US007101475B1

(12) United States Patent
Maaske et al.

(10) Patent No.: US 7,101,475 B1
(45) Date of Patent: Sep. 5, 2006

(54) AUTONOMOUSLY NAVIGATING SOLAR SWIMMING POOL SKIMMER

(76) Inventors: Terry Antone Maaske, 4249 W. Townley Ave., Phoenix, AZ (US) 85051; Denis Louis Ruzsa, 3101 W. Covey Ln., Phoenix, AZ (US) 85027

( * ) Notice: Subject to any disclaimer, the term of this patent is extended or adjusted under 35 U.S.C. 154(b) by 180 days.

(21) Appl. No.: 10/928,550

(22) Filed: Aug. 26, 2004

Related U.S. Application Data

(60) Provisional application No. 60/532,792, filed on Dec. 22, 2003.

(51) Int. Cl.
*E04H 4/16* (2006.01)

(52) U.S. Cl. ..... 210/106; 210/169; 210/232; 210/242.1; 210/407

(58) Field of Classification Search ..... 210/106, 210/143, 169, 232, 242.1, 407; 15/1.7
See application file for complete search history.

(56) References Cited

U.S. PATENT DOCUMENTS

| | | | | |
|---|---|---|---|---|
| 3,268,081 | A | 8/1966 | Menkee et al. | |
| 3,656,624 | A | 4/1972 | Walton | |
| 3,731,813 | A | 5/1973 | Tipton | |
| 3,785,496 | A | 1/1974 | Smith, Jr. | |
| 3,928,206 | A | 12/1975 | Waren | |
| 4,085,049 | A | 4/1978 | Hartwick et al. | |
| 4,322,297 | A * | 3/1982 | Bajka | 210/742 |
| 4,651,376 | A * | 3/1987 | Ford | 15/1.7 |
| 4,900,432 | A | 2/1990 | Arnold et al. | |
| 5,106,492 | A * | 4/1992 | Distinti et al. | 210/91 |
| 5,128,031 | A | 7/1992 | Midkiff | |
| 5,435,031 | A * | 7/1995 | Minami et al. | 15/1.7 |
| 5,507,058 | A * | 4/1996 | Minami et al. | 15/1.7 |
| 5,617,600 | A * | 4/1997 | Frattini | 15/1.7 |
| 5,768,734 | A * | 6/1998 | Dietrich | 15/1.7 |
| 5,788,850 | A | 8/1998 | Tuomey | |
| 5,919,359 | A | 7/1999 | Bisseker | |
| 5,954,972 | A | 9/1999 | Polimeni, Jr. | |
| 6,074,553 | A | 6/2000 | Haski | |
| 6,485,638 | B1 * | 11/2002 | Henkin et al. | 210/143 |
| 2004/0025268 | A1 * | 2/2004 | Porat et al. | 15/1.7 |
| 2004/0092181 | A1 * | 5/2004 | Porat | 441/136 |
| 2004/0168299 | A1 * | 9/2004 | Porat et al. | 29/596 |
| 2004/0173542 | A1 * | 9/2004 | Porat | 210/760 |

* cited by examiner

*Primary Examiner*—Fred G. Prince

(57) ABSTRACT

An autonomously navigating solar swimming pool skimmer employing a forward impeller, navigation being improved by the use of forward mounted powered horizontal bumper wheels as deflectors, combined with occasional reversals of paddlewheels and bumper wheels to clear clogs and navigate away from obstacles. Further improvements include corrosion inhibiting enclosures for motor and electronics, disposable filter media, pool intrusion alarm, an alarm to warn of debris clogs and stuck positions, floatation trim adjustments, debris backwash prevention, electronic control circuitry, intermittent operation during the night, and thrust enhancing features.

22 Claims, 30 Drawing Sheets

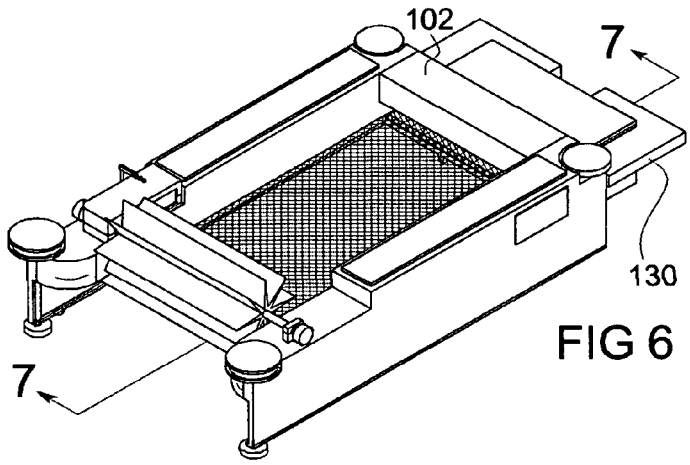
FIG 6
FIG 7
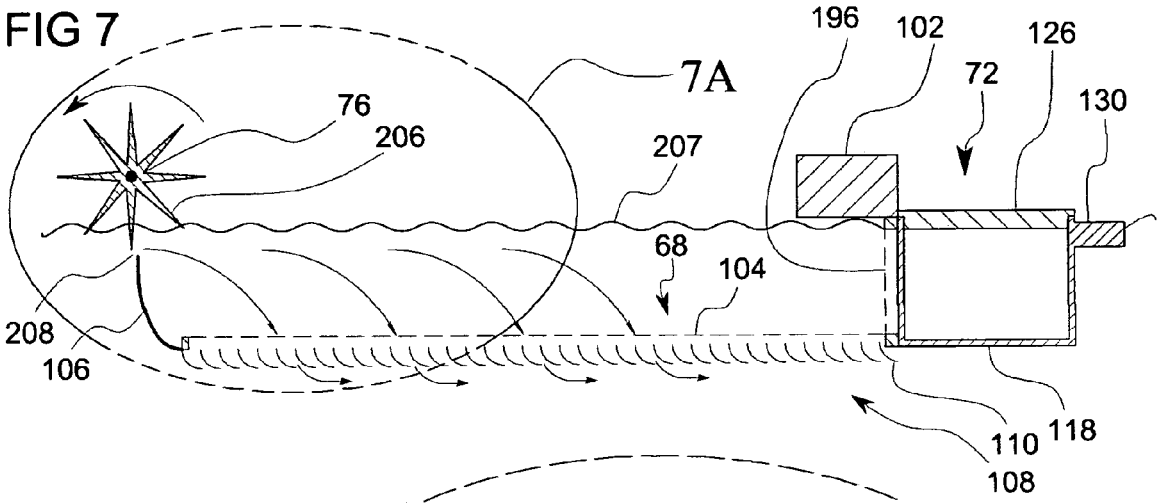
FIG 7A
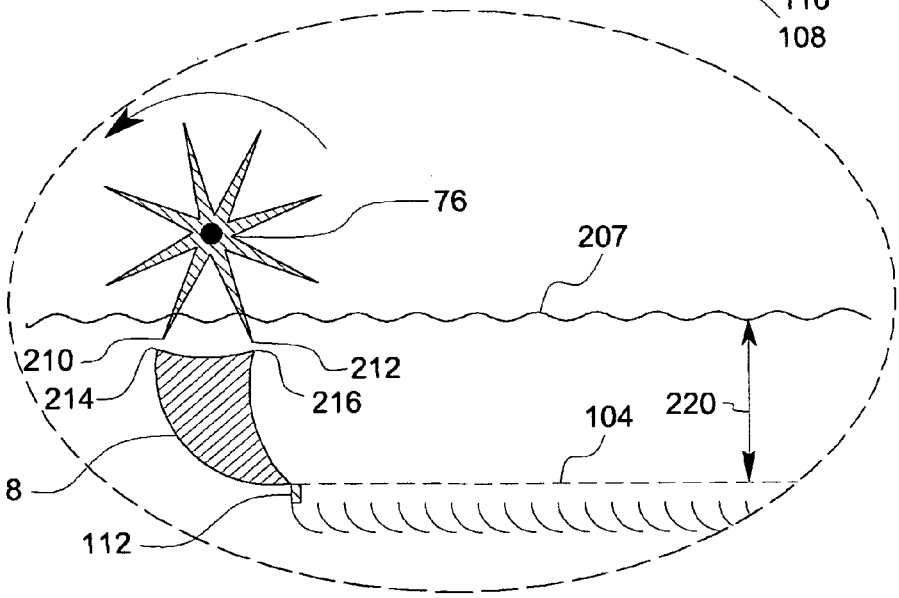

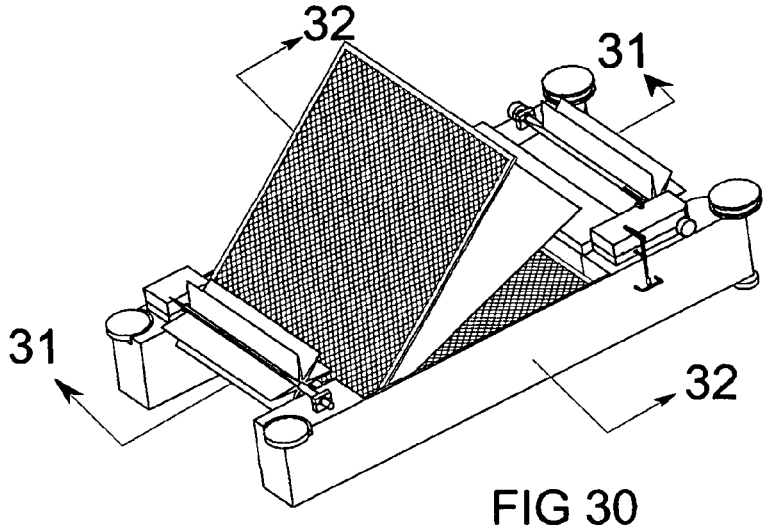
FIG 30
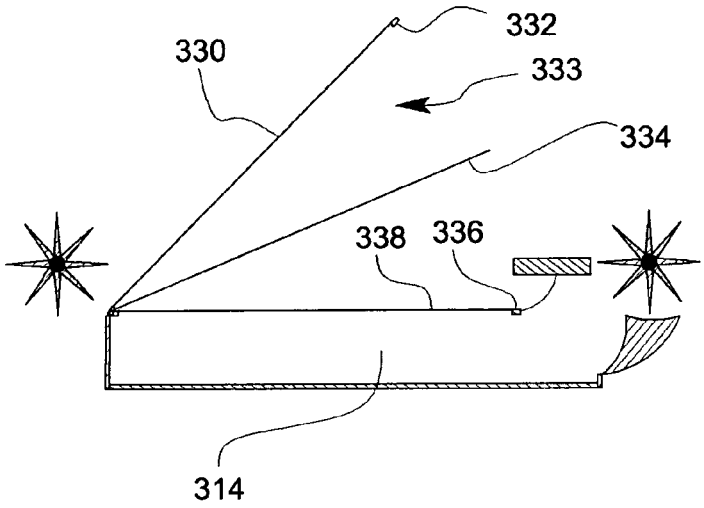
FIG 31
FIG 32
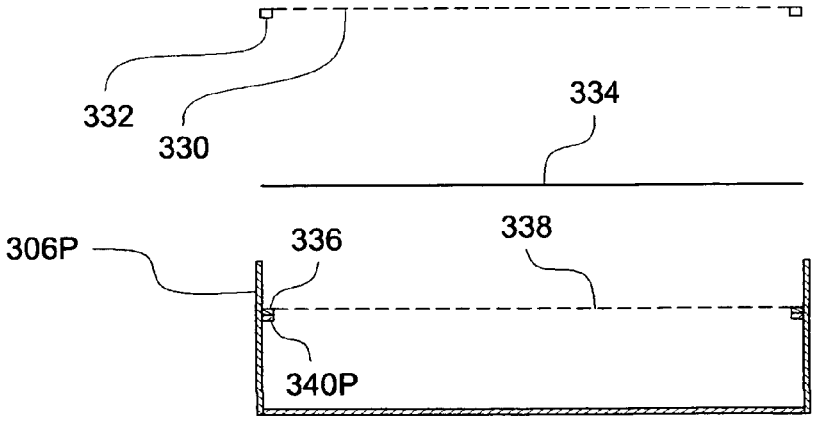

AUTONOMOUSLY NAVIGATING SOLAR SWIMMING POOL SKIMMER

CROSS-REFERENCE TO RELATED APPLICATIONS

This application claims the benefit of PPA Ser. No. 60/532,792, filed Dec. 22, 2003 by the present inventors

FEDERALLY SPONSORED RESEARCH

Not Applicable

SEQUENCE LISTING OR PROGRAM

Not applicable

BACKGROUND OF THE INVENTION

1. Field of Invention

This invention relates to autonomously operating solar powered swimming pool skimmers, specifically to those with mechanisms diverting them from collisions with swimming pool walls.

2. Background of the Invention

Most dirt entering a swimming pool first rests on the water surface as floating debris for a period of hours before sinking. Hand held skimmer nets are labor intensive, and debris typically sinks before a skimming opportunity arises. In the process of using hand held skimmer nets, debris is inadvertently caused to sink to the bottom. Skimmers associated with the main pool filtration system typically operate on timers that also typically miss skimming opportunities. They additionally require immense amounts of electricity relative to the skimming effort being performed, and are frequently precluded from being used by automatic bottom scrubbing devices that are powered by the same main pool filtration system.

Bow mounted paddle wheel style impellers have long been recognized as the most energy efficient dirt, debris, and oil skimming device in harbor skimmers, and have more recently been proposed for use on autonomous self propelled swimming pool skimmers powered by solar cell arrays. This style impeller does not require high skimmer velocity, which is difficult to obtain under limited solar power.

Such solar pool skimmers have the advantages of low power usage, availability when most needed, no cords or hoses, and the ability to propel themselves about the pool. Several such devices have been proposed. Their design is constrained by extremely low energy levels available, the need to prevent backwash of debris back into the pool when turned off, dealing with debris clogged impellers or water entrances, and the difficulty of navigating out of tight corners and away from obstructions, such as ladders and pool toys. Several notable solar skimming devices have been proposed:

U.S. Pat. No. 5,106,492 to Distinti et al. uses a bow paddle wheel effectively for propulsion and skimming, and one embodiment uses a floating weir to limit debris backwash when the unit is off. Such floating weirs function well on high power harbor skimmers, but presents considerable resistance to flow in low power solar skimmers. It has a single un-powered bow deflector wheel on a flexible boom. This deflects the skimmer away from certain wall collisions, but allows it to become stuck in sharp corners, from which there are no means to escape. It includes an interesting warning alarm for a full filter, but that alarm relies on measuring the weight of essentially weightless floating debris.

U.S. Pat. No. 4,900,432 to Arnold et al. uses bow a paddlewheel to throw debris over a barrier to prevent backflow, and uses a secondary sideways thrusting impeller to steer away from a wall. The fixed barrier above water level works well for large harbor skimmers, but creates too great of a workload for a small solar device and severely inhibits propulsion. It also suffers from large debris becoming stranded on top the fixed barrier in normal operations, with no means available for its automatic removal. The side thruster steer away from many stuck positions, but doesn't extract the skimmer from acutely angled corners.

U.S. Pat. No. 5,128,031 to Midkiff uses a pump downstream of a filter rather than the conventional bow paddle wheel, diverting the thrust of the outlet of the pump in a random fashion. Then he employs a solenoid valve to divert the thrust through backwards nozzles in response to bow impacts. This involves forward ram style of debris collection requiring a speed that is beyond the power capacity of reasonable size solar cell arrays. Ram style of filtration requires quite high forwards velocity, difficult to achieve in a solar powered device, and a positive mechanism to inhibit backwash of debris when turned off. Midkiff did not propose any sort of backwash preventing means on the rather wide mouthed water entrance of his invention.

U.S. Pat. No. 6,074,553 to Haski similarly employs a ram filter, and an underwater impeller, utilizing forward protruding rods to act on rear rudders or thrust nozzles, thereby causing collisions to divert the thrust to one side or the other. His device lacks any backwash prevention or mechanism to allow his skimmer to extract itself from acute angled corners. Like other similar devices, it will work well for a time, but requires human intervention frequently when it finally becomes stuck.

Therefore swimming pool skimming devices heretofore known suffer from a number of disadvantages:

a) Manual skimmer nets, while cheap and effective, are labor intensive and typically miss catching debris before it sinks.

b) Many skimmers commonly in use rely on the main swimming pool filters, typically requiring hundreds or thousands of times as much electric power as do autonomous solar powered skimmers. As a result, they are typically not run frequently enough to catch debris before it sinks.

c) Other skimmers require cords and hoses stretched across the pool, creating a hazard for swimmers.

d) Proposed solar skimmers lack autonomous ability to extract themselves from the worst stuck positions.

e) Proposed solar skimmers lack effective and foolproof means of preventing backwashing of debris out of the filter when stopped.

f) Most proposed solar skimmers require more power for skimming and propulsion than is available from reasonable size solar cell arrays.

g) Proposed solar skimmers loose essentially all propulsive effect when used with filters fine enough to filter the finest of dust floating on a pool surface. This fine dust represents a sizeable fraction of the total filtration load.

h) All other skimmers lack provisions for dealing with the severe corrosion problems of motors in swimming pool environments.

BACKGROUND OF THE INVENTION—OBJECTS AND ADVANTAGES

Accordingly, besides the objects and advantages of the autonomously navigating solar swimming pool skimmer described in our above patent, several objects and advantages of the present invention are:

a) to provide an autonomously operating automatic skimmer available for use with sufficient frequency to skim floating debris before it sinks;

b) to provide a skimmer using only a small amount of essentially free solar power to perform the necessary pool skimming duties;

c) to provide a swimming pool skimmer that is autonomously powered and thereby free of hoses and cords that might entangle swimmers;

d) to provide means for a skimmer to extract itself from difficult stuck positions, such as those occurring in the acute corners of a trapezoidal pool;

e) to effectively block already retained debris from being washed back into the swimming pool when the unit is turned off, and to do so without excessive energy cost;

g) to provide propulsive efficiency sufficient to allow the use of very fine filters, capable of catching dust, pollen, etc. that lands on a pool surface;

h) to provide mechanisms to protect motors and electronics from long term corrosion;

Further Objects and Advantages are:

a) to allow propulsion including smooth rolling contact against pool walls, where most debris collects;

b) to provide mechanisms to both avoid clogged impellers and to remove clogging debris automatically;

c) to effectively use disposable filtration media;

d) to more effectively overcome the starting loads of any impeller motor;

e) to effectively navigate a solar skimmer through shadows and recharge storage batteries thereafter;

f) to provide charging means for storage batteries compatible with the special needs of solar skimmers;

g) to provide totally automatic and autonomous operation and navigation of a swimming pool skimmer;

h) to provide warning to humans should an intruder enter the pool, should the skimmer get stuck where it can't extract itself, should the skimmer's filter become full, or should the skimmer's impeller become jammed with debris;

i) to provide short intermittent periods of operation under storage battery power during the night to gather debris prior to its sinking.

Still further objects and advantages will become apparent from a consideration of the ensuing description and drawings.

SUMMARY

In accordance with the present invention an autonomously navigating solar swimming pool skimmer including provisions for self directed navigation, avoidance of debris clogged impellers, control of floatation trim, avoidance of corrosion problems, increase of propulsion efficiency, debris backwash control, useful accessories, finer filtration, and control circuitry.

DRAWINGS—FIGURES

FIG. #

1. Starboard bow Isometric view, Skimmer A Main View

2. Exploded View, major sub-assemblies of Skimmer A

3. Exploded Drive train, Skimmer A

4A. View with filter removed

4B View with filter half way inserted

4C View with filter fully inserted, but without the chemical dispenser installed

5. Starboard bow details, Skimmer A

6. Isometric showing section plane

7. Lengthwise section, Skimmer A, displaying water flow patterns

7A. Enlarged detail of lengthwise section, displaying an alternate version of an inlet dam

8. Isometric showing section plane

9. Lateral section through powered bumper wheels, Skimmer A

10. Isometric showing section plane

11. Lateral section through impeller shaft and dry gear motor assembly, Skimmer A

12. Isometric showing section plane

13. Lateral section of midsection of Skimmer A

14. Isometric showing section plane

15. Lateral section through idler bumper wheels near stern, Skimmer A

16. Isometric showing section plane

17. Lateral section through chemical dispenser of Skimmer A

18. Isometric showing section plane

19. Longitudinal section slicing from impeller to chemical dispenser, Skimmer A

20. Block Circuit Diagram of controller electronics, Skimmer A

21. Bumper wheel operation, beginning of a collision with a pool wall

22. Bumper wheel operation, beginning of deflection away from pool wall

23. Bumper wheel operation, propulsion parallel to wall, after completion of the bumper wheel deflection.

24. Reversing operation, showing skimmer approaching an obstruction

25. Reversing operation, showing skimmer in a stuck position

26. Reverse operation, showing skimmer backing away from obstruction assisted by both impeller and bumper wheel propulsion

27. Master isometric view Skimmer B

28. Lengthwise cross section, Skimmer B, displaying water flow patterns

29A Isometric View, Skimmer B, showing area to be enlarged

29B Enlarged area, Skimmer B, showing dry gear motor area

30. Isometric View, Skimmer B, showing removal of disposable filter

31. Longitudinal central section, Skimmer B, showing removal of disposable filter.

32. Lateral central section through filtration chamber, showing exploded view of filter components.

33. Isometric View, Skimmer B with solar cell array, paddlewheels, drive units, and filters removed for a clearer view of body structure

34. Exploded view, Skimmer B, rear drive train, including dry gear motor structure.

35. Block Circuit diagram, schematic, Skimmer B

36. Isometric master view of Skimmer C, showing movable barrier in the "up" position, and the solar cell array/chemical dispenser lid in the "down" position.

37. Isometric view, with filter raised, showing section plane, Skimmer C

38. Isometric section down longitudinal midline, Skimmer C

39. Isometric view, filters removed, Skimmer C, showing movable barrier lowering and chemical dispenser lid beginning to rise.

40. Isometric view, filters removed, Skimmer C, showing movable barrier fully lowered (closed), and chemical dispenser lid fully open.

41. Isometric view, filters removed, Skimmer C, showing movable barrier fully retracted, chemical chamber lid down, and displaying louver and front dam structure.

42. Isometric view, movable barrier operation, fully closed, Skimmer C

43. Isometric view, movable barrier operation, partially open, Skimmer C

44. Isometric view, movable barrier operation, fully open, Skimmer C

45. Isometric starboard bow details, Skimmer C, displaying vane type motion sensor

46. Exploded view of drive train and movable gate mechanism, including dry gear motor structure, Skimmer C

47. Schematic, theory of operation, fore and aft floatation

48. Block Circuit Diagram of controller electronics, Skimmer C

DRAWINGS—REFERENCE NUMERALS

Note: The letter suffix "P" for "Port" or "S" for "Starboard", added to any reference numeral, shall denote an essentially identical element placed symmetrically in relation to the centerline of the skimmer, with bow defined as the normal forwards direction of movement. This list includes only the first mentioned of Port or Starboard reference numerals. Phrases in brackets ( ) are the preferred shortened term.

FIG. 1

60 Body, of the skimmer (body)
62P Powered bumper wheel, Port
64P Bumper wheel drive means, Port
66P Solar cell array, Port
68 Filter Assembly
70P Idler Bumper Wheel, Port (idler wheel)
72 Swimming Pool Chemical Dispenser Assembly (chemical dispenser)
74S Gunwale, Starboard
76 Impeller

FIG. 2

78 Dry Gear-Motor Assembly
80S Bumper Wheel Drive Pulley, Starboard (pulley)
82 Dry Gear-Motor Box (box)
84 Dry Gear-Motor Box Lid (lid)
86 Dry Gear-Motor Barometric Membrane (membrane)
88 Impeller Shaft (shaft)
90 Impeller Shaft Bearing Assembly
91 Main drive train assembly
92S Powered Bumper Wheel Assembly, Starboard
94 Dry Gear Motor Recess, in body
96S Bumper Wheel Shaft bearing bushing, Starboard (bushing)
98S Bow Extremity of body, Starboard (bow extremity)
100S Narrowing water inlet, Starboard
102 Cross Member
104 Filter Media
106 Inlet Dam
108 Deflector Vane Assembly
110 Deflector Vane, individual, representative (vane)
112 Filter Frame (frame)
114 Battery case
116P Idler bumper wheel shaft bearing bushing, Port (bushing)
118 Swimming pool chemical dispenser box (box)
120 Swimming pool chemical dispenser entrance (entrance)
122 Swimming pool chemical dispenser exit (exit)
124 Swimming pool chemical dispenser box interior (interior)
126 Swimming pool chemical dispenser lid (lid)
128 Swimming pool chemical dispenser mounting clip (clip)
130 Flotation collar
132P Idler bumper wheel shaft, Port (shaft)

FIG. 3

134 Impeller shaft bearing bushing, top half (bushing)
136 Impeller shaft bushing, bottom half (bushing)
138 Gear Motor (conventional)
140 Minimum light photo-sensor (photo-sensor)
142 Magnetic sensor for sail switch (magnetic sensor)
146 LED warning strobe (LED)
148 Microprocessor
150 Motor Start Capacitor (capacitor)
152 Printed Circuit Board, Controller (circuit board)
154 Chemical adsorbent
156 Wire hole (hole)
158 Alarm sounding means (shown as piezo-alarm)
160 Impeller shaft hole (hole)
162 Shaft seal (conventional)
164 Shaft seal (conventional)
166S Lower bumper wheel, Starboard
168S Bumper wheel shaft, Starboard (shaft)
170S Bumper wheel drive belt, Starboard (belt)
172 Motion sensor guard (guard)
174 Motion sensor, sail switch sail (sail)
176 Motion sensor magnet (magnet)
178 Wire hole (hole)
180 LED hole in lid (hole)
182 Photo-sensor hole in lid (hole)
184 Motion sensor mounting strut (strut)
186 Motion sensor, sail switch flexing member (flexing member)
188 Impeller shaft hole (hole)
190 Shaft seal, conventional (shaft seal)

FIG. 4A

192S Filter support lip, Starboard (lip)
194 Inlet dam bottom lip (lip)

FIG. 4B

196 Vertical filter component
198 Filter handle (handle)

FIG. 5

200 Waterline
202 Electric cable leaving Dry Gear Motor box (cable)
204 Intrusion Alarm Sensor (sensor)

FIG. 7

206 Impeller Vane, individual (vane)
207 Waterline
208 Inlet gap, between inlet dam and impeller vanes (gap)

FIG. 7A
210 Impeller vane, individual (vane)
212 Impeller vane, individual (vane)
214 Deep Inlet dam entrance (entrance)
216 Deep inlet dam exit (exit)
218 Deep inlet dam
220 Depth of filter (depth)
FIG. 9
222S Bumper wheel bearing bushing, Starboard (bushing)
223 Waterline
224P Bumper wheel belt flange, Port (flange)
226P Bumper wheel belt groove, Port (groove)
228P Bumper wheel shaft, bottom end, Port (end)
FIG. 11
230 Shaft seal, conventional (shaft seal)
232P Floatation chamber, Port (flotation chamber)
FIG. 15
234 Waterline
FIG. 17
236 Waterline
FIG. 19
238 Waterline
FIG. 20
240 Electrical power means, including solar arrays
242 Battery charger
244 Electrical storage battery
246 Battery isolating diode (diode)
248 Circuit—Detect low battery condition (circuit)
250 Circuit—Detect lack of relative motion (circuit)
252 Circuit—Detect minimum solar input (circuit)
254 Circuit—Microprocessor clock (clock)
258 Circuit—Intrusion alarm (circuit)
260 Alarm—audio (alarm)
148 Microprocessor
264 Microprocessor low battery input (input)
266 Microprocessor lack of motion input (input)
268 Microprocessor minimum light level input (input)
270 Microprocessor clock input (input)
271 Microprocessor output—charge battery (output)
272 Microprocessor output—turn on impeller motor (output)
274 Microprocessor output—reverse motor (output)
276 Microprocessor output—Blinking LED strobe (output)
277 Microprocessor output—slowed motion alarm (output)
278 Circuit—Turn on impeller motor (circuit)
280 Circuit—Reverse impeller motor (circuit)
282 Impeller motor, part of Gear-Motor 138 (motor)
284 LED current limiting resistor (resistor)
288 Circuit—slowed motion alarm circuit (circuit)
290 Output line—slowed motion alarm (line)
292 Motor start capacitor (capacitor)
FIG. 21
293 Swimming pool vertical wall (wall)
FIG. 24
294 Post type obstruction in swimming pool (post)
FIG. 27 Skimmer B
296 Rear drive train assembly
298 Filter assembly
300P Bow floatation chamber, Port side (bow floatation chamber)
302 Solar cell array
304S Stern floatation chamber, Starboard side (stern floatation chamber)
306S Gunwale, Starboard (gunwale)
FIG. 28
308 Rear impeller
310 Waterline
312 Waterline scoop
314 Sump chamber
316 Sump chamber bottom pan (bottom pan)
318 Rear dam
FIG. 29B
320 Magnetic sensor
322 Impeller magnet
FIG. 31
330 Top grid, of filter assembly (top grid)
332 Top grid frame (surrounding top grid) (top grid frame)
333 Top grid assembly
334 Fine disposable filter media (filter media)
336 Bottom grid frame (frame)
338 Bottom grid
FIG. 32
340P Filter frame supports
FIG. 33
342S Tapered inlet, water channel (tapered inlet)
344 Stern impeller well
346 Cavity (in body) to receive rear dry gear-motor assembly (cavity)
FIG. 34
348 Lid, rear dry gear motor box (lid)
350 Top half of hole for impeller shaft (hole)
352 Gear-motor driving rear impeller shaft (gear motor)
354 Barometric adjustment membrane (membrane)
356 Rear dry gear-motor box (box)
358 Bottom half of hole for impeller shaft (hole)
360 Shaft seal, conventional (shaft seal)
362 Porous container of adsorbent chemical (adsorbent chemical)
364 Rear impeller shaft (shaft)
366 Bottom bushing, rear impeller bearing (bushing)
368 Top bushing, rear impeller bearing (bushing)
370 Rear dry gear-motor assembly
FIG. 35
372 Circuit—Detect impeller speed (circuit)
374 Microprocessor input low impeller speed (input)
376 Microprocessor output turn on rear impeller motor (output)
378 Circuit—turn on rear impeller motor (circuit)
380 Microprocessor output to reverse rear impeller motor (output)
382 Circuit—reversing direction of rear impeller motor (circuit)
384 Rear impeller motor, part of a conventional gear motor assembly (motor)
FIG. 36
386 Drive train/movable barrier assembly (C drive train assembly)
388 Movable barrier
390 Filter assembly
392 Solar cell array serving as chemical dispenser lid (solar cell array)
394 Chemical dispenser, integral with body (chemical dispenser)
396S Solar panel hinge, Starboard (hinge)
398 Speed measuring assembly
400 Dry gear-motor assembly, including movable barrier drive,
FIG. 38
402 Front wall, chemical chamber (front wall)
404 Chemical chamber entrance (entrance)
406 Chemical chamber interior (interior)
408 Chemical chamber exit (exit)
FIG. 39
410 Movable barrier shaft (shaft)

FIG. 42
412 Lower lip of movable barrier (lip)
414 Water level
FIG. 45
416 Magnetic sensor for speed measuring assembly (magnetic sensor)
417 Magnet, in impeller of speed measuring assembly (magnet)
418 Impeller, in speed measuring assembly (impeller)
420 Waterline
FIG. 46
422 Lid, dry gear-motor box (lid)
424 Impeller shaft hole in lid (hole)
426 Movable barrier shaft hole in lid (hole)
428 Top bushing, movable barrier shaft bearing (bushing)
430 Bottom bushing, movable barrier shaft bearing (bushing)
432 Movable barrier shaft (shaft)
434 Shaft seal
436 Shaft seal
438 Shaft seal
440 Impeller shaft hole in box (hole)
442 Movable barrier shaft hole in box (hole)
444 Dry gear motor box (box)
446 Movable barrier gear motor (gear motor)
FIG. 47
448 Impeller, schematic representation (impeller)
450 Center point of floatation, bow floatation chambers (point)
452 Schematic bow floatation chamber (bow floatation chamber)
454 Schematic central section of skimmer, with neutral floatation (central section)
455 Schematic stern floatation chamber
456 Arrow, representing deflection of stern downward (arrow)
457 Schematic bow floatation chamber center of floatation
458 Schematic, representation of variable weight, such as pool chemicals (weight)
460 Arrow, representing deflection of stern upward (arrow)
FIG. 48
462 Microprocessor output, to turn on barrier motor (output)
464 Circuit, Turn on barrier motor (circuit)
466 Microprocessor output, to reverse barrier motor (output)
468 Circuit, Reverse barrier motor (circuit)
470 Movable barrier motor, part of movable barrier gear-motor 446 (motor)

DETAILED DESCRIPTION

FIGS. 1–15—Preferred Embodiment

Skimmer "A"

Broad Overview of Embodiments A, B, and C

There are three main embodiments, designated skimmer "A", skimmer "B", and skimmer "C", with the preferred embodiment designated as skimmer A. Skimmer A is functionally the simplest, and serves to introduce the basic concepts and most important features. Skimmer B is a heavier duty device, kept simple, but optimized for heavy duty skimming. And skimmer C can be viewed as a more full featured version of skimmer A, incorporating all major features discussed in both skimmer A and skimmer B, except for the additional rear impeller added in skimmer B.

The three embodiments differ in the following manners:

1. In the mechanism used to prevent backwash of debris backwards through the water inlet (simple geometry in skimmer A, using the main impeller as a barrier in skimmer B, and employing a movable barrier in skimmer C)
2. In the mechanism used to deflect thrust backwards (deflector vanes angled rearward in skimmer A and skimmer C and an enclosure opening rearward in skimmer B)
3. The addition of an extra rear thrusting impeller in skimmer B
4. The use of two different equivalent speed-sensing devices (with skimmer C using a rotary impeller sensor rather than a magnetic sail switch).
5. Deletion of several extra features (chemical dispenser and intrusion and stoppage alarms) in skimmer B
6. Two different means for distributing floatation to compensate for variable swimming pool chemical weights in skimmer A and skimmer C.

Preferred Embodiment—Skimmer "A" FIG. 1–FIG. 15

FIG. 1. Detailed Description:

Terminology—Reference Numerals and Orientation:

FIG. 1 is an introductory isometric view of skimmer A, from the starboard stern position. Since the skimmer functions as a self propelled boat in a swimming pool, the nautical positions Port, Starboard, Bow, and Stern are used throughout all descriptions, to avoid ambiguity, with bow defined as the normal direction of propulsion. Reference numerals with a "P" or "S" suffix refer to an element on Port or Starboard side of the skimmer ONLY when there is an essentially identical component on the opposite side of the skimmer, as mirrored by the longitudinal centerline of the skimmer. For example, port side solar cell array 66P is labeled, but has a counterpart solar cell array 66S on the starboard side that is not given a separate reference numeral.

Basic Parts

The skimmer body 60 is configured as a boat and forms a "U" shaped vessel including two pontoon-like sections bearing the primary floatation chambers of the vessel. The body 60 also forms an enclosure that houses a filter assembly 68 between two pontoon-like segments of body 60. At the bow of the vessel, and extending between port and starboard segments of body 60, is impeller 76. Impeller 76 has a direction of rotation indicated by the nearby curved arrow, with the bottom most vanes of impeller 76 rotating in a direction towards filter assembly 68. The axis of rotation of impeller 76 is horizontal, stretching laterally from port to starboard in a direction transverse to the normal direction of travel of the skimmer.

A powered bumper wheel 62P extends horizontally beyond the outermost port bow extremity of the body 60, and rotates in a direction indicated by the arrow on its top surface. A bumper wheel drive means 64P connects powered bumper wheel 62P rotationally to impeller 76. Similar elements reside on the starboard side, as illustrated by powered bumper wheel 62S. Note that powered bumper wheel 62S has a direction of rotation opposite of that of bumper wheel drive means 64P. Powered bumper wheel 62S normally rotates clockwise, looking from the top, with its gunwale perimeter moving from bow to stern. Powered bumper wheel 62S extends beyond both the bow extremity of the body 60 and the starboard gunwale 74S so that it can, at the same time, act as a bumper for the bow of skimmer body 60 and a fender for the starboard gunwale 74S.

At the stern of body 60 proper, there are idler bumper wheels represented by port idler bumper wheel 70P. Idler bumper wheel 70P is also a horizontal bumper wheel extending beyond the vessel's port gunwale. But idler bumper wheel 70P, and its starboard compliment, lack drive means, and merely serve as rotational fenders and deflectors.

Two solar cell arrays, represented by solar cell array, port 66P, are mounted high on the body, so as not to be shadowed by any portion of the skimmer's superstructure. At the stern of the vessel is a swimming pool chemical dispenser assembly 72, which is a box hanging on the rear of the vessel that is used to contain and dispense dry swimming pool chemicals.

FIG. 2 Exploded View (More Detail)

FIG. 2 is an isometric exploded view of all of the major sub-assemblies of the skimmer, this time from a port bow perspective. The description begins at the top left corner:

Dry gear-motor assembly 78 appears externally as an approximately hermetically sealed dry gear-motor box 82 having a dry gear-motor box lid 84 and a dry gear-motor box flexible barometric membrane 86 designed to allow adjustment of the air pressure inside the box to match the ambient air pressure outside. An impeller shaft 88 extends both to port and starboard from the dry gear-motor assembly 78, with impeller 76 being concentric about the shaft 88 on the starboard side. An impeller shaft bearing assembly 90 secures shaft 88 to body 60, while allowing free rotation of shaft and impeller. At either end of shaft 88, and concentric about it, are two pulleys, represented by bumper wheel drive pulley, 80S on the starboard side.

The main drive train assembly 91 includes all of the elements of the preceding paragraph, namely elements 76,78, 80S, 80P, 82, 84, 86, 88, and 90, plus all the internal and external components of the dry gear-motor assembly 78.

The powered bumper wheel assembly, starboard 92S can be seen to fit rotationally inside of a bumper wheel shaft bearing bushing, starboard 96S, residing in vertical hole in body 60 very near its starboard bow extremity 98S. Note: here and following, we will make no more mention of the identical components mirrored on the opposite side of the vessel midline when the "P" for Port or "S" for starboard suffix is used to designate one of two identical parts.

On the starboard side of body 60 can be seen a dry gear-motor box recess 94 where dry gear-motor assembly 78 can be seen to fit. With attached parts removed, the "U" shaped design of body 60 is more apparent, with two pontoon-like structures being connected by a cross member 102.

The relatively large opening at the bow of the "U" shaped body 60 is made even wider at the bow by the narrowing water inlet 100S. The entrance at the bow of the vessel tapers wider, at the waterline, toward the bow extremity 98S. The impeller 76 and its horizontal shaft 88 can be seen to straddle the opening just to the stern of the narrowing water inlets 100S and 100P.

The relatively great weight of the dry gear-motor assembly 78, located on the port bow corner of the skimmer, may be counterbalanced by placing any electric storage battery 244 (FIG. 20) in the device into a conventional battery case 114, diagonally opposite dry gear-motor assembly 78. These relative positions have no inherent advantages, other than floatation balance, since both dry gear-motor assembly 78 and electric storage battery 244 represent the heaviest concentrated weights aboard the skimmer.

At the port stern corner of body 60 is a vertical hole including idler bumper wheel shaft bearing bushing 116P, that conveniently fits, and allows free rotation of idler bumper wheel 70P and its vertical Idler bumper wheel shaft 132P.

The filter assembly 68 consists of filter media 104 stretched across a filter frame 112. Filter frame 112 provides filter media 104 with sufficient rigidity for filter assembly 68 to be removed, handled, and cleaned. The filter media 104 is illustrated as a screen, but experiments with finer filtration media have also been successful.

Underlying filter assembly 68, and immediately below it with skimmer assembled, is the deflector vane assembly 108. One individual representative deflector vane 110 is a curved louver type of vane showing curvature to deflect downward flowing water towards the stern of the vessel. While shown as a separate assembly in the exploded view drawing, it is advantageous in practice to have the individual vanes, such as vane 110, rigidly attached to body 60 at both port and starboard ends of each vane. This helps provide extra rigidity for the "U" shaped body 60.

An inlet dam 60 sits immediately forwards of the deflector vane assembly 60, and with skimmer assembled, directly below, and parallel to, impeller 76. Inlet dam 60 serves to block the lower portion of the water inlet into the filter assembly 68, and only allow a relatively wide and shallow water inlet to be formed, with impeller 76 located in that shallow water inlet region.

The swimming pool chemical dispenser assembly 72 includes a swimming pool chemical dispenser box 118, and a swimming pool chemical dispenser lid 126. The chemical dispenser box 118 further includes clips, such as swimming pool chemical dispenser mounting clip 128S that is designed to fit snuggly over the stern portion of filter frame 112 when assembled. Box 118 also includes a swimming pool chemical dispenser entrance 120 and a swimming pool chemical dispenser exit 122. While these are drawn as open holes, they can also be fitted, as is common practice with pool chemical dispensers, with adjustable orifices or screens to limit debris or water flow. The last feature of box 118, is a floatation collar 130, designed to be located immediately above the normal water level. The precise location of this floatation collar can be anywhere near the stern of the skimmer, not necessarily connected directly to chemical dispenser assembly 72. It is illustrated as part of the chemical dispenser box 118 because it is linked to it functionally.

FIG. 3 Dry Gear-motor Assembly

Definitions and overview: The dry gear-motor principle is a means to operate a conventional gear-motor in the corrosive environment of a swimming pool. It incorporates a hermetically sealed box incorporating a conventional motor and any necessary electronics, a drying chemical, and a flexible membrane to limit influx and egress of moist air during atmospheric pressure changes.

FIG. 3 is an exploded isometric view of main drive train assembly 91, and its linkage to powered bumper wheel assembly, starboard 92S, and further including internal parts of the dry gear-motor assembly 78.

Dry Gear-motor Box Lid 84, and Attaching Parts

At the top of FIG. 3 is the dry gear-motor box lid 84. Connected to this lid 84 is a motion sensor mounting strut 184, which is a rigid strut extending outward on the starboard side from lid 84. Connected rigidly to strut 184, and projecting downward from it, is a sail switch flexing member 186. Flexing member 186 must be thin in the bow to stern direction, flexible, and springy, especially in its uppermost portion. A springy durable material, such as a stainless steel or fiberglass composite material, is desirable. Motion sensor magnet 176 is oriented such that it lines up with magnetic sensor 142 when the skimmer is fully assembled. Sail switch sail 174 is a widened extension at the bottom of flexing member 186, projecting a widened profile when seen from the bow or stern view. Motion sensor guard 172, shown here as free floating object surrounding sail 174, is really connected to the skimmer body's gunwale 74S, as can be seen clearly in FIG. 5.

Also included in lid 84 are holes LED hole 180, photosensor hole 184, wire hole 178, and Impeller shaft hole 188. Holes 180 and 182 allow the projection upward through the lid of two electronic components, minimum light photosensor 140 and LED warning strobe 146. These elements are glued in place in holes 180 and 182 respectively to form a hermetic seal with the lid 84 when fully assembled. Hole 178 represents the top half of a hole required for the passage of electrical cable out of the dry gear-motor assembly 78. Hole 178 is also hermetically sealed by glue or other conventional sealing techniques, when the skimmer is fully assembled. Hole 188 is the upper half of a shaft hole, including a conventional shaft seal 190.

FIG. 3: Impeller 76 and Attaching Parts:

A brief overview:

Impeller 76 is mounted concentrically about a shaft 88. Shaft 88 extends laterally to port to drive pulley 80S and laterally to starboard, through conventional gear-motor 138, and all the way to drive pulley 80S. Pulley 80S is shown rotationally connected to powered bumper wheel assembly 62S by means of bumper wheel drive belt 170S In more detail:

Bumper wheel drive pulley 80P is rigidly connected to the port extremity of shaft 88 by conventional fastening means. Conventional fastening means may include gluing, crimping, molding about the shaft, or set screws, and may be used to secure pulleys and other structures to rotating shafts in this and other embodiments. Pulley 80P, and other pulleys, on the skimmer, should preferably be made of a corrosion resistant and ultra-violet light stable material such as a UV stabilized plastic, or a corrosion resistant metal alloy.

Impeller shaft bearing bushings 134 and impeller shaft bushing 136 combine to form a bearing allowing free rotation of shaft 88S, and securing it to the port side of skimmer body 60, as can be more clearly seen in FIG. 1.

Impeller shaft 88 is preferably made of a corrosion resistant metal alloy. If a shaft is made of plastic or composite material it must be considerably larger in diameter than shown. A particularly favorable combination of materials is to make the shaft 88 of stainless steel and the bushings 134 and 136 of nylon, Teflon, or similar low friction material. While other combinations of shaft and bearing materials work well, these behave favorably in the corrosive environment of a swimming pool.

Impeller 76 is shown as a single piece molded plastic paddle wheel type of impeller, securely fastened to, and concentric about impeller shaft 88. This can be more clearly seen in FIG. 11. Other horizontal shaft impeller designs may be substituted freely. It is also possible to make a cast impeller 76, where impeller 76 and shaft 88 are molded of a single material, or a molded impeller 76, where impeller 76 is molded in place concentric about a shaft 88, where the shaft 88 is of a different material, such as stainless steel.

Shaft 88 extends to starboard through impeller 76 and into and through conventional gear-motor 138. An additional bumper wheel drive pulley 80S is fastened securely to the starboard extremity of shaft 88, as can be more clearly seen in FIG. 11.

Conventional gear-motor 138, here represented as a simple box, contains an electrical motor and rotary transmission means that result in the rotation of impeller shaft 88 at a relatively low speed. Gear-motor 138 should ideally have several characteristics: It should contain an easily reversible electric motor, such as a DC motor that reverses upon swap of polarity of its leads. In embodiment skimmer A only, it should be wired to run at a lower speed in reverse than it will run rotating in the normal forwards direction. The electric motor should ideally have a very low current draw in normal operation, and the gear train of gear-motor 138 should have the lowest possible parasitic energy loss. Energy efficiency is critically important, due to the relatively low availability of electrical current on any solar powered device. Corrosion resistance is not particularly required, since that is taken care of by the exterior enclosure. But high efficiency, durability, and long life are desirable. The shaft output speed is not highly critical. But relatively low speeds, such as approximately 100 RPM, are favorable rotation speeds for the output impeller shaft 88. Excessive speed wastes impeller energy in splashing and too low of speed slows operation of the skimmer.

Powered bumper wheel assembly, starboard 92S and connecting structures:

FIG. 3:

Shaft 88 is connected rotationally to powered bumper wheel assembly 92S at its starboard extremity by a conventional rotary energy transmitting means 64S. For simplicity of understanding, this is represented by a pulley and belt transmission in these drawings. Transmission bumper wheel drive means 64S includes pulley 80S, being driven by the starboard end of shaft 88, and a belt 170S, which wraps in a conventional manner about a pulley included in the perimeter of powered bumper wheel 62S.

A belt 170S is particularly convenient, since simply twisting the belt can reverse rotational direction of powered bumper wheel assembly 92S. Since Powered bumper wheel assembly 92P, on the port side and not shown here, must rotate in the opposite direction, a corresponding port side belt 170P will merely be given an extra twist upon installation, most clearly seen, enlarged, in FIG. 5.

Transmission bumper wheel drive means 64S can alternatively consist of other conventional rotary energy transmission means, not shown, such as a combination of bevel gears, worm gears, or friction drive rotational transmission means.

A particularly useful variation of bumper wheel drive means, starboard 64S, not illustrated, could include a vertical bevel gear substituted in place of pulley 80S, at the end of shaft 88. Said vertical bevel gear could then mesh with a horizontal bevel gear, which could in turn drive a horizontal intermediate drive gear, said intermediate drive gear meshing rotationally with a gear rigidly mounted on, and concentric with, bumper wheel assembly 92S, whereby it could be rotated in the desired direction. Since the bumper wheel assembly 92P, not shown in this drawing, must rotate in the opposite direction, its intermediate drive gear could then be omitted to maintain the desired rotational direction.

Powered bumper wheel assembly 92S consist of 3 major parts; powered bumper wheel 62S, bumper wheel shaft 168S, and lower bumper wheel 166S. Powered bumper wheel 62S must be configured to meet two requirements: Powered bumper wheel 62S must first act as a bumper, and therefore be sturdy, durable, and capable of maintaining rotation during collisions with swimming pool side walls. Powered bumper wheel 62S must secondarily include means to engage rotationally with bumper wheel drive means 64S. For illustration purposes, it is shown with a belt about its perimeter. Powered bumper wheel 62S, shaft 168S, and lower bumper wheel 166S are all rigidly connected together, to rotate as a unit, by conventional means. Materials used in these elements must all be corrosion resistant and durable. Shaft 168S must particularly be resistant to bending on impact, and resistant to corrosion, since it must freely rotate inside of a bearing bushing 96S (FIG. 2). Powered bumper wheel 62S and lower bumper wheel 166S may preferably be made out of a non-marking rubber or plastic material, since they will frequently make contact with rough and light colored swimming pool walls. It is possible to fabricate the entire powered bumper wheel assembly 92S out of a single molded material. However, it is somewhat advantageous for either lower bumper wheel 166S or powered bumper wheel 62S to be initially separate from bumper wheel shaft, 168S, and then secured firmly together after assembly of bumper wheel shaft, 168S into its bearing bushing 96S (FIG. 2). See FIG. 9 for a clearer illustration of such an assembly.

Printed Circuit Board, Controller 152 and Connecting Elements

FIG. 3: Overview:

Printed circuit board 152 can be seen to normally reside inside of the hermetically sealed dry gear-motor assembly 78. While only a few of the necessary components are represented pictorially in the drawing, circuit board 152 is intended to include the majority of electronic components required for operation of the complete skimmer. Further possible details are shown more clearly in schematic form in FIG. 20, FIG. 35, and FIG. 48, representing skimmer embodiments A, B, and C respectively. Several of these features may be interchanged freely between embodiments, except for those specific for the operation of a piece of hardware limited to that particular embodiment.

Printed circuit board 152 represents a conventional circuit arrangement for the several electrical circuits required for the control of gear-motor 138 and various other components. Circuit board 152 is shown here, and in the electrical schematics in FIG. 20, FIG. 35, and FIG. 48, as being centered around a microprocessor 148. It is also possible to substitute a number of discrete dedicated circuits working independently to perform the same functions in place of the unitary microprocessor 148.

At the very top of the printed circuit board 152, and protruding beyond its top edge, are two electronic elements; minimum light photo-sensor 140 and LED warning strobe 146. LED 146 and photo-sensor 140 can be seen to both align with, and protrude through, hole 180 and hole 182 in lid 84 after dry gear-motor assembly 78 is completely assembled, and where they are visibly located near the very top of the assembled skimmer.

Motor start capacitor 150 is a high value capacitor sized sufficiently large to avoid significant instantaneous voltage drop upon starting gear-motor 138. Capacitor 150 is optional if storage battery 244 (FIG. 20) has sufficient instantaneous current capacity to overcome the gear motor's starting load.

Magnetic sensor 142, while mounted on circuit board 152, interacts with the magnet 176 and the sail 174, to effectively form a magnetic sail switch transmitting a magnetic signal from the outside to the inside of box 82. This magnetic sensor 142 may consist of any magnetically sensitive circuit, including reed switches, Hall effect sensors, arrays of reed switches, or coil type of magnetic pick-ups. Each of these has unique characteristics.

If magnetic sensor 142 consists of a single reed switch, it provides a digital signal indicating presence or absence of a certain level of water motion. If sensor 142 consists of a Hall effect sensor, it can provide analog information about the level of relative water motion. If sensor 142 consists of an array of reed switches, it can provide digital switched information of certain threshold levels of relative water motion. And if sensor 142 includes a magnetic coil pickup, it provides analog data on the change of rate of motion, which must be integrated prior to interpreting the output data.

It is also possible to directly substitute for magnetic sensor 142 any type of sail switch or velocity meter employing or not employing magnetic transmission of the mechanical motion signal.

Chemical absorbent 154, shown adjacent to circuit board 152, is not necessarily connected to it. Chemical adsorbent 154 is shown as a box, and represents a porous container containing a relatively large amount of a non-corrosive chemical absorbent, such as silica gel. Chemical absorbent 154 must be chemically neutral and non-corrosive, so as not to contribute to corrosion of electrical parts, and must absorb relatively large amounts of moisture and chlorine gas over the extended lifetime of the unit.

Chemical absorbent 154 may also include chemicals commonly known to specifically neutralize the effects of free chlorine gas and hydrochloric acid fumes, since these gasses commonly exist in swimming pool environments, and are particularly corrosive to electrical conductors.

Dry Gear-motor Box 82, and Associated Elements

Dry gear-motor box 82, can be seen to combine with lid 84 to form a hermetically sealed container enclosing elements associated with circuit board 152, chemical absorbent 154, and gear-motor 138. Specific fastening and sealing mechanisms between box 82 and lid 84 are not shown, but can include a number of conventional sealing technologies. The simplest technique involves simply gluing box 82 and lid 84 together with a suitable durable and airtight adhesive joint. This can be accomplished most easily if box 82 and lid 84 are made out of a plastic material compatible with solvent welding gluing techniques.

Box 82 and lid 84 may also be secured by other conventional technologies. One favorable gluing technique is to make the mating surfaces relatively large, and then secure them together with a silicone based adhesive, or similar elastomeric substances. This produces a joint with favorable ultra violet resistant properties, assuming the box 82 and lid 84 materials are themselves compatible with a secure bond with silicone adhesive. A second alternative is to provide a gasket, then secure lid 84 to box 82 with bolts, screws, or conventional clamping devices.

Box 82 can be seen to have a large gap in its port wall, preventing a complete hermetic seal upon placement of lid 84. This gap is intentional, and is closed hermetically by barometric membrane 86. The seal about the edges of membrane 86 may be by a number of conventional techniques, with simply silicone gluing being favored.

Membrane 86 is shown as a flat membrane, but may take on any shape, including bellows, that will facilitate easy self-adjustment of barometric pressure inside and outside of box 82. Choice of materials is severely limited by the stringent flexibility and ultra violet resistant requirements. Silicone membranes, silicone impregnated fabric membranes, stainless alloy bellows, and ultra violet stabilized plastic bellows each have some favorable properties. For a membrane shaped as shown, silicone impregnated fabric is particularly favorable. Less flexible materials favor bellows shaped membranes.

The choice of materials for membrane 86 may be considerably enhanced if box 82 is redesigned so that membrane 86 is not subjected to sunlight or severe physical abuse. This could be accomplished by placing the barometric adjusting membrane 86 inside of a protected chamber. This complexity, though advantageous, renders understanding of the illustration of box 82 considerably more difficult, without affecting the theory of operation.

An alarm sounding means 158 is shown attached to the inside surface of membrane 86. This alarm sounding means may be something as simple as an audible electronic alarm, such as a piezo alarm, or a loudspeaker/oscillator circuit. Alarm sounding means 158 placed on the flexible membrane then serves the useful purpose of both freely transmitting sound and still allowing alarm means 158 to be protected from the weather.

An alternative to the simplest alarm sounding means 158 is to place, anywhere inside of box 82, a conventional remote transmitter designed to trigger a remotely located audible or visual alarm within the range of said remote transmitter.

Box 82 can be further seen to possess holes, such as impeller shaft hole 160, designed to accept impeller shaft 88, one on each of the port and starboard sides of box 82 respectively. Such holes are needed for the passage of the low speed shaft 88, and must include conventional shaft seals such as shaft seal 162, and shaft seal 164, with one additional shaft seal shown in the mating lid 84 as shaft seal 190, and an additional such shaft seal hidden from view on the port side of lid 84. Such shaft seals are required, on this and other embodiments, wherever moving shafts pass through the walls of a dry gear motor assembly.

FIG. 4A, FIG. 4B, and FIG. 4C

Filter Assembly 68

FIG. 4A, FIG. 4B, and FIG. 4C present simplified isometric representation of the skimmer, each showing the relationship of skimmer body 60 to filter assembly 68.

FIG. 4A displays filter assembly 68 fully removed from its normal position inside skimmer body 60, but aligned with a filter support lip 192P on the lower port gunwale's interior surface. The arrow indicates the direction of motion of filter assembly 68, as it is slid towards inlet dam 106, where it is intended to mate with the inlet dam bottom lip 194 of inlet dam 106.

Filter support lip, Starboard 192P is conveniently located to both receive and support filter assembly 68, as can be seen in FIG. 4B, where filter assembly 68 can be seen to be partially slid into body 60, supported by filter support lip 192P and its mate on the starboard side. A filter handle 198 is conveniently located on the rear of filter assembly 68, for human handling of filter assembly 68. Vertical filter component 196 is an upward projection of filter assembly 68, designed to fit and seal to a cavity in the rear of body 60, as is clearly seen in FIG. 4C. It is further convenient for receiving and holding chemical dispenser assembly 72 by its clips, such as clip 128S (FIG. 2).

FIG. 5 Starboard Bow Details, Skimmer A

FIG. 5 shows an isometric view of bow details of Skimmer A, from the starboard side, especially showing drive train and dry gear-motor exterior details.

Port Bow (top of FIG. 5)

Impeller shaft 88 can be seen clearly supported by impeller shaft bearing assembly 90.

Impeller shaft bearing assembly 90, in turn, can be seen supported by the port bow deck section of body 60. While assembly techniques are not shown, it would be conventional to secure impeller shaft bearing assembly 90 to such a deck with glue and secure the two halves of impeller shaft bearing assembly 90 together with screws. Also note, on the port bow, that powered bumper wheel 62P rotates in a clockwise fashion, as shown by the arrow on its surface, while its starboard counterpart, powered bumper wheel 62S rotates in a clockwise fashion. This can be clearly seen to be the result of the half twist in belt 170S that drives powered bumper wheel 62P, while no such twist exist in the corresponding belt 170S on the starboard side.

Starboard Side (Bottom Left of FIG. 5)

Waterline 200 represents the approximate operating waterline on gunwale 74S of the floating skimmer. Solar cell array 66S represents one of two solar arrays on the skimmer. The decision to display two small solar cell arrays, rather than only one large array, was entirely arbitrary, and based only on the relatively narrow available areas near the top of the skimmer. The other two embodiments, B and C respectively, display only a single solar cell array. There would be no electrical differences, with the possible exception of the desirability of isolating diodes in the case of two or more solar cell arrays Electric cable leaving Dry Gear-motor box 202 is shown here (but in no other drawing) to demonstrate how electrical cables exit dry gear-motor assembly 78, or other dry gear motor assemblies in other embodiments. Wire hole 156 in lid 84 combines with hole 178 in dry gear-motor box 82 to form a single complete hole for passage of cable 202. By placing electrical cable holes, and any other necessary openings, at the joints between lid 84 and box 82, it facilitates achieving a hermetic seal in the assembled box, perhaps with the assistance of elastomeric adhesives such as silicone. Electrical cable 202 is displayed entering solar cell array 66S, and a similar cable is implied, but not shown, stretching to the corresponding port side solar cell array 66P, not shown here, but visible in FIG. 1.

LED warning strobe 146 and minimum light photo-sensor 140 can be seen protruding through their respective openings in lid 84, in this fully assembled dry gear-motor assembly 78. Both LED 146 and photo-sensor 140 need to be in a high and visually unobstructed mounting position, since the use of either becomes compromised if free light passage is obstructed.

Sail switch sail 176 is clearly shown as dipping below waterline 200. Motion of the surrounding water relative to the vessel causes motion of sail 174 in either of the directions indicated by the arrows. Such motion is also transmitted through flexing member 186 to cause lateral motion of sail switch magnet 176. Magnet 176 is also aligned with magnetic sensor 142, inside of box 82, not shown here, but visible in FIG. 3. Motion of sail 174, as shown by the arrows, is clearly confined and limited by motion sensor guard 172. This guard 172, present in all embodiments, is necessary to shield motion-sensing equipment from debris and impact.

While guard 172 is shown secured to starboard gunwale, starboard 74S, other configurations for protecting motion-sensing equipment are possible. One obvious variation is to place motion-sensing equipment, such as sail 174 and magnet 176, into a protected water channel carved into the gunwale 74S, or some other convenient location on skimmer body 60. While such internal locations for motion sensing equipment is desirable for protection of delicate equipment, external location was chosen here for clarity of illustration.

Extreme Lower Left, FIG. 5:

Intrusion alarm sensor 204 is shown at the extreme bottom of the vessel, and displayed as a simple shallow cylinder. Alarm sensor 204 is a necessary component of any optional conventional intrusion alarm system added to the skimmer. Since intrusion alarms are conventional devices, with various configurations and components, this representation is schematic. As drawn, it could very easily represent a sonar based intrusion sensor that would simply be a sonar transceiver located well below waterline 200. Obviously, other types of conventional motion sensors may have other shapes, and require mounting in other locations on body 60, for maximum performance. While not represented pictorially, it is implied that as much as possible of remaining electronic components of a conventional intrusion alarm be encased inside of dry gear-motor box 82.

General note on intrusion sensors:

The physical movements of the skimmer may, under some circumstances, give a false reading of an intruder entering a swimming pool. Location of and nature of sensor 204 will influence this. In particular, Doppler sonar sensors must be shielded, as far as possible from false readings caused by motion of impeller 76, and wave detectors must be shielded from the waves kicked up by impeller 76. Furthermore, impact of the skimmer with a swimming pool sidewall may trigger false readings in several classes of sensors.

For these reasons, it may also be necessary to turn off, or decrease the sensitivity of the intrusion alarm system during periods of skimmer operations. It may also be wise to prevent alarms being given in the seconds surrounding impact of the skimmer with a sidewall. A short time delay in any swimming pool intrusion circuit would be beneficial in facilitating such temporary alarm shutdowns, without triggering an alarm.

Lastly, attention is called to the very bottom of the starboard bow. Lower bumper wheel 166S is shown clearly protruding both beyond the starboard bow extremity 98S, both as a bow bumper and a gunwale fender, at the very bottom of skimmer body 60. Lower bumper wheel 166 has been found to be particularly useful as a deflector preventing the skimmer body 60 getting stuck on submerged swimming pool steps. It can only be safely eliminated if the depth of draught of skimmer body below waterline 200 is very shallow.

FIG. 6, FIG. 7, and FIG. 7A,

Longitudinal Sections

FIG. 6 is an isometric view of skimmer A displaying the section plane for sectional views in FIG. 7 and FIG. 7A. Cross member 102 and Flotation collar 130 are particularly pointed out for the purpose of making their orientation clearer in sectional view in FIG. 7.

FIG. 7 Overview:

FIG. 7 is a longitudinal sectional view, somewhat to port of the midline of the skimmer. A dashed oval displays the portion displayed in expanded view in FIG. 7A. An arrow above impeller 76 displays its normal direction of rotation. And a series of arrows extending from the lower right of impeller 76 displays the normal path of water propelled by impeller 76.

Impeller 76 and Inlet Dam 106

Impeller 76 is shown in section, displaying multiple vanes such as the individual representative impeller vane 206. A particular positioning of impeller 76 with respect to waterline 207 is desirable. The depth of bite of the impeller vanes into the water has a minimum desirable value determined by that point where at least two vanes touch the water at all times. It can be seen, in the present drawing, that raising impeller 76 just a tiny bit more will lift vane 206, and the corresponding vane on the opposite side of the impeller, out of the water. Experiments performed indicate that propulsion efficiency deteriorates, but does not vanish, at lower depths of vane penetration into the water.

Experiments also indicate that it is critical that there always be at least one vane of impeller 76 in the water at all times, and that end clearance between impeller 76 and the skimmer body 60 (not shown in this drawing) also be minimized. This is due to the tendency of still floating debris, already captured by the skimmer, to find its way back out between vanes of the impeller, if no vane is presently touching the water surface 207. This, and other types of backwash of debris out of the filter assembly 68, is dealt with in greater depth later in this description.

Inlet dam 106 is a simple curved surface that may be a portion of a hollow cylinder or similar smoothly curved surface. Its upper lip is shown just slightly aft of the center of impeller 76, clearing the impeller vanes by a small predetermined distance. Inlet gap, between inlet dam and impeller vanes 208 represents the minimum clearance between vanes of impeller 76 and the top lip of inlet dam 106.

The small clearance shown for inlet gap 208, and the design of inlet dam 106 is a departure from prior art that will result in occasional debris clogged impellers. This is permissible in the present design largely because of the designed ability of the impeller to automatically reverse itself briefly to clear such debris clogs.

Inlet dam 106 has a distinctive curvature and placement relative to impeller 76 resulting in a portion of the propelled water stream moving first downward in front of inlet dam 106, and then backwards, following its streamlined shape. This design allows for a small amount of direct backwards thrust from the impeller that is not inhibited by the resistance of water flowing through filter media 104.

Filtration

Filter media 104 is drawn as a simple fine screen, such as is commonly used in manual swimming pool skimmer nets. It is also possible to utilize a more complex, and finer, filtration system, such as that displayed in skimmer B and skimmer C. Filter media 104 lies just a short distance above deflector vane assembly 108, which may provide additional support under the filter.

Vertical filter component 196, spaced a short distance in front of chemical dispenser box 118, allows additional filtration capacity in a rearward direction. While no path of water exit is obvious in FIG. 7, FIG. 19 and other figures show clearly that water can exit both around and through chemical dispenser box 118.

Deflector vanes:

Deflector vane assembly 108 is arranged with vanes, such as individual deflector vane 110, that have curved surfaces that encourage water exiting from filter media 104 to be turned to exit in a predominantly rearward direction, thereby increasing thrust.

The theoretical ideal shape of individual deflector vanes, such as vane 110, is a smooth curve, nearly vertical at the top, converting to nearly horizontal at the bottom of each vane, with the theoretical ideal smooth curvature approaching being a hyperbola. Due to the extremely low velocity of water flow, even rough approximations of the ideal will suffice.

FIG. 7: Chemical dispenser assembly 72 and cross member 102:

Chemical dispenser 72 can be seen to include dispenser box 118, dispenser lid 126, and floatation collar 130. Not shown in FIG. 7, but visible in FIG. 19, are entrance 120 and exit 122. Also not shown in FIG. 7, but visible in FIG. 2, are dispenser clips, such as clip 128S, that serve to secure chemical dispenser assembly 72 rigidly to vertical filter component 196, holding dispenser assembly 72 firmly in place when assembled. In skimmer A, chemical dispenser assembly 72 will therefore be removable from the skimmer along with filter assembly 68.

Floatation collar 130 is shown slightly below waterline 207, which is the position expected when chemical dispenser 72 is heavily loaded. The increased floatation displacement of floatation collar 130 helps limit further settling of the stern of the skimmer. And, with even further increased weight, it can be seen that the additional floatation of cross member 102 will be added to the total floatation displacement of the stern of the vessel.

FIG. 7A and Alternative Deep Inlet Dam 218

FIG. 7A is an enlarged sectional view of the forwards portion of FIG. 7, displaying impeller 76 in a different rotated position, and with inlet dam 106 replaced with deep inlet dam 218.

With deep inlet dam 218 in place, rather than inlet dam 106, impeller 76 can act as a positive displacement pump. For this variation to be effective, the dimensions of the top of deep inlet dam 218 are critical. The spacing of deep inlet dam entrance 214 and deep inlet dam exit 216 must be at least as great as the spacing between the tips of any two adjacent vanes of impeller 76, such as impeller vane 210 and impeller vane 212, as illustrated.

Generally, the benefits deep inlet dam 218 over inlet dam 106 increase with increasing rotational power available at impeller 76. That is the main reason why it is shown as the preferred inlet dam in the higher-powered skimmer B, as demonstrated in FIG. 28, but not in the present embodiment, skimmer A.

Filter frame 112 is also clearly shown butted firmly against the lower lip of deep inlet dam 218. This is necessary for an effective seal against debris loss between filter frame 112 and inlet dam 218.

Depth of filter 220 points out the importance of the distance between water level 207 and filter media 104. Generally, increased depth of filter 220 decreases debris backwash from entrance 210, or entrance 208 in FIG. 7, when impeller 76 is not turning. And a greater depth of filter is desired when using inlet dam 106 (FIG. 7), compared to the use of deep inlet dam 218.

FIG. 8 and FIG. 9

Overview:

FIG. 8 is an isometric view displaying the section plane for sectional view, FIG. 9. FIG. 9 is a lateral sectional view through the centers of powered bumper wheels 62P and 62S, just aft of the bow of the skimmer.

FIG. 8:

Narrowing water inlet, starboard 100S is emphasized, explaining why the section of body 60 at this point will have a small cross sectional area. Bow extremity 98P represents the most forward extremity of body 60 on the port side of the skimmer. The perimeter of powered bumper wheel 62P and the perimeter of lower bumper wheel 166P must both extend significantly beyond bow extremity 98P, both laterally and in the forward or bow direction.

FIG. 9:

Narrowing water inlet, starboard 100S affects the area of inlet to impeller 76 (not shown) at waterline 223.

Gunwale 74S represents the outer edge of body 60. The protrusion of powered bumper wheel 62S and lower bumper wheel 166S beyond this point is to be noted. This protrusion is critical in allowing these bumper wheels to act as actively rotating fenders for body 60. Bearing bushing 222S allows free rotation of shaft 168P, and attached powered bumper wheel 62S and lower bumper wheel 166S.

It is desirable that shaft 168P and bumper wheel bearing bushing 222S be made of corrosion resistant materials capable of prolonged low friction rotating contact while immersed in swimming pool water. One such pair of materials is nylon for bearing bushing 222S and stainless steel for shaft 168S.

One possible assembly technique for powered bumper wheel assembly 92P is demonstrated on the right side of FIG. 9, which displays the port side of the skimmer. Powered bumper wheel 62P may be pre-assembled with bumper wheel shaft 168P, forming a unit which may be inserted into the bearing journal. Subsequently lower bumper wheel 166P may be secured over the bottom end 228P of bumper wheel 168P. This assembly technique is particularly favored if powered bumper wheel 62P, shaft 168P, and lower bumper wheel 166P are all constructed with at least an exterior surface of a plastic material capable of being solvent welded together.

FIG. 10 and FIG. 11

Overview:

FIG. 10 is an isometric showing the section plane for FIG. 11. FIG. 11 is a lateral cross section of the skimmer, slicing the length of impeller 76.

FIG. 10 points out, again, dry gear-motor assembly 78, which will be sliced laterally in FIG. 11.

FIG. 11.

Impeller 76 displays a very large cross-section, merely because one pair of impeller vanes happens to be vertical, extending up and down from impeller shaft 88. Impeller shaft 88 can clearly be seen to extend through the center of impeller 76, and laterally to port and starboard, being capped by bumper wheel drive pulley 80P on the port side and bumper wheel drive pulley 80S on the starboard side.

This picture clarifies the importance of rigidity in impeller shaft 88. If it were to be made of plastic materials it is quite likely that the weight of impeller 76, combined with the heat of the sun, would cause a warping and imbalance of the entire rotating assemblage. Two practical means of achieving such rigidity are to make the shaft 88 itself out of a corrosion resistant metal, such as stainless steel, or to make shaft 88 out of a less corrosion resistant metal, coated with a protective plastic having a low coefficient of friction. The later combination allows the exterior plastic coating to be used as a low friction bearing material. The former, solid metal shaft 88, is the preferred means.

Impeller shaft bearing assembly 90 must, of course, be lined with a bearing surface complimentary to shaft 88, and itself corrosion resistant material. Flotation chamber 232P is a portion of skimmer body 60, and has a top surface supporting Impeller Shaft Bearing Assembly 90.

Dry gear-motor assembly 78 is shown in section, including shaft 88, revealing internal detail. In particular, note how dry gear-motor box 82 is capped by lid 84, with conventional shaft seals such as shaft seal, conventional 230 forming a rotating seal between shaft 88 and the two halves of the exterior box of dry gear-motor assembly 78. There is no bearing assembly shown supporting shaft 88 on the starboard side, since such bearings are conventionally included as a portion of gear-motors such as gear-motor 138.

FIG. 12 and FIG. 13

Figure 1:
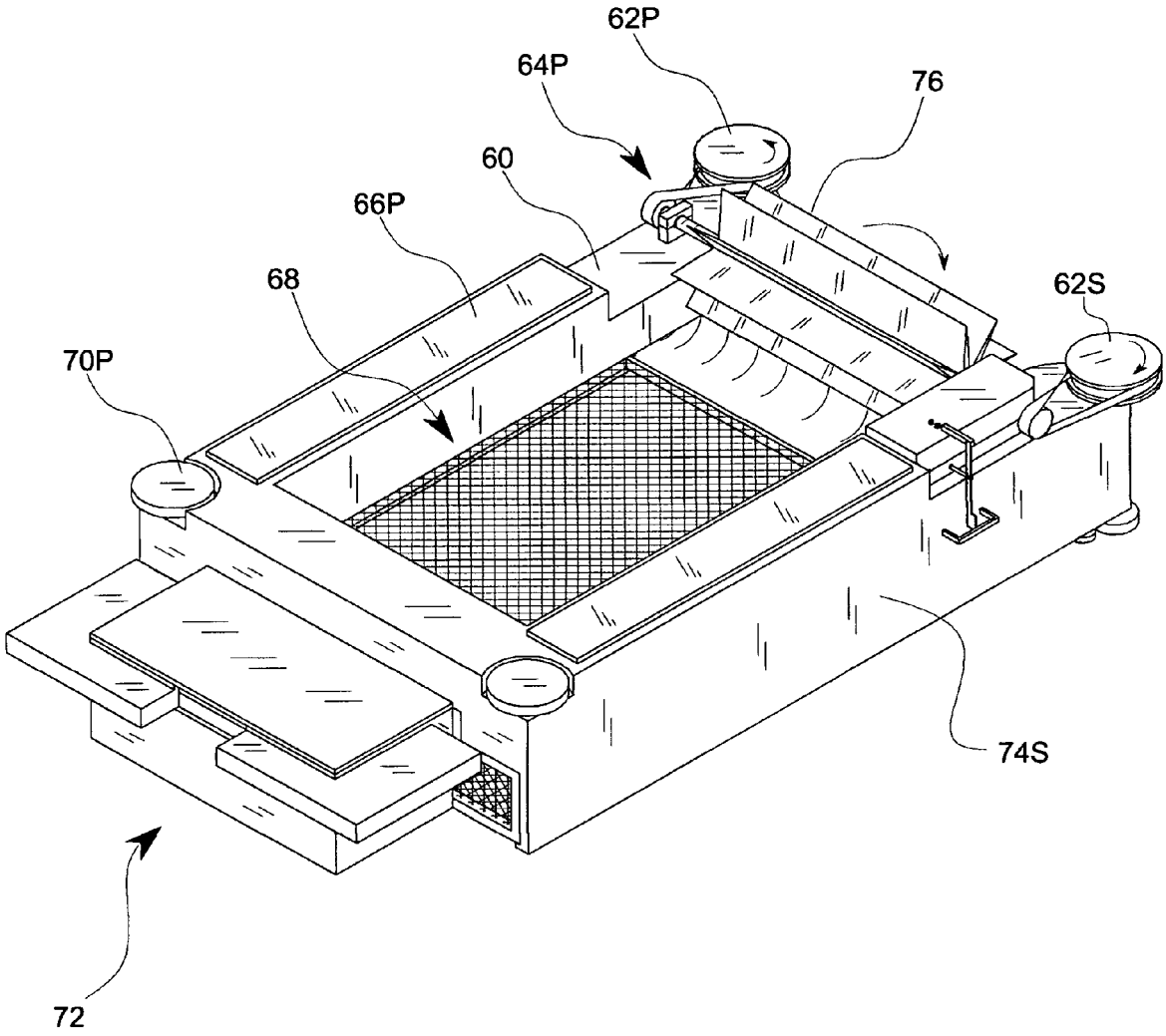

FIG. 13:

Solar cell array 66S can be seen secured to the top of floatation chamber 232S, which is in turn a portion of body 60 of the skimmer. Solar cell arrays, such as 66S, are conventional components in industry. It is especially important in this corrosive environment to utilize high quality sealants such as silicones in assembling or sealing solar cell array 66S.

Floatation chambers, such as floatation chamber 232S, must be extremely water tight and not porous. Experiments indicate that a porous flotation chambers can produce unacceptable variations in the floatation trim of impeller 76, not shown here, as the pores become waterlogged.

Filtration and deflector vanes:

Filter media 104 is shown spaced a short distance above an individual deflector vane 110, which is in turn a portion of deflector vane assembly 108, not fully displayed here. While filter media 104 visually appears to be spaced away from deflector vane 110, in real life soft filtration media will tend to sag, and be supported by such vanes. Filter frame 112 is shown as supported by filter support lip 192P, which in turn is a portion of skimmer body 60, not shown fully. Note how much wider filter media 104 is, near the bottom of the skimmer, than is the waterline between floatation chamber 232S and floatation chamber 232P. A significant part of the attraction of this particular physical layout in skimmer A is the relatively large filter 104, relative to the entire size of body 60.

Figure 14:
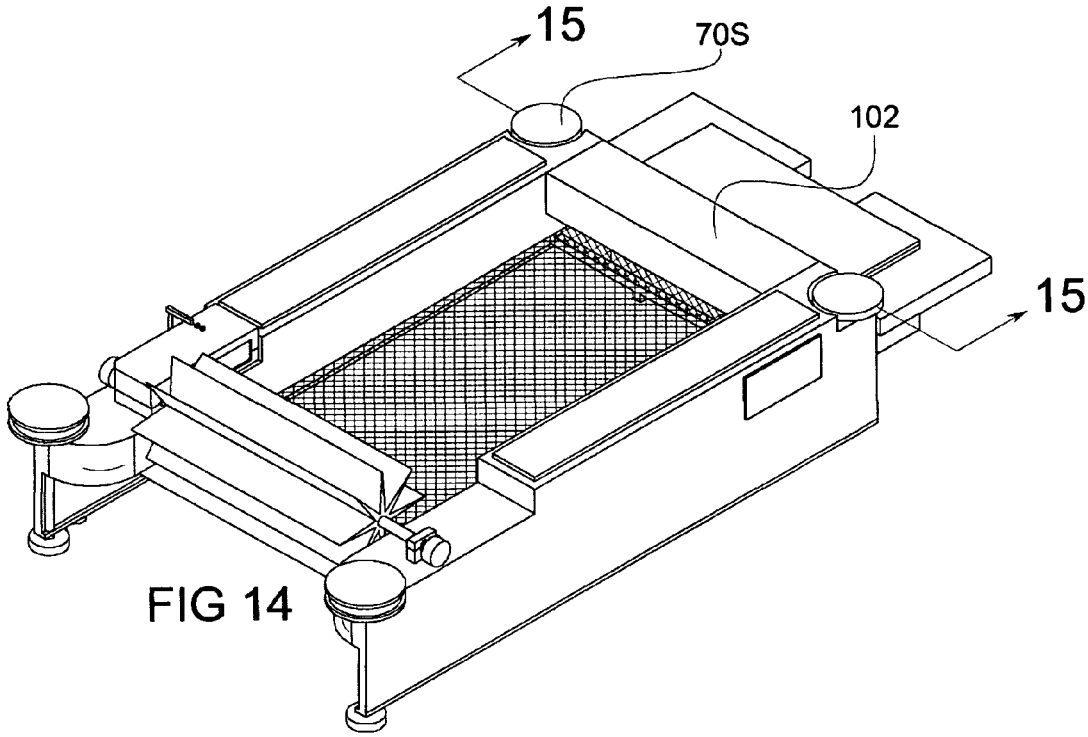
Figure 15:
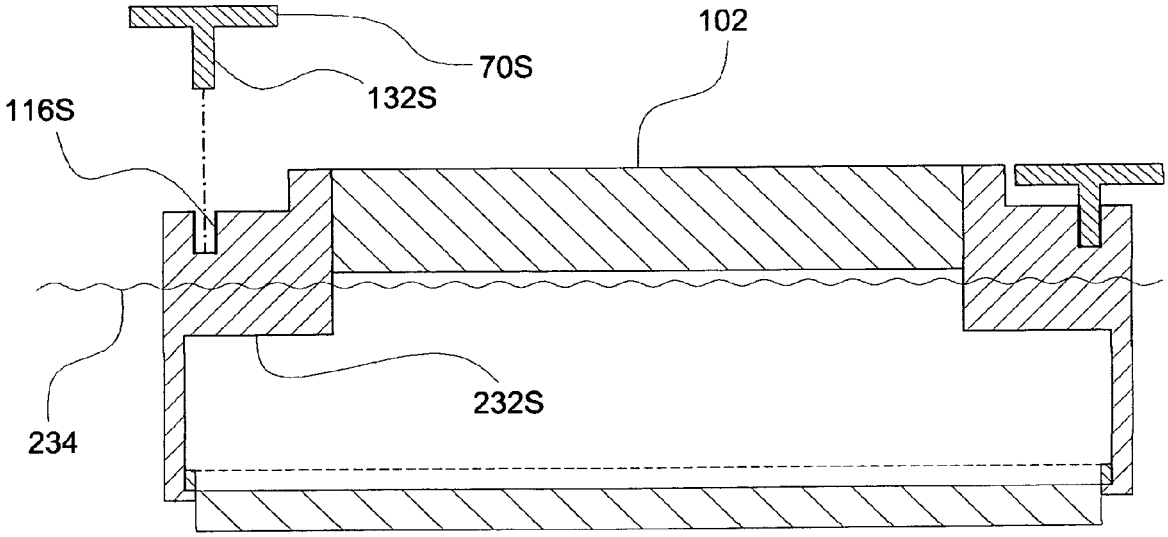

FIG. 14 and FIG. 15

FIG. 14 is an isometric view showing the section plane for FIG. 15. FIG. 14 additionally is used to point out again, for reference, the location of idler bumper wheel 70S, and cross member 102.

FIG. 15 is a lateral sectional view through the stern section, cutting through the idler bumper wheels, such as idler bumper wheel 70S.

Idler bumper wheel 70S is shown in sectional exploded view, away from floatation chamber 232S, where it normally rests. Idler bumper wheel 70S has a vertical shaft 132S. Due to the tremendously lower stress, wear, and impact which idler bumper wheels are subjected to, compared to the powered bumper wheels, it is possible to use a less sturdy structure. It is quite feasible to manufacture idler bumper wheel 70S and idler bumper wheel shaft 132S out of one piece of material such as nylon or a similar plastic.

Idler bumper wheel shaft bearing bushing 116S is designed to accept idler bumper wheel shaft 132S, and allow it to turn freely. It must therefore be made of a compatible low friction material.

Note the large cross sectional area of cross member 102, just barely above water level 234. This serves the useful purpose of providing a greatly increased area of floatation should the stern of the skimmer be forced to settle in the water, as it might with the introduction of large amounts of swimming pool chemicals into chemical dispenser assembly 72 (FIG. 16).

Figure 16:
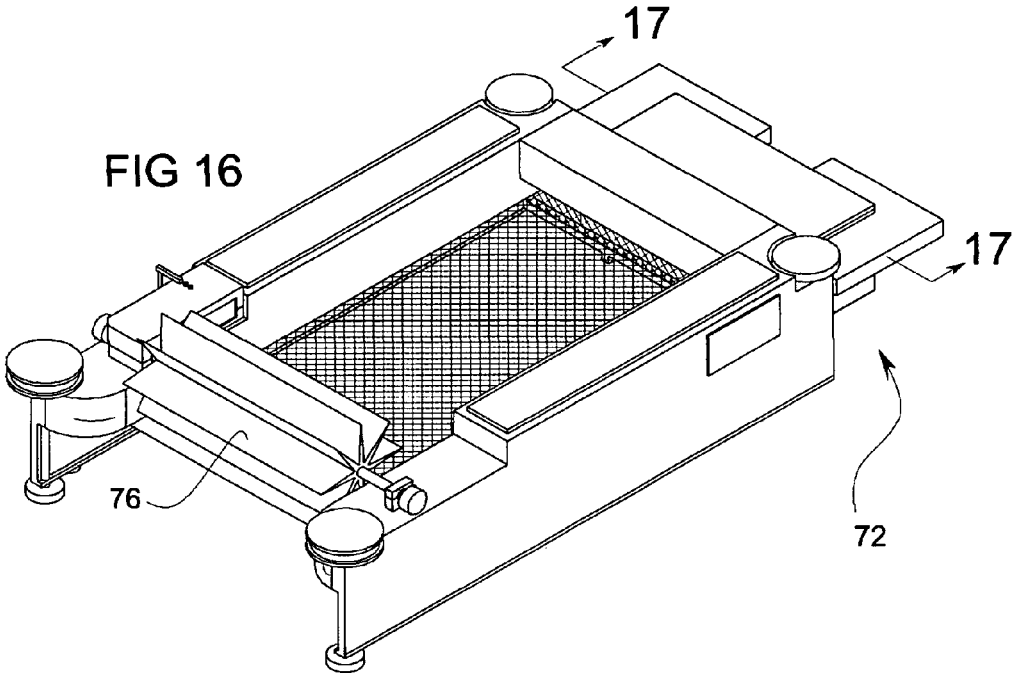
Figure 17:
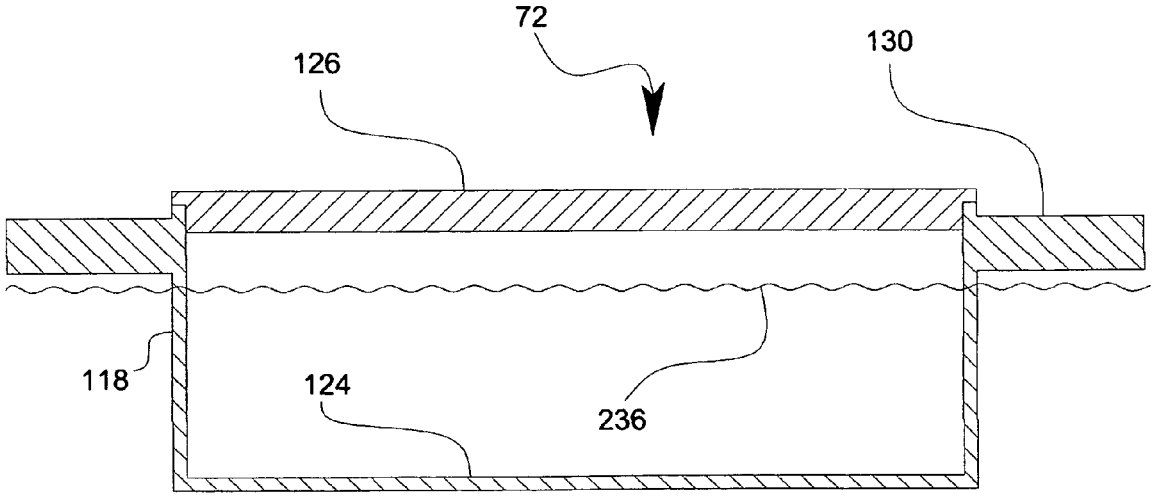

FIG. 16 and FIG. 17

FIG. 16 is an isometric view showing the section plane for FIG. 17. Chemical dispenser assembly 72 is also pointed out for reference.

Figure 2:
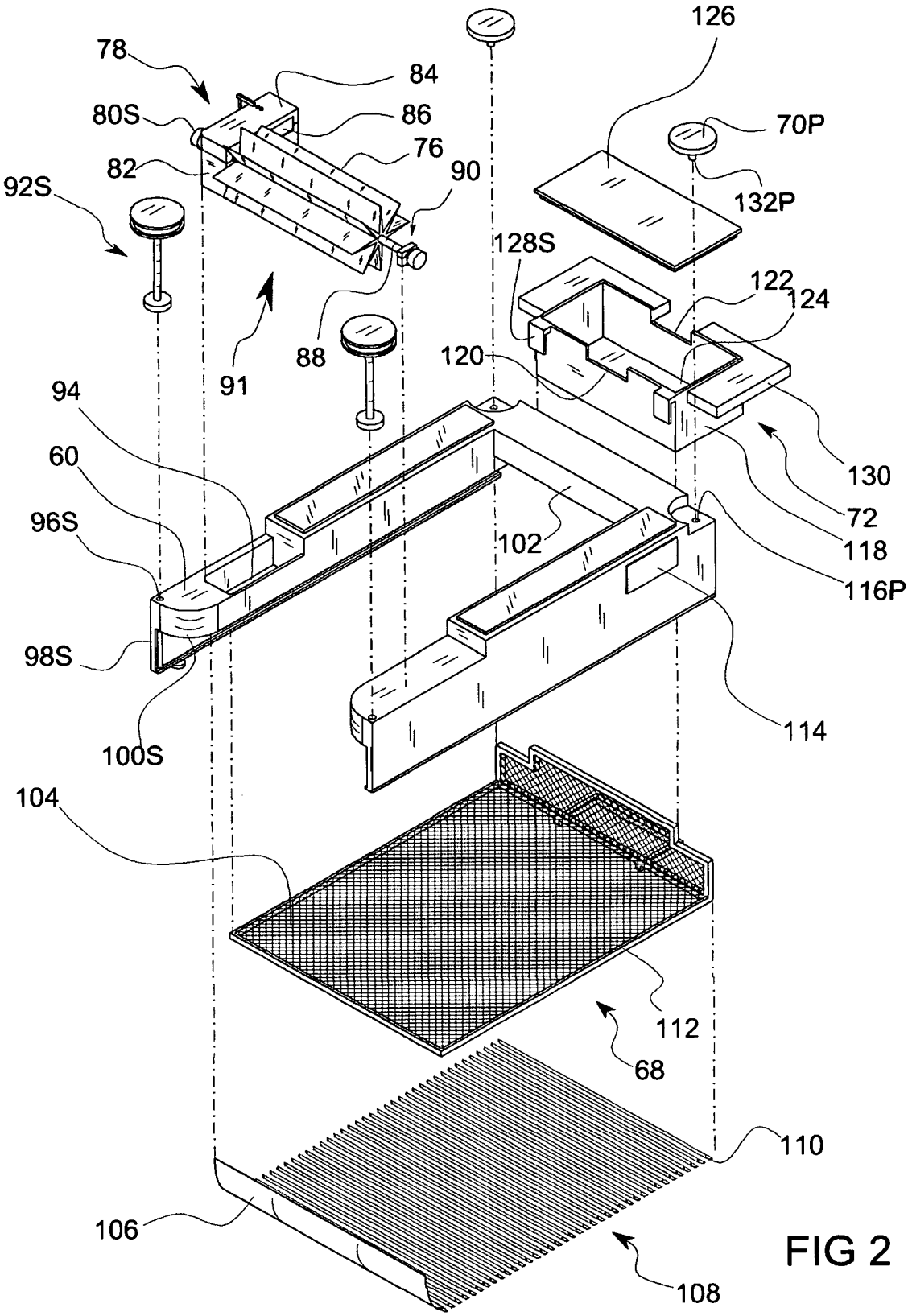

FIG. 17 is a lateral cross section through chemical dispenser 72, to the rear of the skimmer body 60 (FIG. 2).

Chemical dispenser box 118 is largely immersed, below waterline 236. Any solid pool chemicals in the swimming pool chemical dispenser box interior 124 will be immersed in this water. The weight of such chemicals will affect the trim of both chemical dispenser assembly 72 and hence the entire skimmer. Floatation collar 130 is located barely above normal waterline 236, such that the additional floatation of floatation collar 130, when it is immersed, will counterbalance the weight of such added swimming pool chemicals, and prevent further settling of the chemical dispenser 72, and the stern of the skimmer. Also shown is chemical dispenser lid 126, which is a simple lid, possibly with a conventional fastening mechanism, not shown, securing it to box 118.

Figure 18:
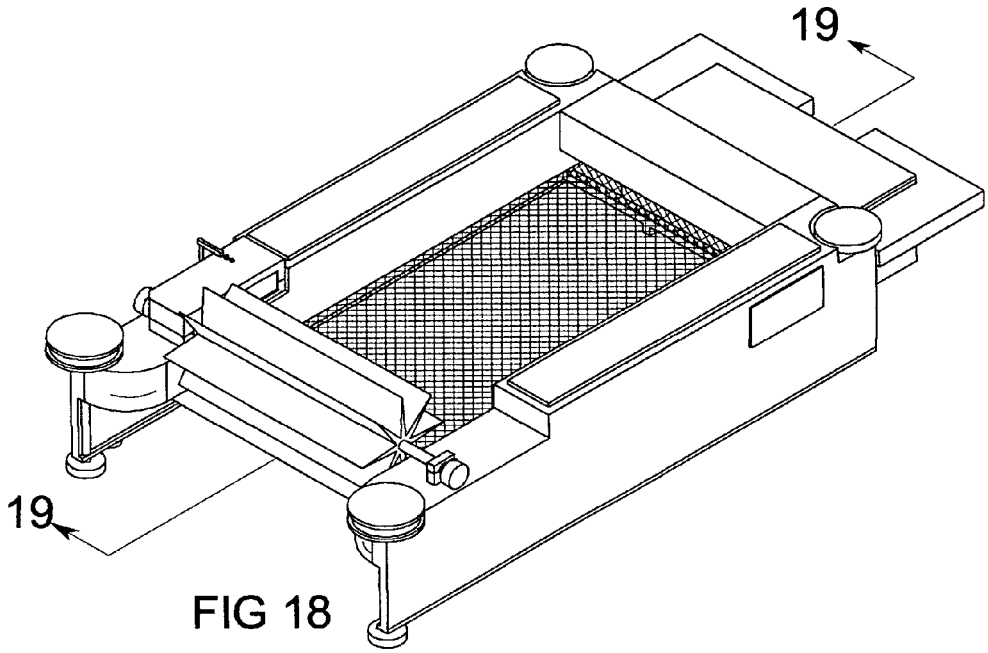
Figure 19:
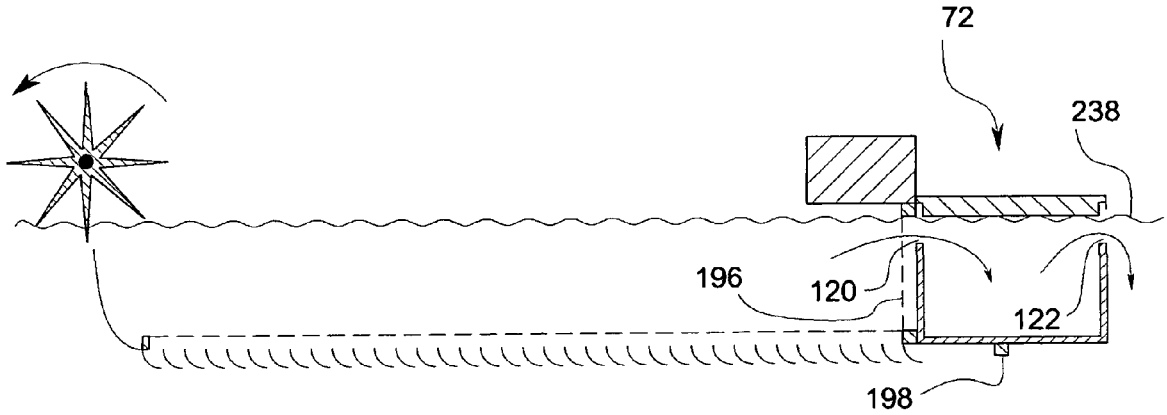

FIG. 18 and FIG. 19

FIG. 18 is an isometric view showing the section plane for FIG. 19. FIG. 19 is a longitudinal section down the midline of the skimmer. Unlike FIG. 7, this longitudinal section is cut precisely down the midline of the skimmer, rather than offset to the port side.

FIG. 19:

FIG. 19 is largely to demonstrate the flow pattern of water through dispenser assembly 72. Chemical dispenser assembly 72 can here be seen to have an entrance and exit. Entrance 120 is located behind vertical filter component 196, so that water entering dispenser assembly 72 is first filtered of debris. Exit 122 allows water to exit dispenser assembly 72.

Note that both entrance 120 and exit 122 are located near the top of dispenser assembly 72. This is very significant, since swimming pool chemicals are heavy, and their concentrated chemical solutions are substantially heavier than swimming pool water. The chemical solutions will therefore tend to stay inside dispenser assembly 72 by gravity until the skimmer begins moving. This is significantly different than conventional floating chemical dispensers. Water level 238 should therefore be engineered to stay within the opening area of entrance 120 and exit 122.

Figure 4C:
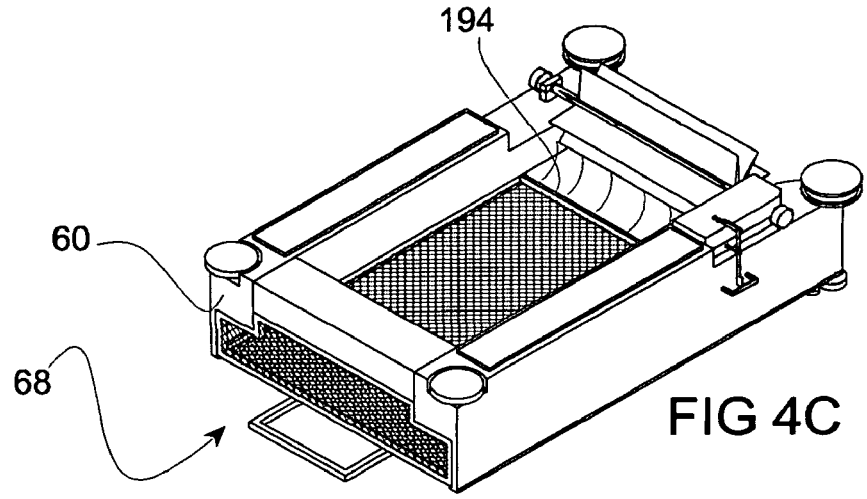
Figure 4B:
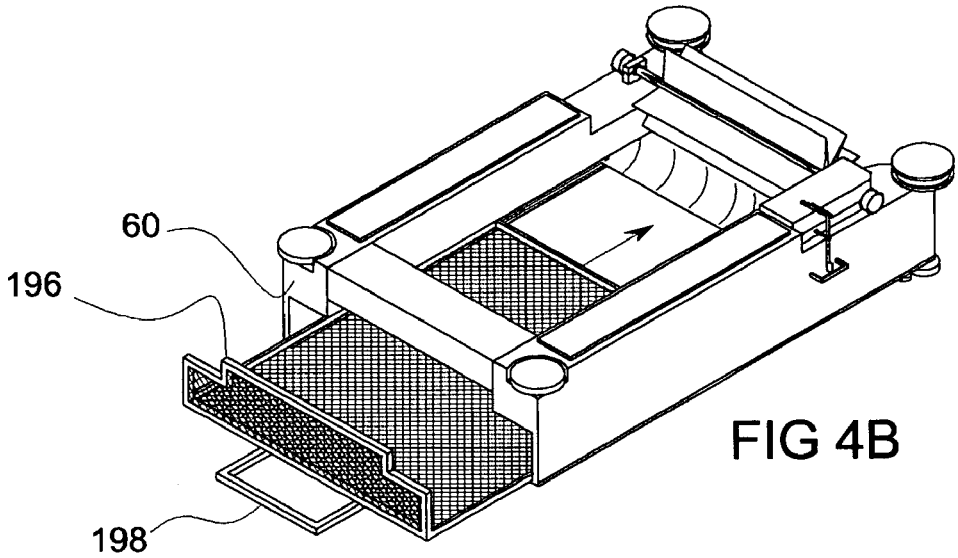

Filter handle 198, more clearly seen in FIG. 4B, is also shown in section directly underneath chemical dispenser 72, where it both supports it, and holds it in place.

Figure 20:
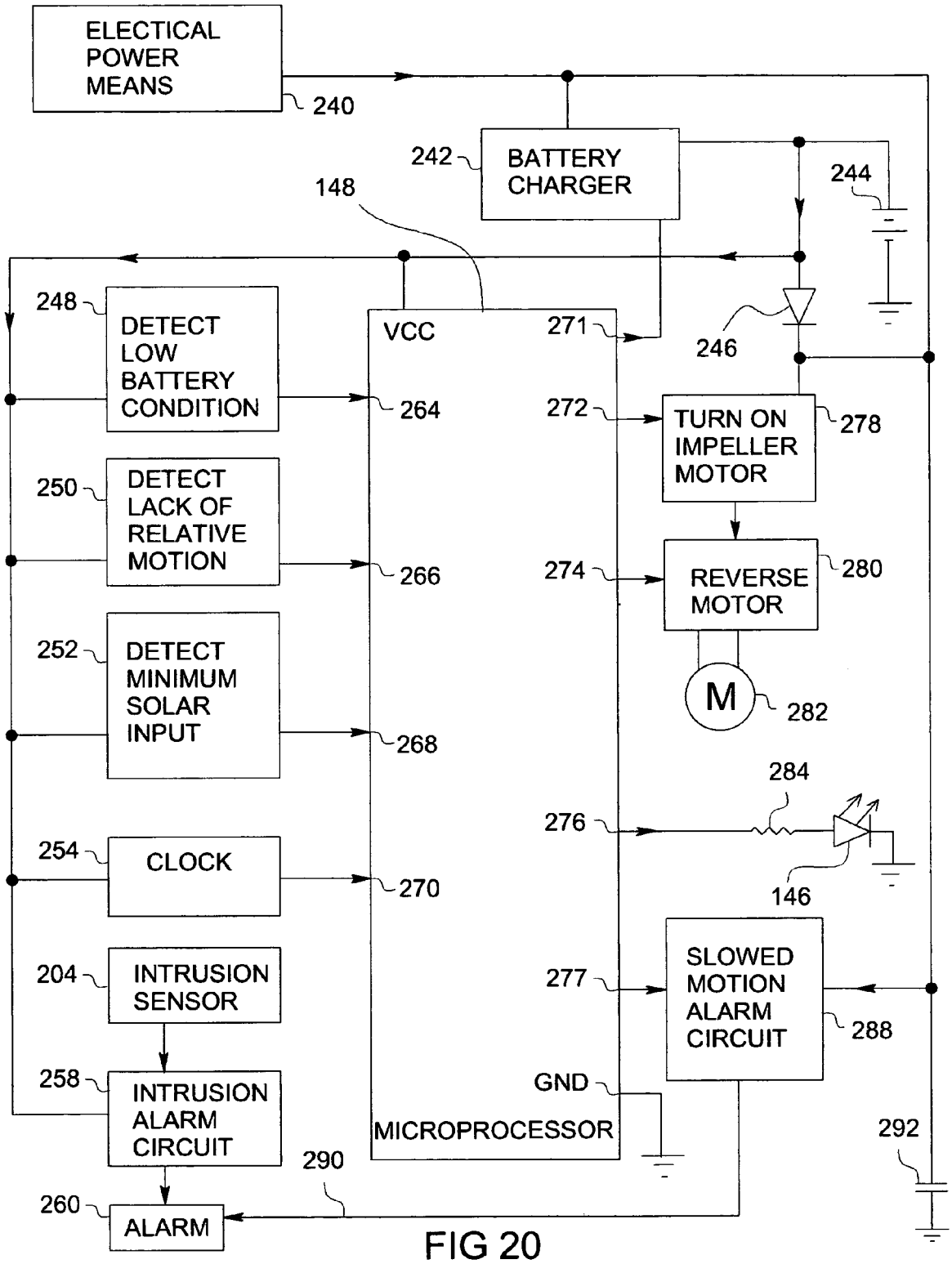

FIG. 20 Electrical Schematic Skimmer A

Electrical Power Supply Elements

Electrical power means 240 includes, in skimmer A only, two separate solar cell arrays, array 66P and solar cell arrays 66S, not shown here, but visible in FIG. 1 and other drawings. When two or more solar cell arrays are used, they may be isolated from one another by diodes, but this is not required for operation. Electrical power means 240 may also include other conventional circuitry commonly used in solar cell array power applications. Electrical power means 240 may further include alternative power sources, such as conventional batteries, fuel cells, other electrical generating equipment, wind generated power sources, and modular rechargeable batteries to be removed and charged by a remote device.

Battery charger 242 involves conventional circuitry. Since the decision to charge or not to charge is preferably made in microprocessor 148, and signaled by microprocessor output 271 leading to the battery charger, battery charger 242 needs have no separate decision making circuitry. Thus, battery charger 242, as shown, is predominantly a circuit allowing electrical power flowing from electrical power means 240 to be turned on or off, as needed in the charging of electrical storage battery 244. It is also possible to use conventional discrete battery charger circuits that eliminate the requirement for circuit 248, microprocessor low battery input 264, and microprocessor output 271. But that simplification degrades one or more proposed control functions of the skimmer.

Electrical storage battery 244 is charged by battery charger 242, and may be used as an alternative source of power (to electrical power means 240) by all other electrical elements during times of low solar input.

Motor start capacitor 292 is combined with battery isolating diode 246 in a small optional circuit that may be eliminated if electrical storage battery 244 is sufficiently energetic in starting motors, including impeller motor 282. It is most useful in cases where electrical storage battery 244 is eliminated, or made to be of minimum electrical output capacity. While not explicitly shown in this circuit diagram, it is possible to modify the circuitry (slightly) to make it possible to run the entire skimmer entirely from electrical power means 240, in the case of failure of battery 244 (during sunlight hours only). This requires a bit more conventional isolation circuitry than shown. In this particular case, motor start capacitor 292 becomes much more critical. This "pure solar" operation (with no battery) is not modeled here, largely because of its failure to navigate out of shadows.

Microprocessor Input Circuits

Microprocessor 148 is a conventional microprocessor, typical of those used in control circuitry, having a number of internally protected inputs and outputs. As shown, it is assumed to have internal memory sufficient to prosecute simple switching tasks. It is also possible to perform each of the tasks performed by microprocessor 148 with a discrete conventional circuit, which combination of circuits would the functional equivalent of microprocessor 148.

Circuit 248 is a conventional circuit element that serves to detect a low battery condition requiring re-charging of electrical storage battery 244. Microprocessor input 264 receives the output signal from circuit 248. It may provide a simple on/off digital signal at a certain threshold voltage. Alternatively, it may provide more precise battery voltage data in the form of frequency or pulse width modulated digital signals.

Figure 3:
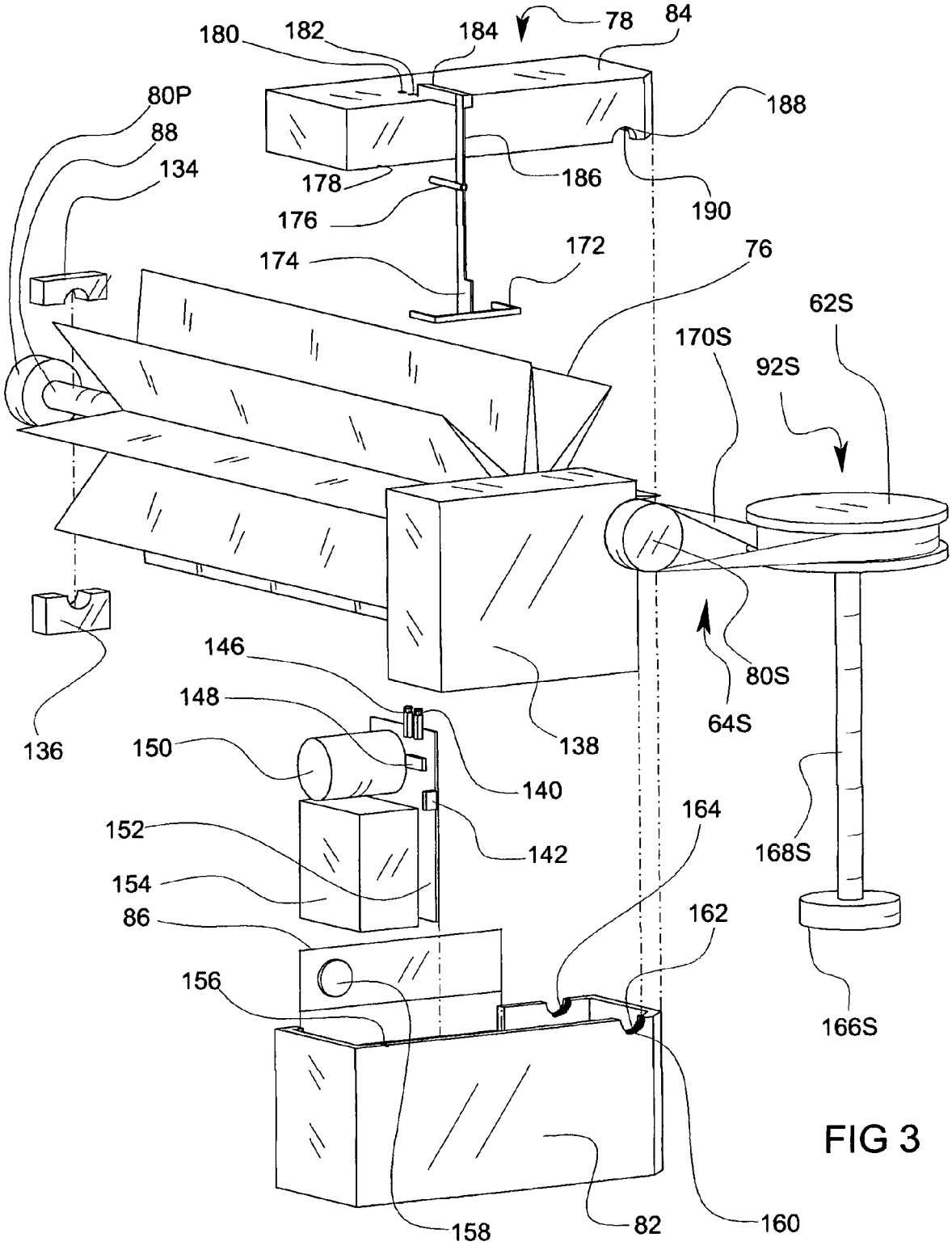

Circuit 250 is a conventional element designed to detect the lack of relative motion of the skimmer with respect to the swimming pool water surrounding it. As shown in FIG. 3 and elsewhere, this element is depicted as a magnetic sail switch employing a sail 174, not shown, immersed in the surrounding water to detect motion. Other conventional fluid motion detectors may be substituted, including, but not limited to: simple sail switches, sonar fluid flow detectors, ram type fluid pressure sensors, and rotary vane fluid motion sensors such as speed measuring assembly 398 (FIG. 36) utilized in skimmer C. Microprocessor input 266 receives the output signal from circuit 250. This output signal may provide a simple on/off digital signal at a certain threshold speed of the skimmer relative to the water. This would be the case of a simple sail switch. Alternatively, it may provide more constant and precise speed data in the form of frequency or pulse width modulated digital signals, as would be the case with most rotary speed sensors.

Circuit 252 is a conventional element designed to detect the minimum solar input levels appropriate for just barely being able to run motor 282 on the output of solar arrays alone. It is pictorially represented by a circuit including photo-sensor 140 in FIG. 5 and elsewhere. While there are functional advantages to such a discrete photo-sensor, it is also possible to utilize the output voltage or current of solar cell arrays as the sensor input for circuit 252. The discrete photo-sensor 140 is desirable, however, to avoid the false readings caused by voltage drops in electrical power means 240 initiated by the application of electrical load. The output signal provided by circuit 252 may be a simple digital on/off signal at a predetermined level of solar flux (sunlight brightness). Alternatively, a more precise and wide ranging measurement of solar flux may be provided by a circuit 252 which would provide a frequency or pulse width modulated digital signal with frequency or pulse width proportionate to the solar flux. This would be useful, for instance, in detecting the first sign of breaking dawn, detecting a great excess of solar flux, detecting a rapid decline of solar flux, or other useful measurements.

Circuit 254 represents a conventional microprocessor clock circuit, with Microprocessor clock input 270 receiving its clock output. Both may obviously be deleted if microprocessor 148 possesses an internal clock.

Alarm Circuitry

Overview:

Intrusion sensor 204, circuit 258, and alarm 260 are conventional components of a conventional swimming pool intrusion alarm system that may optionally be added to any skimmer embodiment. The inclusion of a swimming pool intrusion alarm circuit aboard a skimmer is predicated on the fact that the skimmer already has a safe and autonomous power supply, it is already in the swimming pool around the clock, and it already has a hermetically sealed dry gear-motor assembly suitable for encasing delicate electronics. Microprocessor output 277 and slowed motion alarm circuit 288 form a separate alarm circuit that may share a common alarm element in circuit 260, which combination serves to produce a warning signal when the skimmer is either stuck or severely clogged with debris. Line 290 feeds the second alarm signal into an audible or other sort of alarm 260 capable of attracting human attention.

Intrusion Alarm Sensor 204 is a conventional sensor detecting intruder entry into the swimming pool. Various types of conventional sensors are used. The sensor 204, pictorially represented in FIG. 5 and elsewhere, represents one particular common type, the sonar transceiver. Several other types of conventional sensors exist. A particularly useful variation would involve a switch or other sensing device simply detecting surface wave, or water pressure wave, deflection of one floating element of the skimmer relative to the balance of the skimmer.

Circuit—Intrusion alarm 258 is the intrusion alarm circuit proper. This too is a conventional circuit. Circuit 258 is drawn as a separate circuit predominantly to emphasize the possibility that the functions of this circuit could be included inside of microprocessor 148, with the inclusion of one more microprocessor inputs and one more microprocessor outputs. Or, it could exist as a totally discrete conventional unit, with the entire intrusion alarm system essentially an "add on" to the rest of the skimmer's electronic circuitry.

Alarm circuit 260 represents any conventional alarm sounding circuit, such as piezo alarms, electric alarm bells, remote alarms, visual flashing strobes, and other devices to catch the attention of humans. It is pictorially represented in FIG. 3, and elsewhere, as alarm sounding means 158, which is drawn as a simple piezo alarm attached to the inside surface of a waterproof membrane.

It is particularly useful, in a floating pool skimmer, to include a very bright downward facing conventional light or photoflash style of strobing light, activated along with the intrusion alarm signal. For instance: a very bright light aimed downward into the pool water, and strobed perhaps once a second, both provides a visual warning and facilitates a search for a body in a dark pool.

Microprocessor output 277 signals extremely prolonged lack of motion, as measured by circuit 250. Circuit 288 is a conventional alarm driver circuit for alarm 260. Output line 290 connects circuit 288 to alarm 260, and may, for some devices, require an isolation diode, not shown. Circuit 288 could, of course, have its own discrete alarm-sounding device, rather than the shared alarm 260.

Microprocessor Output Circuits

Microprocessor output 271, as already mentioned, leads to battery charger 242. Feeding the charging signal through the microprocessor allows a more sophisticated choice of when to recharge electrical storage battery 244. It can react "intelligently" to more external conditions, such as whether motors are running, and to whether the skimmer is moving relative to the surrounding water.

Microprocessor output 272 signals a time to turn on impeller motor 282 (in either direction). Circuit 278 is a conventional circuit providing a positive switching action to turn on or turn off impeller motor 282. It is particularly important that circuit 278, and other circuits, not draw significant current from electrical storage battery 244 when impeller motor 282 is turned off. In the simplest case, Circuit 278 may represent a simple power transistor biased for saturated switching. The low standby current requirement may require slightly more complexity.

Microprocessor output 274 signals a brief reversal signal for impeller motor 282. Circuit 280 is a conventional motor reverse circuit. In the simplest case, circuit 280 may represent a simple DPDT relay, possibly including a transistor buffer for microprocessor output 274. In skimmer A only, it is wise to introduce a resistor, or other speed-reducing element, connected in such a manner, perhaps including a diode, whereby motor 282 will be caused to run at a lower speed in reverse than it will in normal forward rotation. This reduced speed in reverse is critical to limiting backwards discharge of retained debris.

Note: It is also theoretically possible to design reversible circuitry with separate microprocessor outputs for forwards and backwards rotation of motor 282.

Impeller motor 282 represents the electric motor component of gear-motor 138, displayed in FIG. 3 and elsewhere. In its simplest form, impeller motor 282 is DC motor, reversible by switching polarity.

High efficiency is critical in impeller motor 282, as well as its connecting rotary energy transmission means. Experiments have shown that many common small DC motors draw more current than reasonable size solar cell arrays can produce. It is extremely desirable to have a motor capable of normal continuous operation off of solar cell array power alone. It is also extremely desirable to provide a starting boost from electrical storage battery 244 and/or motor start capacitor 292 upon starting. This is because solar cell arrays are, electrically, a very poor match for the starting load of an electric motor. Unlike physical electrical generators, they have no inertia capable of producing a higher peak power in response to a surge in load, such as the starting load of a motor.

Microprocessor output 276, LED current limiting resistor 284, and LED 146 combine to form a flashing LED strobe circuit. This assumes that microprocessor output 276 is capable of intermittently sourcing the approximately 20 mA required by LED 146. If it is not, this entire flashing LED circuit may be replaced by a conventional discrete LED flasher circuit, not shown.

Skimmer "A": Operation

Summary—Introduction to Major System Functions

A Broad Preliminary Overview

FIG. 1:

Impeller 76, powered bumper wheel 62P, and powered bumper wheel 62S are rotationally connected, turning together, and capable of being briefly reversed together in case impeller 76 jambs with debris, or the skimmer becoming hopelessly stuck against an obstacle. The two powered bumper wheels, by rotating in opposite directions, serve to actively turn the skimmer away from any stuck position against swimming pool walls, obstacles, or corners of a pool.

Filter assembly 68 receives and filters water and retains debris swept into it by impeller 76. Solar cell arrays such as 66P provides primary electrical power. Body 60 acts as a boat or raft supporting all other elements of the skimmer. Idler bumper wheel 70P acts as an un-powered rotating fender. And chemical dispenser assembly 72 serves to distribute swimming pool chemicals, but only when the unit is operating.

Summary Overview of Normal Operating Cycle

The skimmer is designed to generally operate when the sun is shining, and for a timed period of several minutes after the loss of direct sunlight to solar cell arrays, such as 66P, before the skimmer turns itself off. Thus, the skimmer can travel effectively through shadows without stopping. The skimmer is also designed to be periodically (for instance, once an hour) triggered to operate during low sun conditions, on battery power. It then runs for the same timed period of several minutes before it shuts down. Thus, it can do at least some periodic effective skimming during the night.

If the skimmer detects that it is moving, then it will re-set the timer to operate for its minimum several minutes of operation. If the skimmer detects it is not moving, then it will briefly reverse impeller 76 and the powered bumper wheels 62P and 62S. This maneuver tends to back the skimmer away from obstacles as well as clear a clogged impeller 76. If it detects, after this maneuver, that it is moving through the water, it will go back to normal operations, for a minimum of several minutes.

If, on the other hand, the skimmer fails to detect motion, it will jump back and forth between forwards and backwards operations several times in an attempt to free itself. Then, and only then, it will sound an alarm that tells the pool owner that it may be stuck, have a jammed impeller, or have a filter so full of debris that the skimmer can no longer propel itself.

Figure 35:
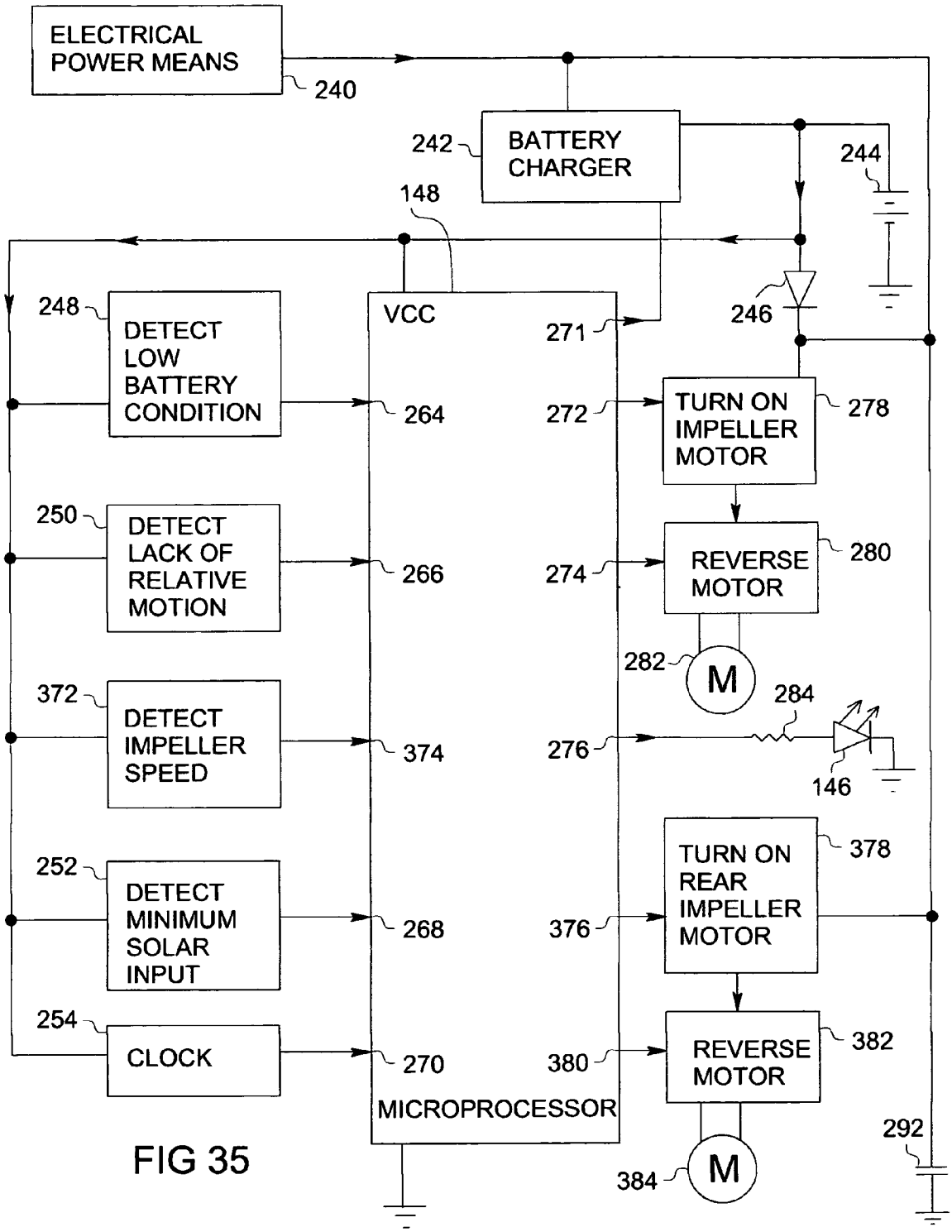
Figure 48:
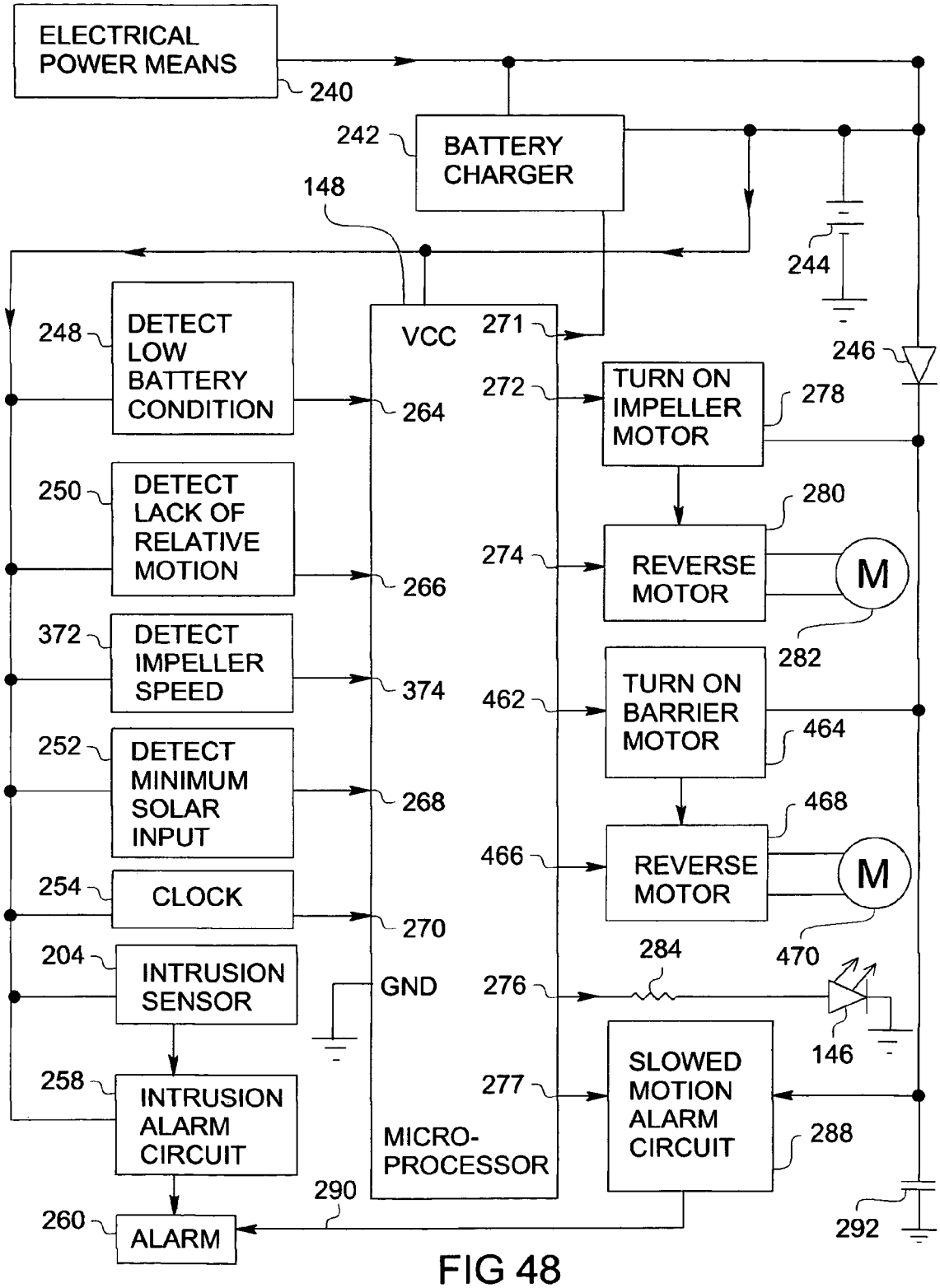

The precise methods used to accomplish these operations are discussed with the circuit diagrams, FIG. 20, FIG. 35, and FIG. 48.

FIG. 2: Operation of Major Components

Main drive train assembly 91 rotates impeller 76 and powered bumper wheel assemblies 92S and 92P, not separately labeled. Dry gear-motor assembly 78 provides motive power, contains an electronic controller, and provides corrosion protection for motor and electronics. Filter assembly 68 filters debris from exiting water, and deflector vane assembly 108 generates forwards thrust by turning the exiting water rearwards from the skimmer. Inlet dam 106 rests below impeller 76, and creates a broad and shallow water entrance above it for the entering water.

FIG. 5

Motion sensing means, including motion sensor sail switch sail 174, detects when the skimmer quits moving, allowing the system to attempt to extract itself by briefly reversing several times. Failing that, it can shut itself off and provide an alarm, telling people that it is stuck. A more life critical swimming pool intrusion alarm system, including intrusion alarm sensor 204, provides a more strident alarm should an intruder enter the swimming pool while it is armed. An additional function of the motion sensor is to activate a timer reset. Each time motion is detected it serves to set a timer allowing the skimmer to operate for several minutes, even in the absence of sun (using battery power, battery 244 FIG. 20). This also allows the motion sensor to be used as a switch to test the operation of the skimmer when the sun isn't shining, since nudging the motion sensor will trigger several minutes of operation on battery power, if the sun isn't shining. And lower bumper wheel 166S rotates along with powered bumper wheel 62S to serve as an active deflector in collisions with submerged swimming pool steps.

Figure 23:
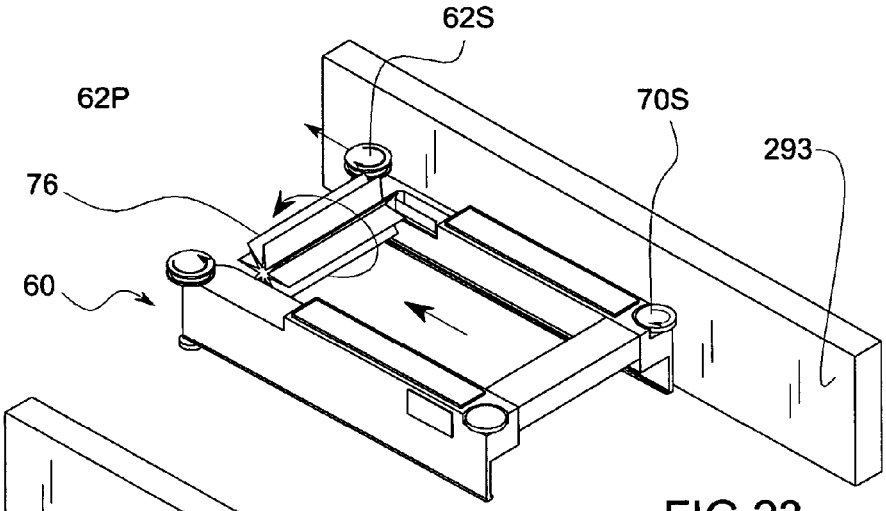
Figure 22:
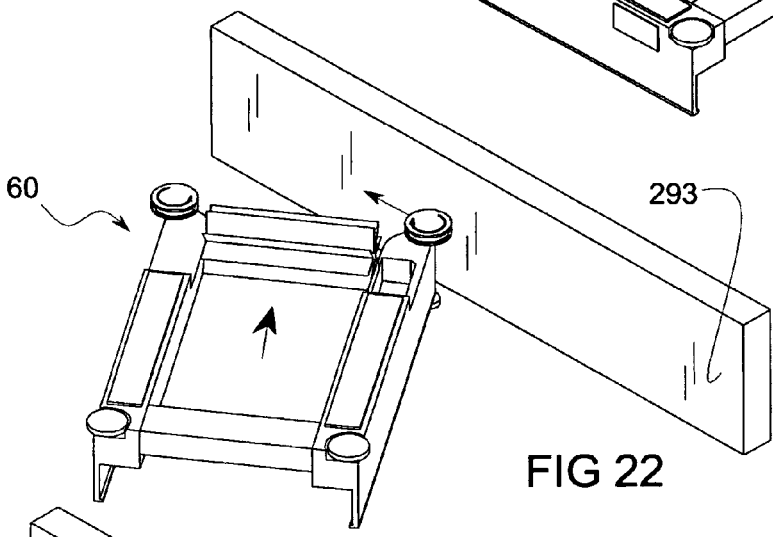
Figure 21:
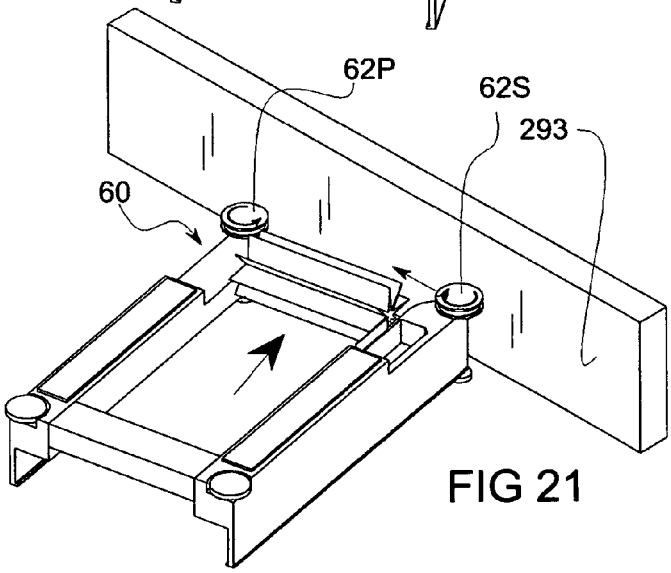

Navigation Basics: FIG. 21–FIG. 23

How the Skimmer Moves and Extracts Itself from Collisions

In FIG. 21 a simplified representation of the skimmer, including body 60, is shown first colliding with a vertical swimming pool wall 293. The large arrow inside of body 60 represents the normal impulse propulsion provided by impeller 76, not labeled here, but labeled in FIG. 23. This large arrow represents the motion of water through a bow entrance at the waterline, through impeller 76, then through an internal water channel, before the water exits backwards. This impulse propulsion provides the thrust keeping the skimmer moving in its normal direction of travel.

Note that in FIG. 21 this normal operating thrust vector will ordinarily suck the skimmer's bow tightly against the pool wall 293, effectively ending forwards, or any other motion. However, rotating powered bumper wheel 62S makes contact with wall 293 before body 60 has an opportunity to touch the wall. This rotating contact of powered bumper wheel 62S with wall 293 generates a lateral thrust represented by the strait arrow attached to powered bumper wheel 62S.

Powered bumper wheel 62S is rotationally coupled to rotate at a predetermined angular velocity sufficient for its thrust vector to overpower the turning force resulting from the impact of the skimmer with wall 293.

If a skimmer collision with wall 293 should happen to be precisely head on, it will be seen that both powered bumper wheels 62P and 62S will provide equal and opposite thrusts, which thrusts will briefly cancel each other out. While this appears to be a stuck position, it is not a position that can be maintained beyond a few seconds, because it is dynamically unstable. It is the physical equivalent of a weight being balanced on a knife-edge. If either powered bumper wheel 62S or 62P should, even for the briefest instant, obtain more traction against the wall than the opposing bumper wheel, then that particular bumper wheel will pull the skimmer in a direction that removes the opposing bumper wheel from having any contact at all with wall 293.

FIG. 22 shows skimmer body 60 several seconds after the original collision shown in FIG. 21. Note that the impeller thrust vector represented by the arrow inside of body 60 now is no longer pulling the vessel straight against wall 293. As the angle of body 60 with wall 293 becomes more acute, more and more of this impeller thrust vector will assist the turning action of the traction of powered bumper wheel 62S, not labeled separately here, but labeled in FIG. 21.

FIG. 23 shows skimmer body 60 with the turn completed, with the resulting propulsion forces now being entirely parallel to wall 293. Note that the gunwale perimeter of powered bumper wheel 62S, when in contact with the swimming pool wall, produces thrust parallel to the thrust of impeller 76. Idler bumper wheel 70S is now also in contact with wall 293, providing a smooth rolling contact, rather than a friction contact, of body 60 with wall 293.

As long as powered bumper wheel 62S is in contact with wall 293, its frictional propulsive force is essentially parallel to the impulse propulsion provided ultimately by impeller 76. This results in the natural tendency of the skimmer to proceed rapidly both parallel to, and in contact with, wall 293. This is especially true if there is even the slightest of winds blowing against the port side of body 60.

This is a very desirable mode of operation, with body 60 gliding smoothly along wall 293. Virtually all floating debris located on the surface of a swimming pool will be concentrated against the downwind wall, if there is any breeze at all.

Experiments also indicate that wind has a powerful effect on self-propelled skimmers, such as this one, also tending to drive them against the downwind wall. This combination of wind effects makes even a single circumnavigation of a swimming pool by the skimmer extremely effective in scooping up the concentrated floating debris.

Figure 24:
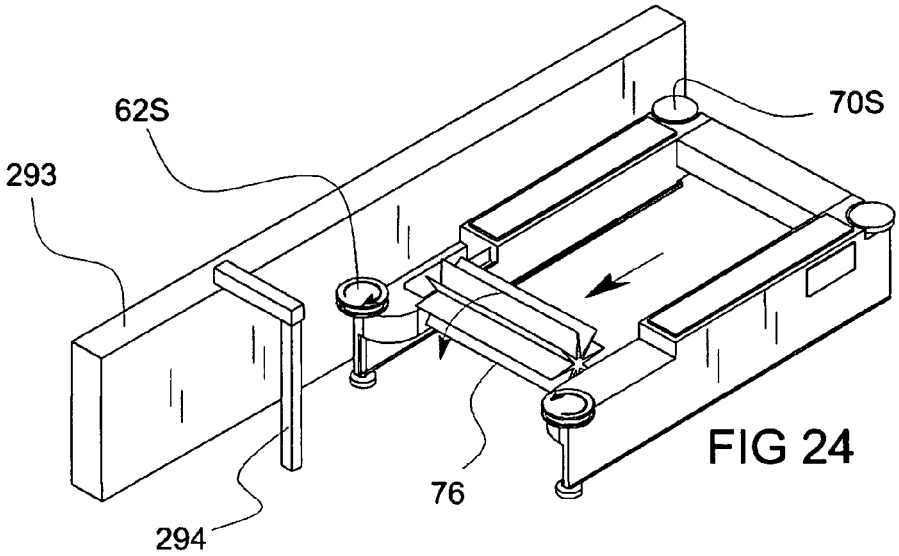
Figure 25:
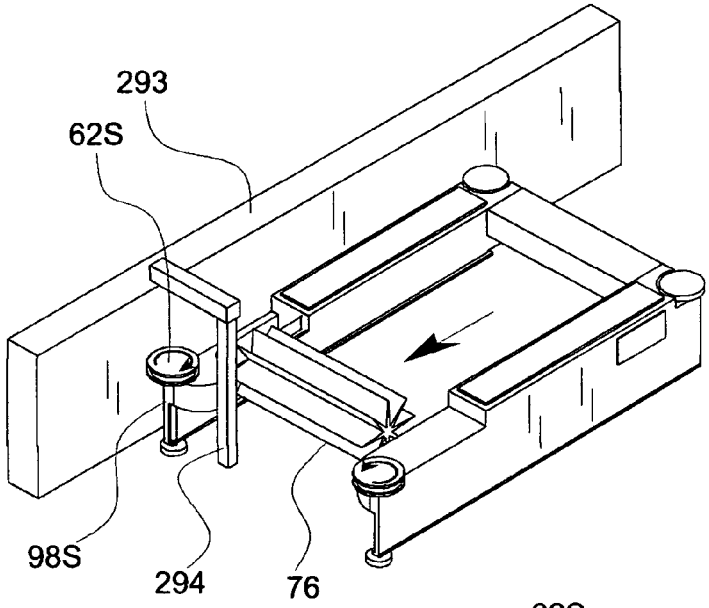
Figure 26:
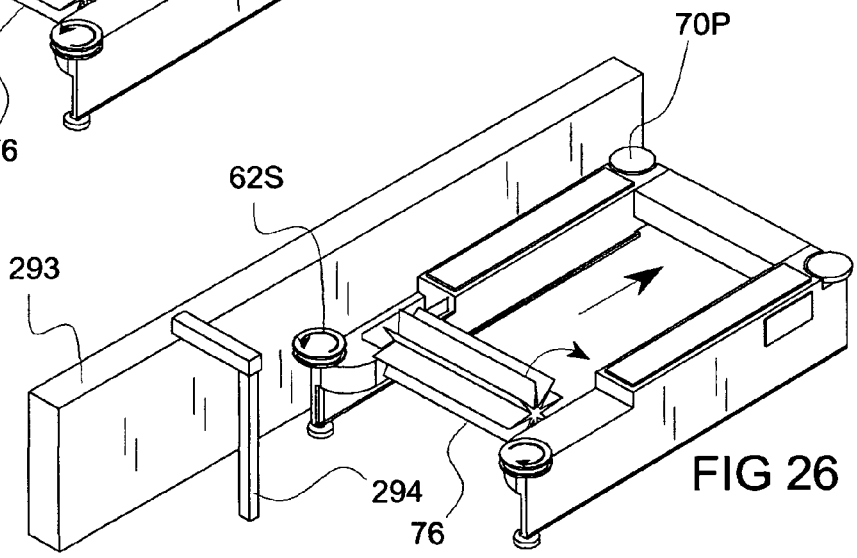

Backing Away from Obstacles: FIGS. 24–26

FIG. 24–FIG. 26 represent a collision of the skimmer, shown in simplified form, with a post type of obstacle, represented by post 294, located a short distance away from swimming pool wall 293. This post represents the worst sort of obstacles ordinarily encountered in swimming pools. This might include the vertical member of a swimming pool ladder, or the vertical portion of a large swimming pool toy left carelessly in the swimming pool.

These figures emphasize why it is critical that an autonomously navigating skimmer be capable of both sensing when it is stuck, and why it must be able to react by briefly backing away from such an obstacle.

FIG. 24 shows the skimmer traveling parallel to, and in contact with, vertical swimming pool wall 293. The skimmer is moving. It is being propelled forwards along the wall both by the rotation and impulse of impeller 76 and by the rotational contact of powered bumper wheel 62S with wall 293. Note the direction of rotation of powered bumper wheel 62S being parallel to the direction of motion at its point of contact with wall 293. Friction of the skimmer against wall 293 is reduced by the free rotation of idler bumper wheel 70S. This allows rather rapid propulsion along wall 293, even in adverse wind conditions.

FIG. 25 represents both the collision, and the resulting stuck position of the skimmer against post 294. Note that the propulsive thrust of both impeller 76 and powered bumper wheel 62S cooperate to hold the skimmer firmly against the post. The stuck position results in starboard bow extremity 98S being caught between wall 293 and post 294.

During this stuck phase, impeller 76 may be either turning or not turning. Sensing rotation alone, of impeller 76, is not sufficient to inform the skimmer of whether or not it is truly stuck. It is necessary to determine both if the electricity is being provided to turn impeller 76, and if there is a lack of relative motion between the skimmer and the surrounding water for an extended predetermined period of time.

FIG. 26 represents the results of the logical decision above. Namely, IF there is electrical power supplied to ultimately turn impeller 76 AND IF there is a lack of relative motion sensed between the skimmer and the surrounding water, THEN both impeller 76 AND powered bumper wheel 62S should be briefly rotated in reversed direction. This is shown by a reversing of the circular arrows indicating rotational direction.

Note that this results in propulsion by both rotary friction of bumper wheel 62S and impulse propulsion of impeller 76 in the backwards direction indicated by the large straight arrow inside of the skimmer body.

Not quite as clearly shown is the fact that both propulsive means are pushing from the bow of the skimmer, now briefly acting as its stern, relative to motion. As the skimmer backs away from post 294, a turning vector is introduced that tends to pull idler bumper wheel 70P away from wall 293.

The most desirable cycle of operation is to operate in reverse for a very brief predetermined time, then to allow the vessel to coast by its own inertia for a somewhat longer time, with all propulsion turned off. This provides an opportunity for the skimmer to escape, by coasting, from the immediate vicinity of post 294, and make another attempt at circumnavigating the swimming pool. After a predetermined time the skimmer resumes operating in the normal direction of propulsion. If the period of coasting is chosen judiciously, there will frequently be an opportunity for the skimmer to rotate nearly 180 degrees before it begins moving forwards again.

It should be noted, that in embodiment skimmer A only, such reversals of impeller 76 should rotate at lower than the normal forwards rotation rate of impeller 76. This reduces backwashing of debris. It also does not inhibit propulsion significantly, since experiments verify that reverse propulsion is significantly more efficient than is forwards propulsion in this particular embodiment. This lower rotation rate in reverse is not necessary in the later two embodiments, skimmer B and skimmer C respectively, because they each have physical barriers to such backwash during reverse maneuvering. Skimmer B and skimmer C may be furthermore equipped with sensing equipment including an impeller speed detection circuit 372 (FIG. 35 and FIG. 48) that allow differentiating between a stuck impeller and a skimmer stuck against an obstacle. Since skimmer A must react to both problems in the same manner, such extra circuitry is unnecessary in that embodiment.

Navigating Shadows and Night Operations

Included here is a very brief summary of behavior of skimmer A, and the other embodiments, in response to shadows and nightfall. This is explicitly documented in the circuit diagram for each embodiment (FIG. 20, FIG. 35, and FIG. 48) respectively. The description here is only a brief introduction to place navigation properties in context.

Solar cell arrays quit producing power instantaneously upon hitting a shadow. A storage battery 244 (FIG. 20) is provided to prevent stopping dead at every shadow and staying there indefinitely. Circuitry is provided (detailed in FIG. 20 and elsewhere) allowing impeller 76 to be driven for several minutes after entry into a shadow. A timing function measures this amount of time. If the skimmer doesn't escape in that time, it shuts down, assuming it is close to sunset. Periodically during the night, (once an hour for example) the skimmer is triggered, by a second timing function, into operation again, and operates for the same several minutes before stopping. This allows periodic removal of wind blown debris from the downwind side of a swimming pool. This is especially true because the skimmer, when not provided power, will be blown by the wind to the same side of the pool where debris accumulates.

Operations of Filter Assembly 68

Figure 4A:
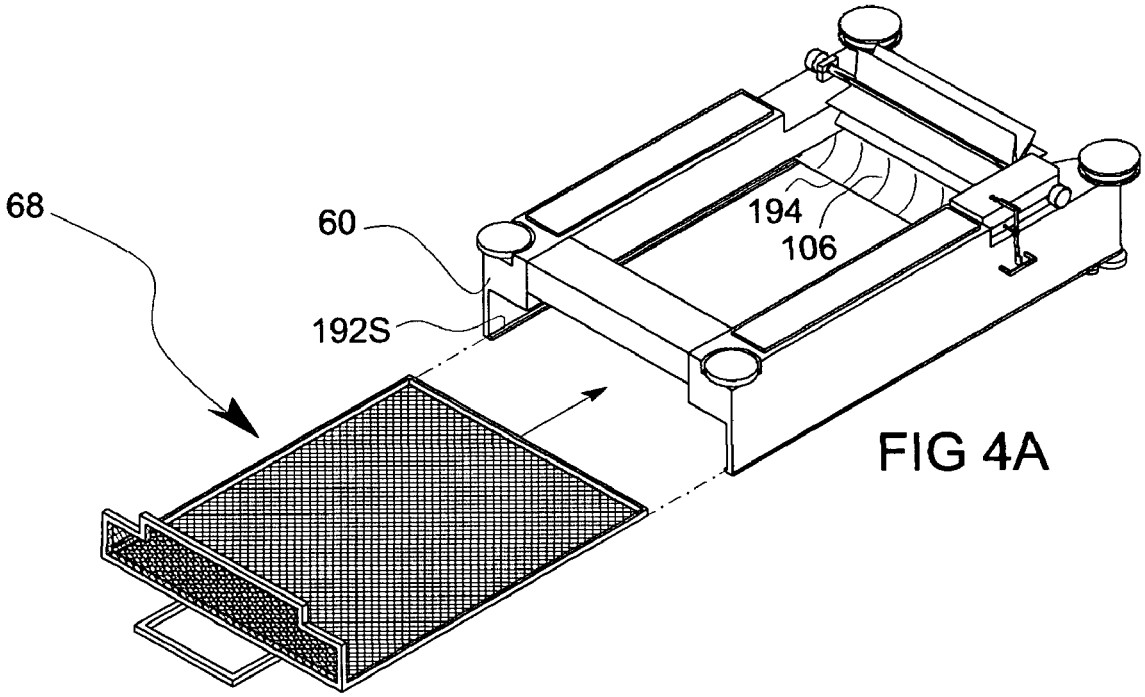

FIG. 4A–FIG. 4C show how filter assembly 68 may be slid conveniently into position inside of skimmer body 60. Note, in FIG. 4A, the existence of a filter support lip 192S at the lower edge of body 60 that serves to support filter assembly 68.

Handle 198 serves to facilitate human insertion and removal of filter assembly 68, as well as serving as a support for chemical dispenser assembly 72, as depicted in FIG. 19.

Note that, as filter assembly 68 slides into body 60, its forward edge makes contact with the lower lip 194 of inlet dam 106. The vertical filter component 196 (FIG. 4B) makes contact with a similar shaped recess in at the stern of body 60. And the outboard edges of filter assembly 68 make contact with filter support lip 192S (FIG. 4A). These edge contacts with skimmer components serve to create a complete enclosure whereby debris might be filtered and retained. Note also in 4B and 4C that vertical filter component 196 provides a direct rearward path for water travel, while the bulk of water will travel downward.

FIG. 7.

Note that water pumped rearwards by impeller 76 exits downward through filter assembly 68, being retained against the filter media 104, which is the working filter component, and can theoretically consist of any sheet-like porous filter medium. It can also be seen that deflector vane assembly 108 provides the primary support for the filter media 104 against the force of downward moving water.

FIG. 2: Operations of Skimmer Body 60

FIG. 2 gives the clearest isolated view of skimmer body 60. Body 60 serves a floatation purpose analogous to a pontoon boat, as well as providing mounting points for assorted hardware. Cross member 102, near the stern, provides additional stern floatation just barely above the normal waterline. This position prevents added weight, such as swimming pool chemicals, from depressing the stern and thereby causing the bow to rise in the water. Any great variation in the water level at the bow of body 60 is highly undesirable, because it affects the depth of bite of impeller 76 into the surrounding water. The narrowing water inlet 100S, at the bow waterline forms a scoop that deflects debris laterally into the central region, where impeller 76 is somewhat narrower than is body 60.

Body 60 further includes holes lined with bearing bushings, such as bumper wheel shaft bushing 96S and idler bumper wheel shaft bushing 116P, that allow free rotation of powered bumper wheel assembly 92S and idler bumper wheel 70P respectively, as well as their opposite side counterparts.

FIG. 3—Operation of Main Drive Train Assembly 91

Figure 11:
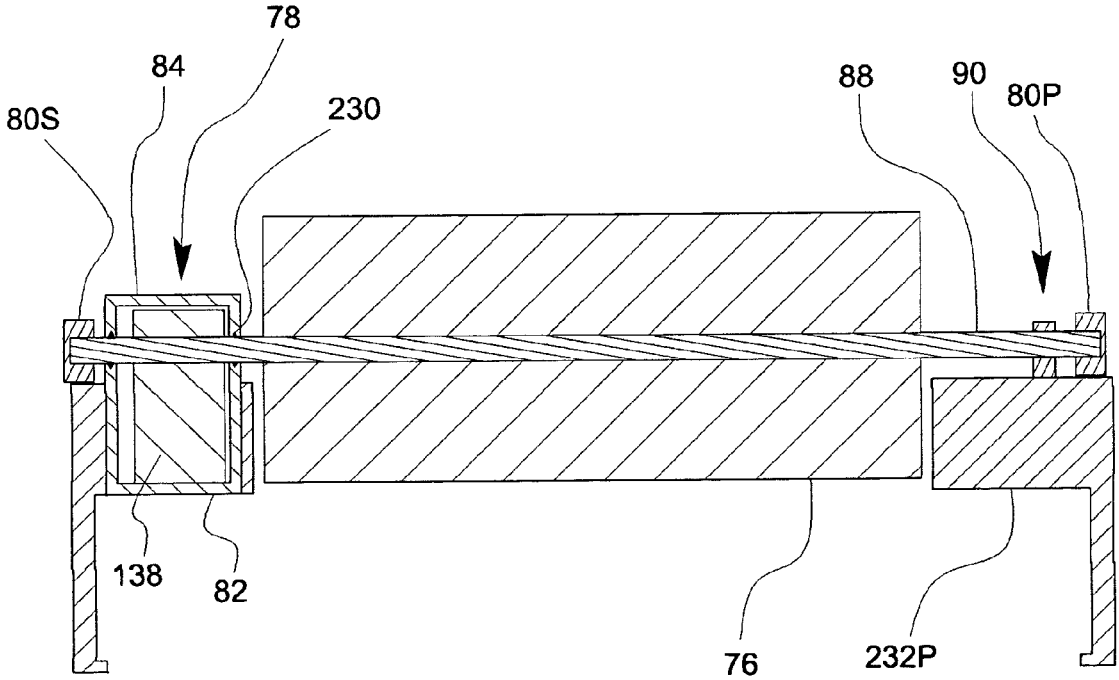
Figure 12:
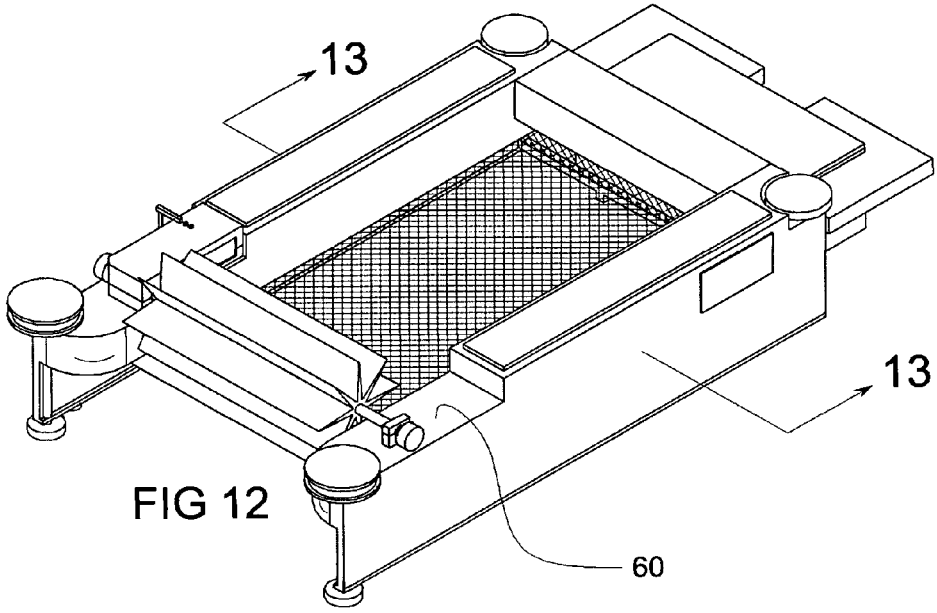
FIG. 12 is an isometric view displaying the section plane for FIG. 14.
Figure 13:
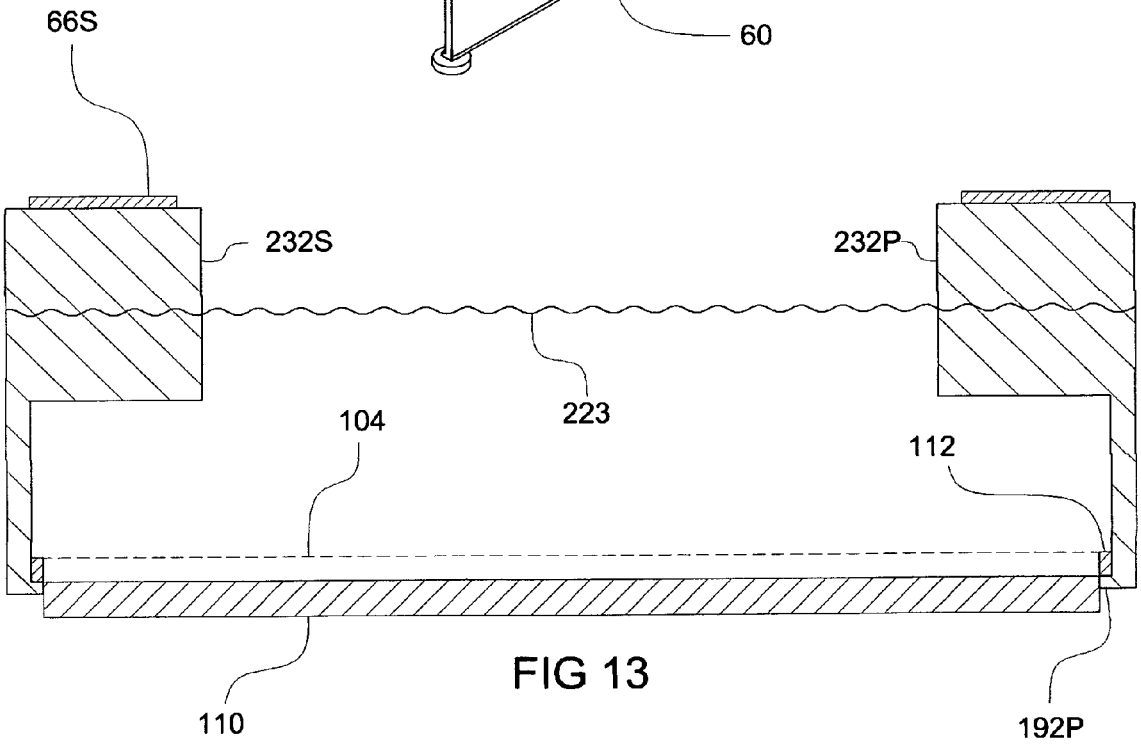
FIG. 13 is a lateral section across the midsection of the skimmer, displaying in particular the floatation and filtration components of the skimmer.

Gear-motor 138 lies at the very center of FIG. 3. Through impeller shaft 88, gear-motor 138 provides motive power for all actively moving components of the skimmer. Impeller shaft 88 directly rotates attached impeller 76 and attached bumper wheel drive pulleys 80P and 80S, as is more clearly seen in sectional view in FIG. 11.

FIG. 3:

Bumper wheel drive pulley 80S in turn rotates belt 170S, with the combination of both designated as bumper wheel drive means 64S. Bumper wheel drive means 64S rotates powered bumper wheel assembly 92S in the horizontal plane. Powered bumper wheel assembly 92S consists of powered bumper wheel 62S, shaft 168S, and lower bumper wheel 166S, all secured together and rotating as a unit.

An identical bumper wheel drive pulley 80P and powered bumper wheel assembly 92P are similarly driven on the port side. Belt 170P, however, is given an half twist, as is clearly seen in FIG. 1 and FIG. 5, resulting in bumper wheel assembly 92P rotating in the opposite direction of powered bumper wheel assembly 92S. Identical results can, of course, be accomplished by other equivalent types of bumper wheel drive means 64S and 64P, including various rotary transmission means such as bevel gears.

FIG. 3:

Printed circuit board 152 includes controller circuitry, detailed in schematic form in FIG. 20, capable of turning gear-motor 138 on and off at appropriate times, as well as reversing the direction of rotation of gear-motor 138.

FIG. 3:

LED 146, at the very top of printed circuit board 152, acts as a warning strobe at night, warning night-time swimmers from diving into the top of the skimmer. Minimum light photo-sensor 140 is part of a circuit informing the skimmer when there is sufficient direct sunlight to operate gear-motor 138 on solar generated electricity alone. It generates a signal informing microprocessor 148 of a predetermined light level that ultimately results in continuous operation of gear-motor 138 during most periods of full and direct sunlight. Photo-sensor 140 is also useful in detecting entry of the skimmer into a shadow, by virtue of its signal decreasing. This is critical, since the skimmer is designed to continue operating for a predetermined time after entering a shadow. Photo-sensor 140 further is used to detect re-entry into the sun subsequent to traversing a shadow. This is also critical, since the skimmer is designed to shut down briefly for a battery charging cycle upon first entering sunlight, if the battery 244 (FIG. 20) is detected as being low. Circuitry causing these effects is all detailed in FIG. 20.

FIG. 3:

Motor start Capacitor 150, also on printed circuit board 152, is instrumental in providing more instantaneous starting torque to gear-motor 138, by virtue of providing a pulse of higher voltage and current during sunlight hours. This is particularly useful in unclogging a stuck impeller.

Dry Gear-Motor Assembly 78 (Box 82 and Lid 84)

Gear-motors, such as gear-motor 138 and electronic circuitry, such as is included on printed circuit board 152, must be actively protected from the corrosive effects of swimming pool water, chlorine, pool acid, and pool alkalis. To accomplish this, dry gear-motor box 82, lid 84, and various subsidiary components serve to achieve a nearly hermetically sealed container for delicate components inside.

But dry gear-motor box 82 is more than just an effective splash shield for gear-motor 138. A flexible membrane 86 allows automatic adjustment of the internal air pressure to equal ambient air pressure. Without this feature, moisture will manage to find its way in through the smallest of pores during diurnal fluctuations of relative air pressure. Furthermore, a porous container of chemical absorbent 154 is designed to soak up any corrosive chemicals that may eventually find their way into dry gear-motor box 82. Conventional shaft seals, such as shaft seal 164, create an effective moisture barrier around impeller shaft 88. And glue, such as elastomeric silicone, seals remaining holes, such as hole 156, for the passage of electrical cable out of box 82. Conventional sealing techniques, such as use of elastomeric adhesives, gasket and seals, or solvent welding of a plastic box 82 and lid 84 together, are used to seal the joint between box 82 and lid 84.

It should be emphasized further that impeller shaft 88 is a low speed output shaft, and that shaft seals, such as shaft seal 164, about low speed shafts create far less parasitic drag, and are far easier to seal against moisture infiltration, than are seals about a high speed shaft. In a low powered solar device, the shaft seal drag is a very serious consideration.

A further safety feature preventing corrosion, not shown in any drawing, may include the placement of a sizeable floatation chamber above dry gear-motor assembly 78. Such a floatation chamber should be located and sized such that a total capsize of the skimmer will cause it to float with shaft holes, such as impeller shaft hole 160, at least slightly out of the water. Since shaft seals, such as shaft seal 160, provide the most likely path for infiltration of moisture into box 82, there is value in keeping them out of the water under all circumstances. Such an additional floatation chamber is not shown pictorially in the drawings because it does not bear on the normal operation of the skimmer, aside from corrosion protection, and hides too many important elements from view.

FIG. 3: Shafts, Bushings, and Bearings Operations

Conventional gear-motor 138 will conventionally contain an impeller shaft bearing, protected from the weather by dry gear-motor assembly 78. Impeller shaft 88 requires a corrosion resistant bearing on the port side, made up of impeller shaft bushing top half 134 and impeller shaft bushing bottom half 136. Free turning in wet and corrosive environments require very forgiving bearing combinations, already discussed in the details section, such as stainless steel shafts and nylon bushings—or equivalent material combinations. Similar considerations apply to all exposed shafts and bushing combinations on the skimmer. In operation, all these bearings must operate equally well wet or dry, and must have loose enough clearance to tolerate grit, debris, and hair between shaft and bearings. Because of this, it is highly advantageous to have all exposed shafts turning at the lowest speed and highest torque that will perform the job well.

FIG. 7 and FIG. 7A: Impeller and Inlet Dam Operations

FIG. 7:

Impeller 76, in operation, must of necessity, contact the waterline 207, and penetrate a predetermined amount below it. In theory, even the smallest amount of penetration provides adequate skimming action, as long as at least one vane, such as impeller vane 206, is in contact with the water surface at any one time.

Effective propulsion, as opposed to skimming action, seems experimentally to require a deeper penetration of impeller vanes below waterline 207. Our present theory is that paddle wheel style impellers at shallow depth of bite produce almost no pumped head pressure of water.

Figure 28:
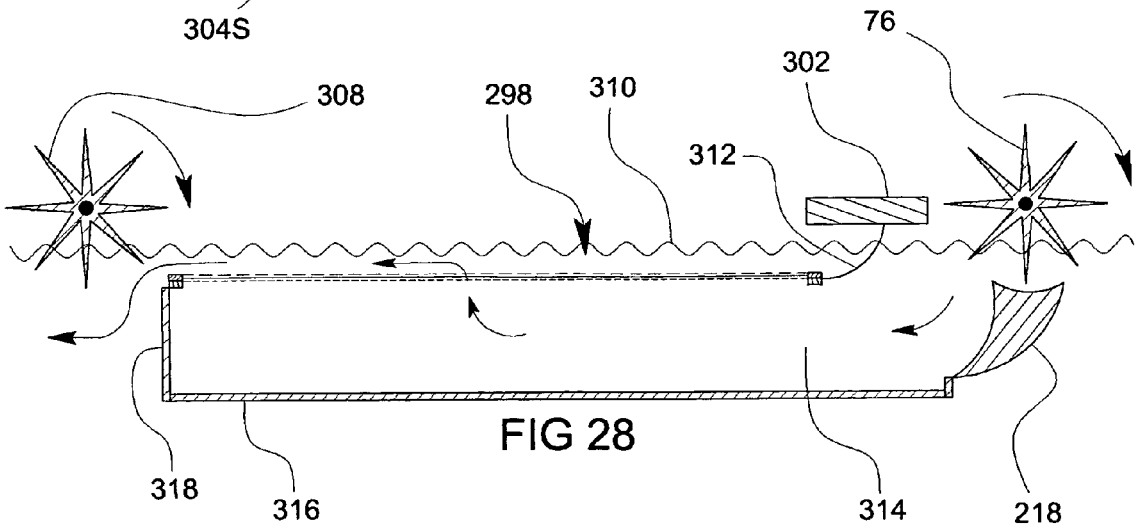

Experiments indicate that skimmers with shallow bite impellers require a filter design with minimal backpressure, and perform best when as much filtration area as possible is oriented vertically, so that water can exit directly to the rear. An example of a embodiment that would fair well with a shallow bite impeller is this present skimmer A, with chemical dispenser assembly 72 removed, as illustrated in FIG. 4B. In this case, much of the effective propulsion would be from water exiting the vertical filter component 196. Another example would be skimmer B, since it can achieve its propulsion directly from a secondary rear impeller 308 as shown in FIG. 28.

FIG. 7:

Water motion caused by impeller 76 rotation is shown by the arrows beginning just aft of impeller 76. Note that the rotating impeller 76 traps water between the waterline 207 and curved inlet dam 106. Inlet gap 208 represents the small clearance between impeller 76 and inlet dam 106. Inlet gap 208 represents the clearance, not the total size of the path of water inlet into the skimmer. Inlet gap 208 does, however, represent a potential gap for the backwash of debris from out of filter assembly 68 during times impeller 76 is not operating.

When the skimmer is not operating, inlet gap 208 is significantly below waterline 207 and even further above the filter media 104. In practice, most retained debris will be waterlogged, and resting on filter media 104. Most of the remainder will still be floating at waterline 207. Because of this, as long as at least one vane (such as vane 206) of impeller 76 is touching the water, very little debris will backwash out through inlet gap 208 during shut down times.

Of greater concern is the gap between adjacent vanes, should impeller 76 stop with no individual vane directly above inlet dam 106. This is only a great concern during conditions of heavy waves, with the unit not operating. FIG. 7A displays a different style of inlet dam, deep inlet dam 218, characterized by a broad, cylindrically hollow top surface. This deep inlet dam 218 traps water in a positive displacement pump formed between the tip of adjacent vanes 210 and 212 and inlet gap lip 214 and the outlet lip 216 of deep inlet dam 218.

It also has at least two consecutive inlet gaps that water and debris must squeeze through for backwashing to occur, with the skimmer shut down.

Employing deep inlet dam 218 (FIG. 7A) to replace inlet dam 106 (FIG. 7) has two positive effects: First, it creates a double positive seal against backwashing of debris at both deep inlet dam entrance 214 (FIG. 7) and inlet dam exit 216. Secondly, it creates the potential for impeller 76 to pump significantly greater head pressure of water. This alternate deep inlet dam 218 is not shown as a normal feature of skimmer A, but is shown as a normal feature of skimmer B, predominantly because skimmer B is intended to represent a higher powered skimmer, and positive displacement pumps require more power when turning impeller 76.

FIG. 7: Deflector Vanes: Theory of Operation

The theory of operation of deflector vanes concerns the nature of water diffusion through a filter, such as filter media 104. Finer pores, in a filter media, result in more randomness in the direction of exiting water. Intuitively one tends to think that the direction of water passing through a horizontal fine screen will be almost unaffected by the presence of the screen. That is far from the case as filters get progressively finer. A horizontally placed fine screen results in almost random exiting thrust vectors, with a mean thrust vector almost straight down, rather than towards the stern. This produces little net useful rearward thrust.

Further theory of operation of deflector vanes indicates that, as power to impeller 76 increases and depth of bite increases, pumping head pressure will increase. Note that deflector vane assembly 108, as shown, displays a narrowing gap, or nozzle effect, between individual vanes, in the direction of water flow. Hydrodynamic theory indicates that this improves pressure recovery. Pressure recovery is the efficient conversion of pumping head pressure into velocity, with velocity being converted to thrust when it is deflected toward the stern.

Generalized thrust vector deflection means:

Experiments have verified the importance of thrust vector deflection means. In general, thrust vector deflection means refer to any method of smoothly turning the direction of motion of water exiting the filters into a predominantly rearward, or thrusting, direction. This has been accomplished in experiments effectively both by deflector vanes and by the placing of a closed chamber underneath the filter media 104, with said closed chamber having an exit facing towards the stern of the vessel. While such a closed chamber is not represented explicitly in drawings of this skimmer A, it is incorporated into skimmer B. FIG. 28, with the simple removal of rear impeller 308, demonstrates the use of a closed chamber as a replacement for deflector vanes. Theory indicates that closed chambers with rear exits act as a precise equivalent to deflector vane assembly 108 in its function of turning of the thrust vector rearward.

Shape of Impeller 76

FIG. 76:

Impeller 76 is represented as an 8-vane paddle wheel style of impeller having vanes that parallel impeller shaft 88 (not shown here, but illustrated in FIG. 3). It is self evident more vanes reduce backwash potential using a narrow inlet dam such as inlet dam 106, by reducing the gap between adjacent vanes and inlet dam 106.

An equivalent conventional impeller variation, not shown, to impeller 76, is to twist the vanes of impeller 76 helically about its shaft 88, not shown. This impeller variation is slightly more difficult to manufacture, and differs predominantly in producing less waves during operation, which may slightly reduce parasitic energy losses.

Reversing Impeller 76—Backwash of Debris

FIG. 7:

During reversal of direction of rotation of impeller 76, discussed earlier, debris already collected in filter assembly 68 may tend to be pumped back out through inlet gap 208. Both skimmers B and C have more sophisticated ways of dealing with this problem, while skimmer A, shown here, merely minimizes the problem with several design traits.

First, the length of filter assembly 68 contributes to debris settling in its rearmost portion. During impeller reversals most of the reverse flow of water tends to come upwards through the most forwards portion of filter assembly 68.

Figure 42:
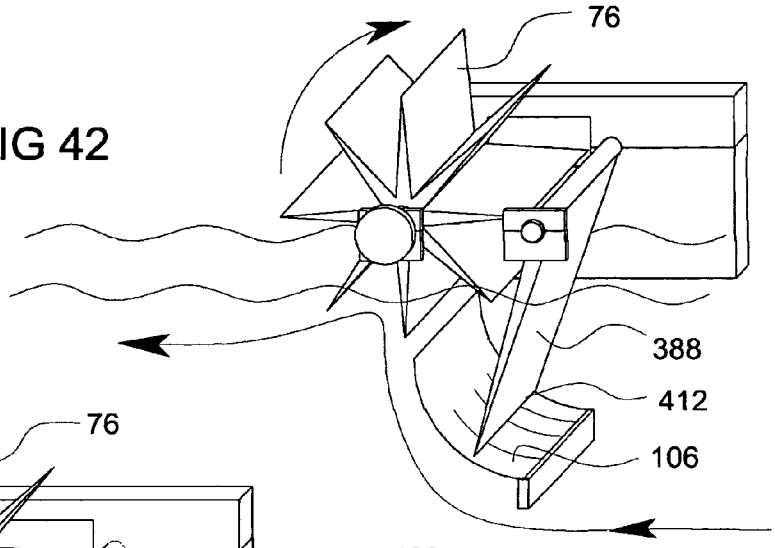

Second, the location and shape of inlet dam 106 contributes to a reverse water flow pattern, not shown here, but demonstrated in FIG. 42, where water will be sucked along the front surface of inlet dam 106, coming from underneath the skimmer. This effect is more noteworthy as the fineness and flow resistance of filter media 104 increases.

Third, the speed of reverse rotation of impeller 76 may be set at a significantly lower speed than is its forward speed. This effect, not conveniently displayed in diagrams, has the greatest effect on reducing backwashing of debris during impeller 76 reversals. Experiments demonstrate that the propulsive efficiency of impeller 76 is significantly greater operating in reverse compared to its normal forwards direction of rotation. Therefore, a lower speed, and a lower volume of backwards-pumped water, is sufficient to back away from obstructions. Lower volume of backwards water flow through filter media 104 greatly inhibits backwash of debris.

Fourth, in FIG. 7A, the depth of filter 220 represents the depth of filter 104 below waterline 207. A relatively great depth of filter 220 contributes toward not backwashing already waterlogged debris. It needs to also be noted that, experimentally, impeller 76 is extremely effective in swamping, and causing the waterlogged condition, of most entrapped debris.

Fifth, skimmer A may use a shorter cycle of reversal, giving less time and opportunity for backwash, than will probably be used in the more forgiving skimmer B or skimmer C. The later embodiments then allow for backing up greater distances away from an obstruction. Skimmer A must substitute with a coasting cycle following a briefer period of impeller reversal.

Sixth, skimmer A may use a higher standard for choosing to reverse impeller 76. This merely involves waiting for a longer time without relative motion before initiating reversals. This provides more opportunity for powered bumper wheels 62P and 62S (not shown here, but as illustrated in FIGS. 21–23) to deal with stuck positions prior to using reversals of direction as a last resort.

Figure 8:
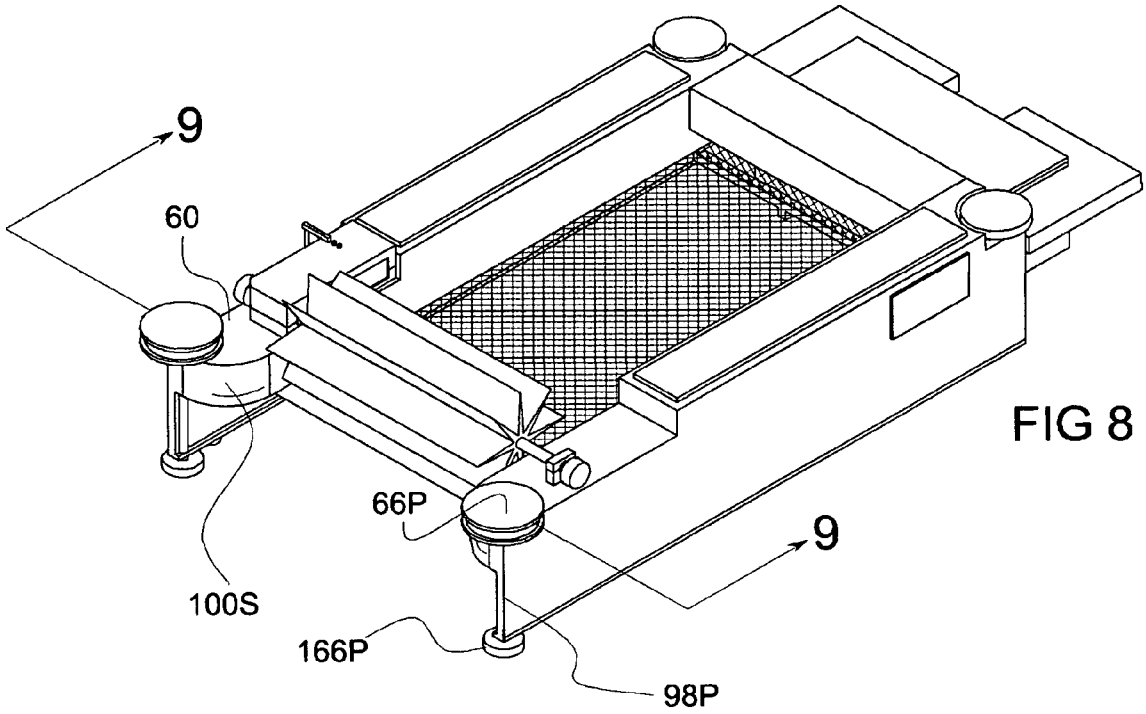
Figure 9:
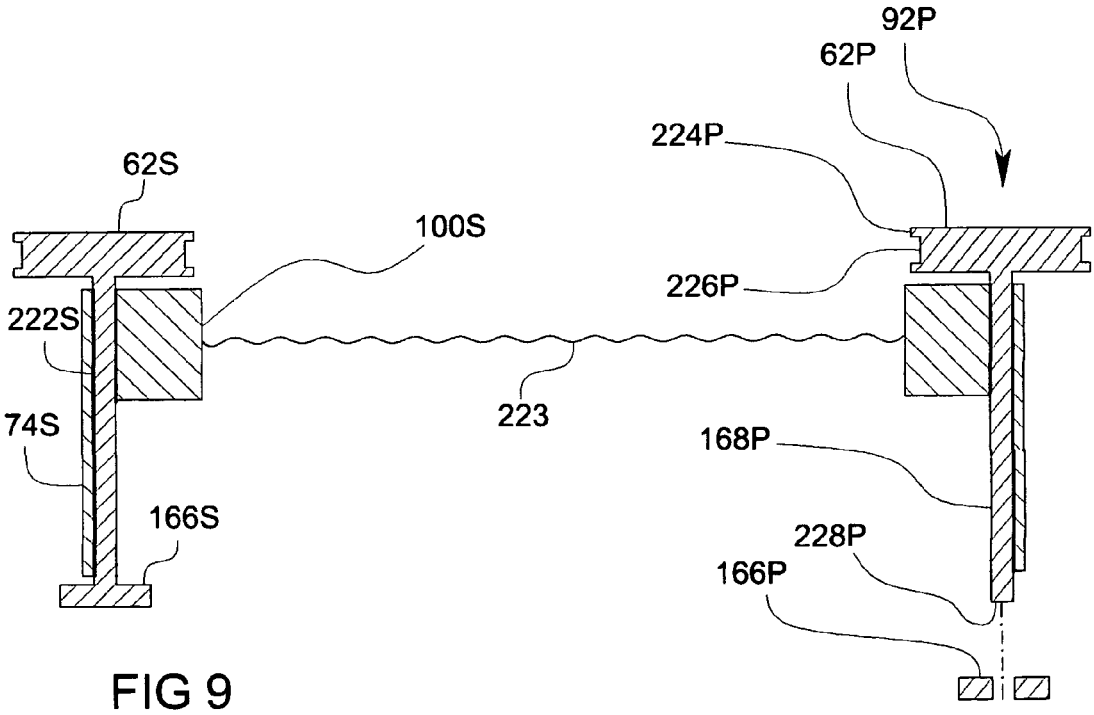
Figure 10:
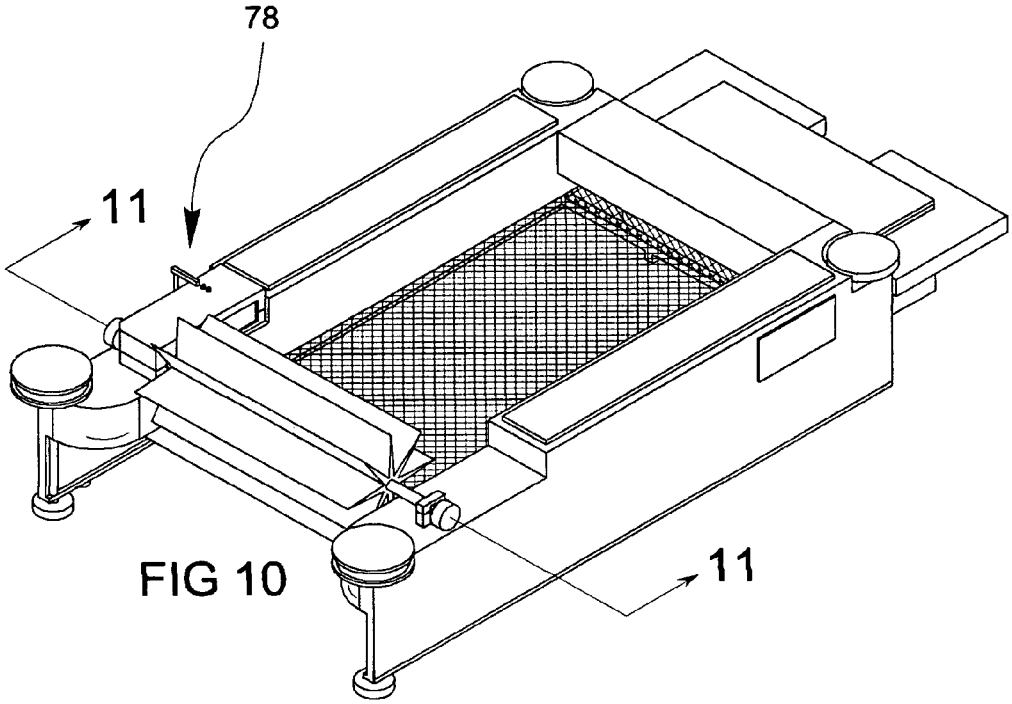

Lower Bumper Wheel Operation, FIG. 8 and FIG. 9

Lower bumper wheel 166P can be seen to protrude beyond port bow extremity 98P, of body 60. Since it represents the most forwards and lowest portion of the moving skimmer, it will contact submerged swimming pool steps before any other portion of the skimmer. Since it rotates as a unit with powered bumper wheel 92P, it will have much the same effect underwater as the powered bumper wheel will above the water line. It will deflect the skimmer from the vertical edge of submerged swimming pool steps in exactly the same manner that powered bumper wheel 62S deflects the skimmer from a vertical swimming pool wall 293 in FIG. 21.

Chemical Dispenser Operation, FIGS. 16–19

FIG. 17:

Chemical dispenser assembly 72 operates in a manner somewhat different from conventional free-floating chemical dispensers (not shown). It has a box 118, a lid 126, and an interior 124 intended for holding dry chemicals below the waterline 236, much like conventional chlorinators.

It differs by having a floatation collar 130 designed to minimize settling upon dumping heavy chemicals into interior 124. This functions by greatly increasing the floatation displaced volume upon a small increase in depth of settling in the water caused by chemical weight. The floatation of floatation collar 130 is supplemented by a similar striking increase in floatation caused by cross member 102 settling into the water (not shown here, but illustrated in FIG. 7.)

This limitation on the depth of settling is critical, since, as can be seen in FIG. 16, depressing the stern of the skimmer with chemical weight will tend to bring the bow of the skimmer, and impeller 76 up out of the water.

FIG. 19:

Chemical dispenser assembly 72 further differs from conventional chemical dispensers in having openings only near the top. Note that entrance 120 and exit 122 are significantly higher than the bottom of chemical dispenser assembly 72. When the skimmer is not operating, this has the effect of allowing a strong and heavy chemical solution to reach saturation below the level of entrance 120 and exit 122. In the absence of water flow, gravity will greatly inhibit diffusion of chemicals out of exit 122 or entrance 122. When the unit is operating water will flow into entrance 120, swirl around the chemicals inside of chemical dispenser assembly 72, and leave by way of exit 122, as illustrated by the arrows near chemical dispenser assembly 72.

In operation, the net effects of these two major differences are:

First, that chemical weight will not greatly influence skimmer floatation trim and Second, that chemical solution will be released predominantly when the skimmer is operating, not while it is sitting idle.

Also displayed in FIG. 19 is filter assembly handle 198, which supports chemical dispenser 72 during operation.

FIG. 2 displays chemical dispenser box 118 possessing clips, such as clip 128S. In operation, they slip over the top of the rear portion of filter assembly 68, holding chemical dispenser assembly 72 firmly in place when filter assembly 68 is slid into body 60. This is more easily visualized by looking at FIGS. 4A–4C, where it is seen that filter assembly 68 has a vertical filter component 196 that serves to accept the clips of chemical dispenser box 118. Filter assembly 68 further includes a filter handle 198 that conveniently holds the bottom of chemical dispenser box 118. When filter assembly 68 is firmly slid into body 60 (FIG. 4C), this will also serve to hold chemical dispenser box 118 firmly in places at the back end of filter assembly 68.

Electrical Operations, Schematic FIG. 20

In operation, electrical power is generated by solar cell arrays included in electrical power means 240, with the power proceeding both towards battery charger 242 and motor start capacitor 292.

When turned on, battery charger 242 allows solar array generated electricity to be used to charge an electrical storage battery 244. Stored electricity flows back out of electrical storage battery 244 to power all remaining circuitry illustrated, as well as any additional auxiliary circuits that may be subsequently added.

When battery charger 242 is turned off, solar cells arrays that are a component of electrical power means 240 experience a no load condition. In such a no load condition typical conventional solar arrays (such as solar cell array 66P, shown in FIG. 1) produce a voltage significantly higher than the charging voltage required for electrical storage battery 244. This higher voltage is stored inside of motor start capacitor 292, and is liberated at the instant impeller motor 282 is turned on. This provides a pulse of significantly increased starting torque at impeller motor 282. This is particularly useful in overcoming the heavy starting load typical of electrical motors, and is also useful in compensating for the total lack of high peak power production by typical solar cell arrays. Without motor start capacitor 292, it would be very hard to start impeller motor 282 in the absence of a full battery charge, especially under physical load. This is due to the fact that solar cell arrays would have to be enormously oversized to produce the necessary voltage/current pulse to start the skimmer operating.

Battery isolating diode 246 serves to prevent the higher stored voltage in motor start capacitor 292 from leaking into, and overcharging, electrical storage battery 244.

Microprocessor 148 serves to take digital inputs from a number of sensors, make decisions based on the digital state of the inputs, and produce several digital control outputs according to simple discrete programs or sub-programs. Discrete circuits for each function could accomplish the same thing, but become more complex when dealing with several timed functions simultaneously, or multiple logical AND operations.

Circuit 248 simply measures voltage of electrical storage battery 244, and feeds a signal into microprocessor input 264 indicating when voltage at electrical storage battery 244 is below a predetermined low voltage threshold. One of the most useful variations of circuit 248 uses conventional circuitry to produce digital pulses of frequency or length proportional to voltage at electrical storage battery 244. Microprocessor 148, integrating these pulses over time, then has information about the mean voltage at electrical storage battery 244. This information could be integrated into choices involving the length of charging cycles of battery charger 242.

Microprocessor output 271 turns on battery charger 242 (allowing it to charge storage battery 244) IF input 264 indicates a low battery AND IF output 272 currently has impeller motor 282 turned off. Battery 244 therefore charges whenever the solar arrays in Electrical power means 240 produce a voltage higher than current battery voltage at the same time that the motor is turned off. Note: battery charging only when impeller motor 282 is turned off is wise, predominantly because of the constant current properties of solar arrays. Motor loads in experimental skimmers have frequently dropped solar array voltages lower than the voltage needed to charge a battery. Circuit 250 detects a lack of relative motion between the skimmer and the surrounding water. (Note: In FIG. 2, magnetic sensor 142 serves as an active component of Circuit 250 in sensing the motion. Basically sail 174 moves as a response to water motion, causing flexing member 186 to bend, causing magnet 176 to move, whereby change in magnetic flux influences magnetic sensor 142, showing a moving condition of the skimmer.) Circuit 250 produces a signal fed into microprocessor input 266 upon sensing of relative motion, and a lack of such a signal is used by the microprocessor to determine a stuck position. Essentially, the microprocessor "knows" when the motor has power (triggered by microprocessor output 272) and it still doesn't move in a reasonable amount of time. No motion after a predetermined time delay (with power to impeller motor 282) indicates a stuck condition of some sort.

NOTE: A signal of motion from Circuit 250 may act as a RESET button, triggering the unit to run for several minutes, whether the sun is shining or not, and canceling any slowed motion alarm. This provides a convenient method, without a separate switch, of turning off an alarm. It also acts as a convenient method of turning on a cycle of operation anytime, day or night, by simply giving the skimmer a shove. The skimmer obviously can't be allowed to continuously, or repetitively, trigger itself by sensing the motion that it has just created by operating the impeller. Therefore, there must be some sort of time delay (perhaps implemented in software) that prevents such auto-triggering of run cycles. Circuit 252 detects a predetermined minimum level of solar flux (brightness of direct sunlight) required for total solar operation of impeller motor 282. Circuit 252 includes minimum light photo-sensor 140 (represented in FIG. 3) or some similar sensing mechanism. Circuit 252 feeds a signal into microprocessor input 268 indicating when a predetermined minimum solar flux level has been reached. The most useful variation of Circuit 252 would produce a series of digital pulses of frequency or length proportional to the level of solar flux. With this more informative data, it is possible to utilize light data for peripheral uses. A perfect example would be to trigger a relatively long cycle of operation utilizing mainly battery power at the first sign of dawn. This useful cycle would allow operation of the skimmer at the most useful time of the day, before any swimmers disturb the debris on the surface of the pool, and shortly before the morning sunlight will recharge battery 244.

A more basic use of circuit 252 uses it to detect a lack of sufficient sunlight to run the unit. This result is fed into microprocessor input 268. If input 268 sees insufficient sunlight for some predetermined time delay (on the order of several minutes), then microprocessor 148 will shut down output 272. This (indirectly) turns off impeller motor 282 after a reasonable time delay.

This time delay (after loss of sunlight) serves three useful functions:

First, it allows the skimmer to continue running for sufficient time to (normally) traverse a shadow cast across the swimming pool without shutting down. This is critical, to prevent the skimmer from wasting most of its time sitting in shadows, with no available power. The skimmer traverses shadows without shutting off, if not stuck, but shuts down several minutes after the sun disappears.

Second, it is useful in allowing an operational cycle of several minutes to be triggered by simply nudging the skimmer into motion. (Skimmer motion detected by circuit 250 will trigger several minutes of operation, as well as turn off any alarms related to a stuck condition.) This allows any triggering of motor operation to continue for a period of several minutes, on battery power alone, if necessary. This "triggered" cycle of operation provides a convenient way (without outside switches or remote controls) to test or demonstrate operation of the skimmer, whether the sun is shining or not. It merely requires giving the skimmer a shove. This is an effective way of turning the unit on after servicing or extracting it (manually) from a hopelessly stuck predicament.

Third, this time delay operation is also useful in allowing cyclic brief periods of operation during the night, for example, initiated by a (software) timer at hourly intervals. Brief periods of operation, triggered by a software (or hardware) timer, during the night help capture debris that might otherwise sink. This class of "timer initiated" night-time operations may also be made sensitive to battery voltage, sensed by the microprocessor at input 264. This could provide more timer initiated cycles at night (or even during the day) if the battery is fully charged than if the battery is about to die. Cyclic operations such as this also serve the useful purpose of periodically "rescuing" a skimmer that somehow still manages to get stuck in a shadow during sunlight hours.

Two other useful battery-charging functions may be triggered, based on input 268 indicating an adequate level of light.

First, an "after shadow charge" cycle may be initiated, which may (under some conditions) cause the skimmer to shut down while the battery is charged. Since the skimmer frequently operates on battery power while traversing shadows, it is quite possible for multiple shadows cast across a pool to eventually drain the battery, even while the sun is shining in some parts of the pool. This may be prevented by a simple subroutine that checks input 264 for a low battery condition any time input 268 indicates a resumption of generous sunlight after a period of battery only operation. IF the battery is lower than a predetermined minimum charge, AND the sunlight is bright, THEN the motor may be shut down by turning off output 272. Note that the battery will automatically charge any time the motor is shut off AND the sun is shining. This cycle may last until the battery is fully charged, if the skimmer remains in bright sunlight. Alternately, it could be made to last for a predetermined number of minutes. This "after shadow charge cycle" is merely temporary. In other words, if sunlight fails during the cycle, operation of the skimmer resumes, under pure battery power. (Of course, this cycle of operation in shadow will only last for several minutes.) This prevents problems associated with the skimmer drifting back into a shadow while charging its batteries.

Second, a "multiplexed charge" cycle may be initiated, for a period of milliseconds, periodically, whenever input 268 indicates bright sunlight AND input 266 indicates skimmer movement. This simply means that, when the skimmer is moving in bright sunlight, it cyclically shuts down the motor for very brief intervals. If the intervals are sufficiently short, skimmer and impeller motion is continuous. But shutting down the motor, even briefly, allows the full resources of the solar arrays to charge storage battery 244. If circuit 248 detects the battery voltage as a coded voltage value (rather than a minimum threshold), then even the cycle length of multiplexed charge cycles could be modulated for greater charging efficiency. Note: This multiplexed charge cycle helps negate the problem inherent in motor operation dropping the voltage available from solar arrays to below the critical battery-charging threshold. Without this, charging the battery while the unit is operating becomes very difficult, unless solar arrays are tremendously oversized.

Microprocessor clock Circuit—254 operates conventionally, and in some cases may be a component of the microprocessor.

Figure 5:
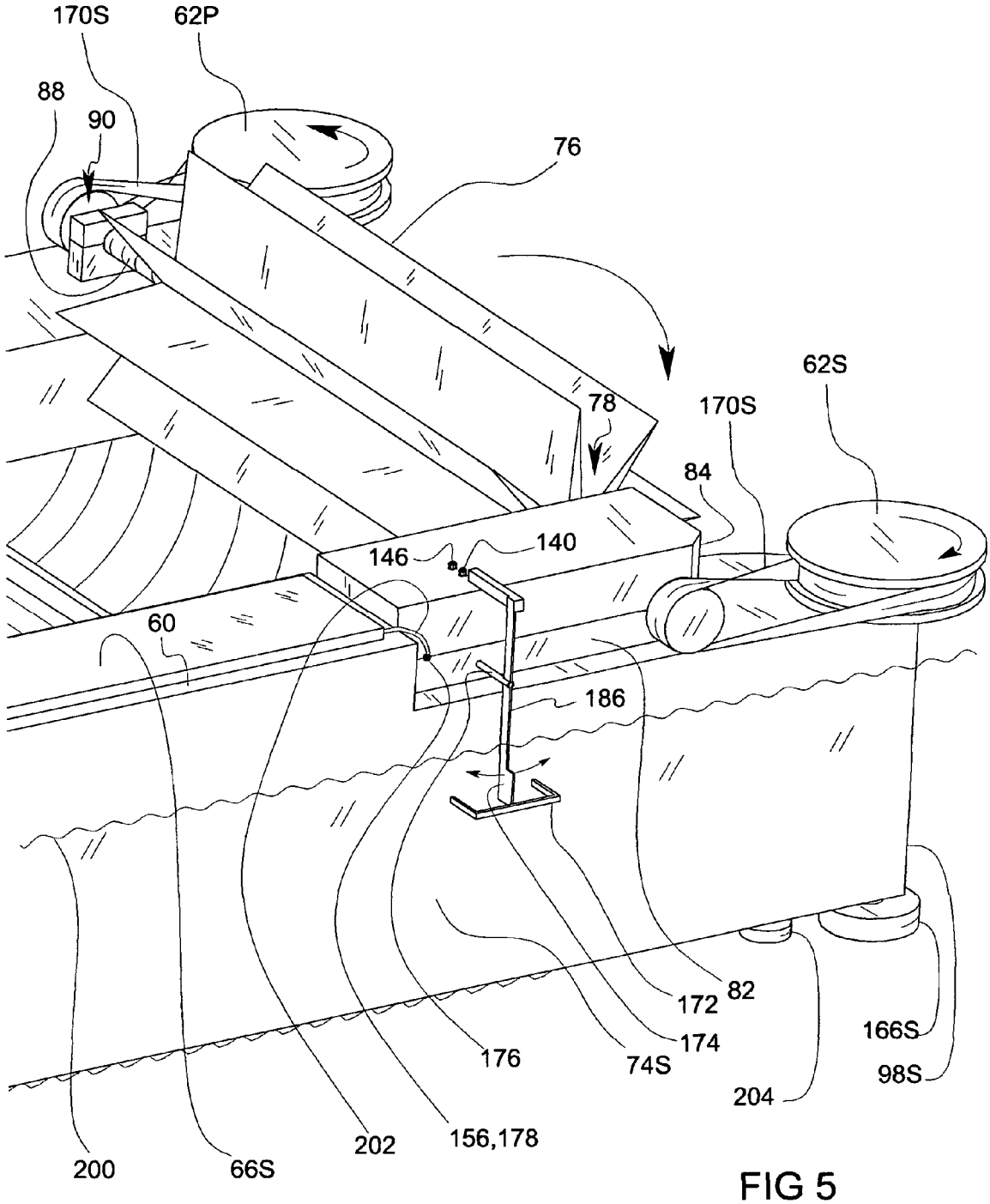

Intrusion sensor 204, intrusion alarm circuit 258, and alarm 260 are all components of a conventional intrusion alarm system. This conventional system can operate using any conventional sensing technique useful for sensing intruders in the swimming pool. As illustrated in FIG. 5, we pictorially represent a sensor 204 as a sonar transceiver typically used to detect motion by the Doppler effect, or a rapid change of sonar reflections. Other classes of sensors may look entirely different, and require placement on entirely different locations on the skimmer. This conventional intrusion alarm system may be a discrete unit, simply drawing power from electrical storage battery 244. Alternately, it may be integrated into the skimmer control circuitry, even to the extent of placing all of its decision-making functions inside of microprocessor 148. In any case, in operation it warns any nearby human of any large intrusion into the swimming pool by way of alarm 260, either directly, or remotely.

A separate and simpler class of variations in intrusion sensor 204 may employ wave sensors. A particularly useful wave sensing mechanism is to employ deflection of floating elements of the skimmer itself to sense the sort of waves created by intruders entering a pool.

If necessary, the entire intrusion alarm circuit may be turned off at the instant of collision of the skimmer with a swimming pool wall, to prevent false intrusion warnings. It may also be necessary to take further steps, such as reducing sensor sensitivity, to prevent false triggering of the intrusion alarm, during times when the skimmer is operating. This may be necessary in the case where rotation of an impeller, all by itself, is capable of triggering an intrusion alarm by creating vibrations, causing wave actions, or causing relative motion of the skimmer.

An intrusion alarm aboard a pool skimmer, such as alarm 260, may also include a photo-flash style of strobe light, aimed downward into the water, that flashes cyclically, illuminating the bottom of the pool, perhaps once a second or so. This both acts as a visual alarm and provides a quick method of verifying that there is not a child lying at the bottom of the swimming pool, in the middle of the night.

Since intrusion alarms, by their very nature, are "life critical", their inclusion mitigates against battery powered skimmer operation at night, and other electrical usage schemes that tend to promote frequent occurrence of dead batteries, unless a separate alarm battery is utilized. A separate battery, charged in parallel with battery 244, but isolated from it by diodes, may be necessary. Such a dual battery system can be used to decrease the chance of loss of power to an alarm system.

Circuit 278, upon signal by microprocessor output 272, turns on power to impeller motor 282, which will normally produce motion in the forwards direction. In doing so, it initially utilizes the relatively high voltage stored in motor start capacitor 292, when available, or the lower voltage, but higher sustained current output of electrical storage battery 244, flowing through diode 246. Or, of course, it can directly utilize power coming from solar arrays, through battery charger 242. Circuit 278 may consist of something as simple as a single (properly biased) power transistor.

Circuit 280, upon signal by microprocessor output 274, reverses the direction of impeller motor 282, typically by reversing the polarity of the voltage flowing to it. This is done for a predetermined period of on the order of several seconds. This has the effect of reversing the direction of propulsion of the entire skimmer. This could easily be accomplished if circuit 280 consists essentially of a motor reversing relay, or a solid-state equivalent circuit.

In skimmer A, the (ideal) normal reverse cycle involves a short backwards cycle of operation of motor 282 at approximately half speed for several seconds, followed by a longer period of coasting with motor 282 off. Then, an attempt at restarting motor 282 in the forward direction is made again. If no relative motion of the skimmer is noted at microprocessor input 266 within a predetermined time, then another reverse cycle is performed. When a predetermined number of reverse cycles occur within a relatively short (predetermined) period of time, a signal is sent to microprocessor output 277 that triggers a slowed motion alarm circuit. This essentially signals failure of the skimmer to clear a clogged impellor or a stuck position in a reasonable number of attempts. And since, in skimmer A, repeated reversals may result in backwashing already captured debris out of the filter, it may be wise to turn off the impeller motor upon this type of failure. The lack of motion of the skimmer itself (during sunlight hours) may act as an adequate (visual) "slowed motion alarm", perhaps obviating the need for circuit 288.

Even if the skimmer shuts down after repeated reversal attempts, there is some benefit to cyclic (perhaps hourly) attempts at normal operation. This can be handled by the same program or circuitry that allows cyclic nighttime operation. Since wind and waves and passage of time frequently clear stuck conditions, cyclic triggering forms a useful means of resuming normal operations without human intervention.

The circuit made up of microprocessor output 276, resistor 284, and light emitting diode 146 forms a simple flashing light or warning strobe atop the skimmer, as graphically displayed where LED 146 is visible in FIG. 5. This simply forms a conventional circuit flashing a top mounted LED strobe a predetermined number of times per minute.

Slowed motion alarm circuit 288 generates an alternate alarm signal to alarm 260 by way of line 290, such that a less strident or different type of alarm is heard or sensed by nearby humans than that provided by the intrusion alarm circuit 258. Circuit 288 generates this "low stridency" alarm when it receives a signal from microprocessor output 277. This occurs when more than a predetermined number of reverse cycles occur in a given period of time, and signals a condition where the unit could not clear its impeller of debris, or successfully evade an obstruction, or when the unit has so much debris in its filter that it can no longer propel itself at an acceptable minimum speed. This normally also results in shutting down the impeller motor 282 to prevent the skimmer from disgorging its debris in an excessive number of reversals of directions.

Note that manually moving the skimmer (say by nudging it) creates a sensing of relative motion in circuit 250, which triggers a cycle of operation, canceling the alarm. This using of circuit 250 as a "reset button" is useful, since it is common for a passing human to give a stuck skimmer a nudge to free it.

Not separately visible in this circuit diagram is a timed function associated with microprocessor output 272. At some time interval (say, for instance, once an hour) a signal may be sent to output 272 to turn on the impeller motor (by way of circuit 278, powering impeller motor 282). This allows several minutes of operation at least several times during the night. It also gives time for wind and waves to "fix" a stuck position, then allows a stuck skimmer to periodically cancel its slowed motion alarm and try operating normally once again.

Skimmer B

Detailed Description

Figure 27:
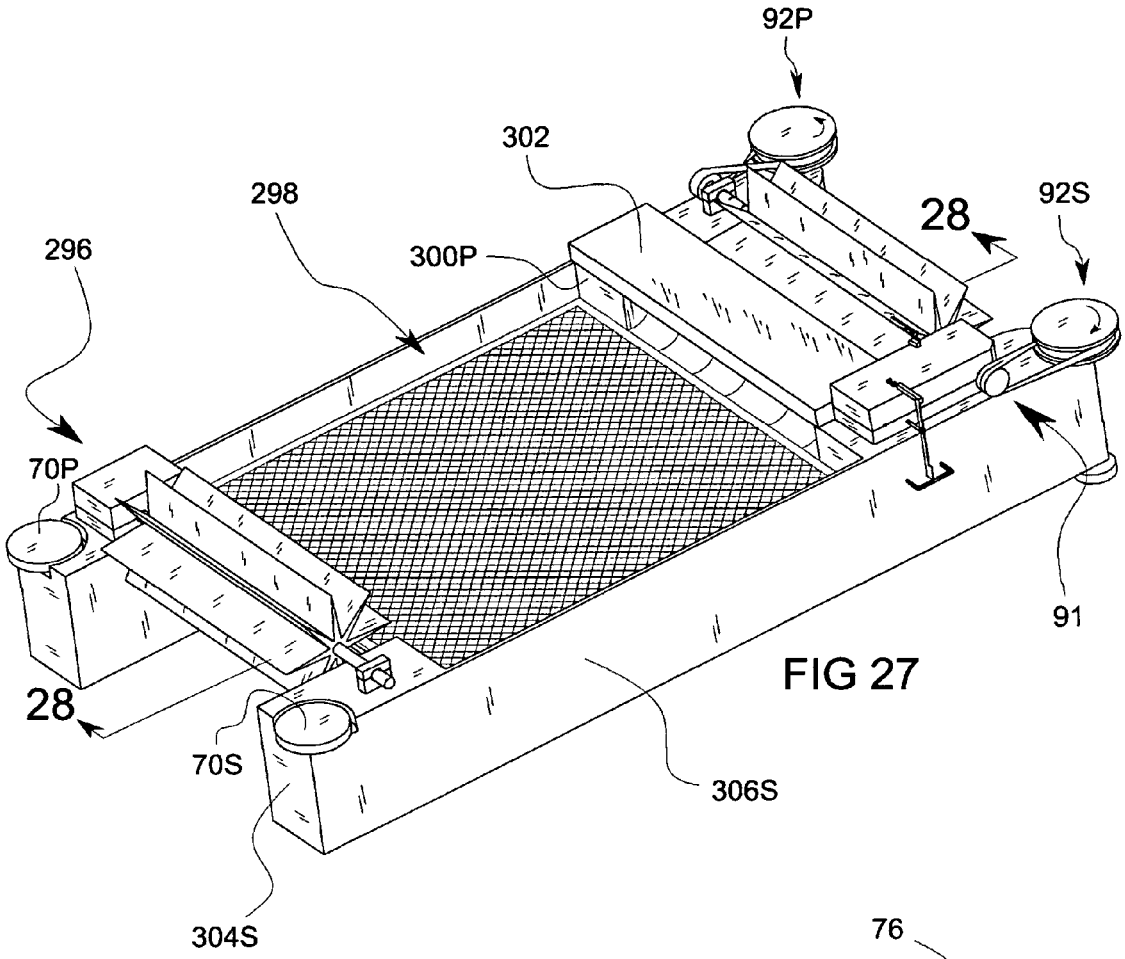

FIG. 27: isometric view introduction:

Skimmer B shares many common features with skimmer A. Notably: All of main drive train assembly 91, powered bumper wheel assemblies 92P and 92S, and idler bumper wheels 70P and 70S may remain identical.

Obviously different is the lack of any sort of swimming pool chemical dispenser or any sort of alarm circuitry, and the inclusion of a rear drive train assembly 296, that is essentially just a slightly simplified version of main drive train assembly 91.

Floatation has been re-arranged to locations closer to the bow and stern, such as bow floatation chamber, Port side 300P at the bow and floatation chamber, starboard side 304S at the stern. Filter assembly 298 is located higher, and is has more components than is the equivalent assembly in skimmer A. Also obviously different are the gunwales, such as gunwale, starboard 306S, which form relatively thin walls containing no significant floatation. And solar cell array 302 replaces the two narrower such arrays in skimmer A.

FIG. 28 longitudinal section:

Impeller 76 is located directly above deep inlet dam 218. Deep inlet dam 218 details are shown in section in FIG. 7A, as a variation in skimmer A. In FIG. 28, an essentially closed sump chamber 314 is formed between deep inlet dam 218, waterline scoop 312, filter assembly 298, sump chamber bottom pan 316, gunwales, such as gunwale, starboard 306S (FIG. 27), and rear dam 318. Sump chamber 314 forms a portion of an interior water channel with a broad shallow entrance above deep inlet dam 218 and an exit upward through filter assembly 298 and rearward past rear impeller 308. It is highly advantageous to locate sump chamber 314 downstream of impeller 76. This allows impeller 76, when not rotating, to serve as a barrier preventing backwashing already collected debris from sump chamber 314. It also makes it possible to have an impeller both pushing water into the sump chamber (impeller 76), and pulling water from the sump chamber (rear impeller 308). This improves filter performance.

Rear impeller 308 is a rotating component of rear drive train assembly 296, and is located significantly to the rear of sump chamber 314. There is a series of arrows beginning below and to the rear of impeller 76 that extends upward through filter assembly 298, and to the rear, past and below rear impeller 308. This series of arrows represent the normal water flow path. Therefore, it can be seen that impeller 76 lies at the water entrance to the skimmer, and that rear impeller 308 lies at the water exit of the skimmer. And that, in between these two points in the water flow path, lay sump chamber 314 and filter assembly 298, directly above sump chamber 314. It can further be seen that deep inlet dam 218 closes off the bow end of sump chamber 314, and that waterline scoop 312 forces water to travel downward into sump 314, and then back up through filter assembly 298.

The arrows closely associated with impeller 76 and with impeller 308 indicate the normal direction of rotation of these impellers, when the skimmer is moving forward.

Figure 29A:
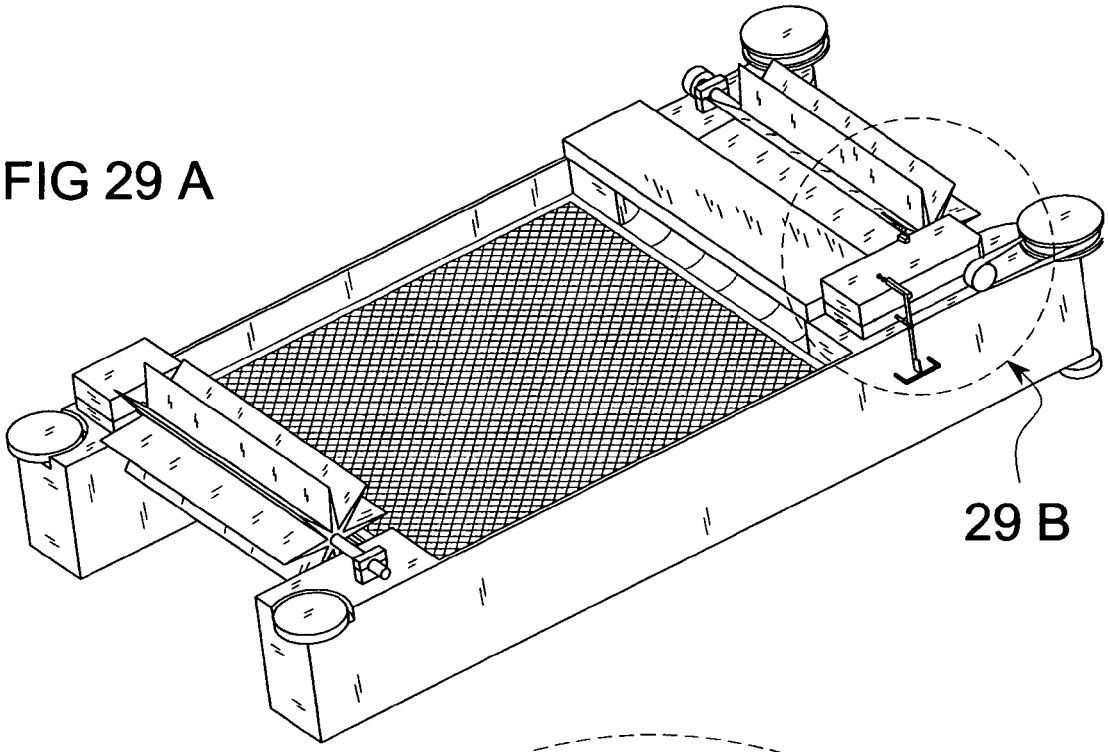
Figure 29B:
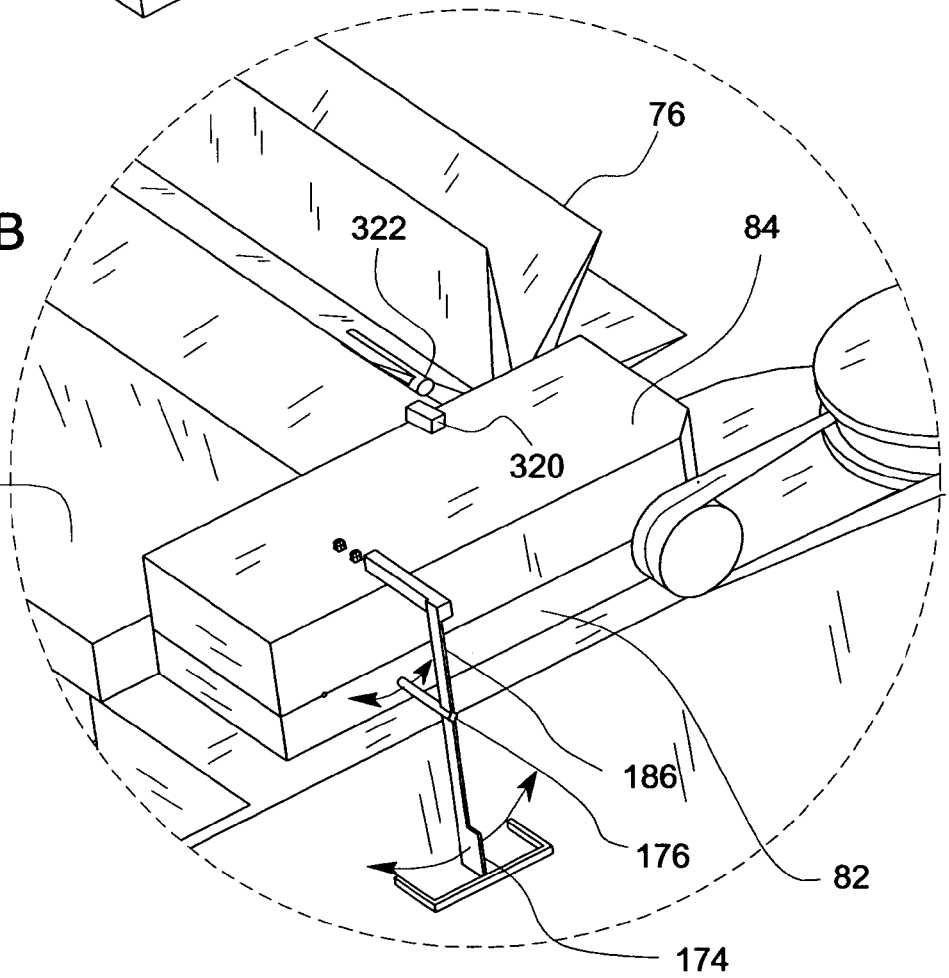

FIG. 29B—Lid Close Up

FIG. 29A is an isometric view of the skimmer showing the area of view for expanded view, FIG. 29B.

FIG. 29B

Solar cell array 302 is essentially equivalent to the two solar cell arrays in skimmer A, and is illustrated at a location clear of impeller 308 and filter assembly 298.

Impeller speed sensor magnetic sensor 320 is located on top of dry gear-motor lid 84, and is electrically connected to the control circuitry located inside of dry gear-motor box 82. Impeller magnetic sensor 320 also makes up the raw sensing portion of circuit 372 (FIG. 35), which detects the absolute speed of impeller 76. Impeller sensor 320, in its simplest form, would be magnetically sensitive reed switch. But other magnetic flux sensors could also serve, such as Hall effect sensors, and magnetic pickup coils. Both of these require more additional circuitry than does a simple reed switch.

Impeller magnet 322 represents a small magnet secured to impeller 76. It is placed in such a position on impeller 76 that, upon rotation, it will pass close by impeller magnetic sensor 320. One or more such magnets provide the signal required to measure impeller speed of rotation.

FIG. 29B are all of the components used to measure relative speed of the skimmer. These include sail switch sail 174, flexible member 186, and motion sensor magnet 176, all of which are identical to those elements in skimmer A.

Filtration System FIG. 30–FIG. 32

FIG. 30 is an isometric view showing both the longitudinal section plane for FIG. 31 and the lateral section plane for FIG. 32. All three drawings represent the skimmer with the components of the filter system angled upward, as if to be cleaned or removed.

FIG. 31 is a longitudinal section through the skimmer with filtration components lifted at an angle, as if for removal or cleaning. FIG. 32 is a lateral section amidships, with filtration components lifted at the same angle, as if for removal or cleaning.

FIG. 31 and FIG. 32:

Fine disposable filter media 334 is shown as sandwiched between a top grid 330 and a bottom grid 338. Disposable filter media 334 represents a very high quality paper towel or similar porous felted paper-like material used as a disposable filter. Filter media 334 typically is quite soft when wet, and requires the support on the top side of top grid 330, and the support on the bottom side of bottom grid 338. Both top grid 330 and bottom grid 338 are relatively course grid works made of a durable and corrosion resistant material. Suitable materials might include stainless steel screen, UV resistant plastics, and a wide range of other durable materials.

Top grid frame 332 surrounds and increases the rigidity of top grid 330, both elements taken together constituting a removable top grid assembly 333. Top grid assembly 333 needs to either be totally removable, or mounted so as to hinge upward, allowing clear unobstructed access to fine disposable filter media 334.

In practice, top grid assembly 333 must, at least, serve to act as a clamping mechanism upstream of disposable filter media 334. It must serve to clamp at least the edges of disposable filter media 334 (usually a "paper towel") secure against bottom grid 338 so that disposable filter media 334 does not tend to float or wash away from its normal location.

Disposable filter media 334 normally rests on bottom grid 338, which gives structural support, and position retaining ability, to the rather soft and floppy filter media 334. Bottom grid 338 also has a bottom grid frame 336, increasing its rigidity. Bottom grid frame rests on filter frame supports, such as filter frame support 340P. Gunwale, port 306P acts as the ultimate support and lateral edge barrier for this filtration system.

Disposable filter media 334 may be custom manufactured for this purpose. But, more than likely, rectangular or roll type products designed as disposable cleaning rags will be used. For this reason, maintaining a filtration system with rectangular dimensions matching a multiple of the dimensions of the most common roll products on the market is probably desirable.

Figure 33:
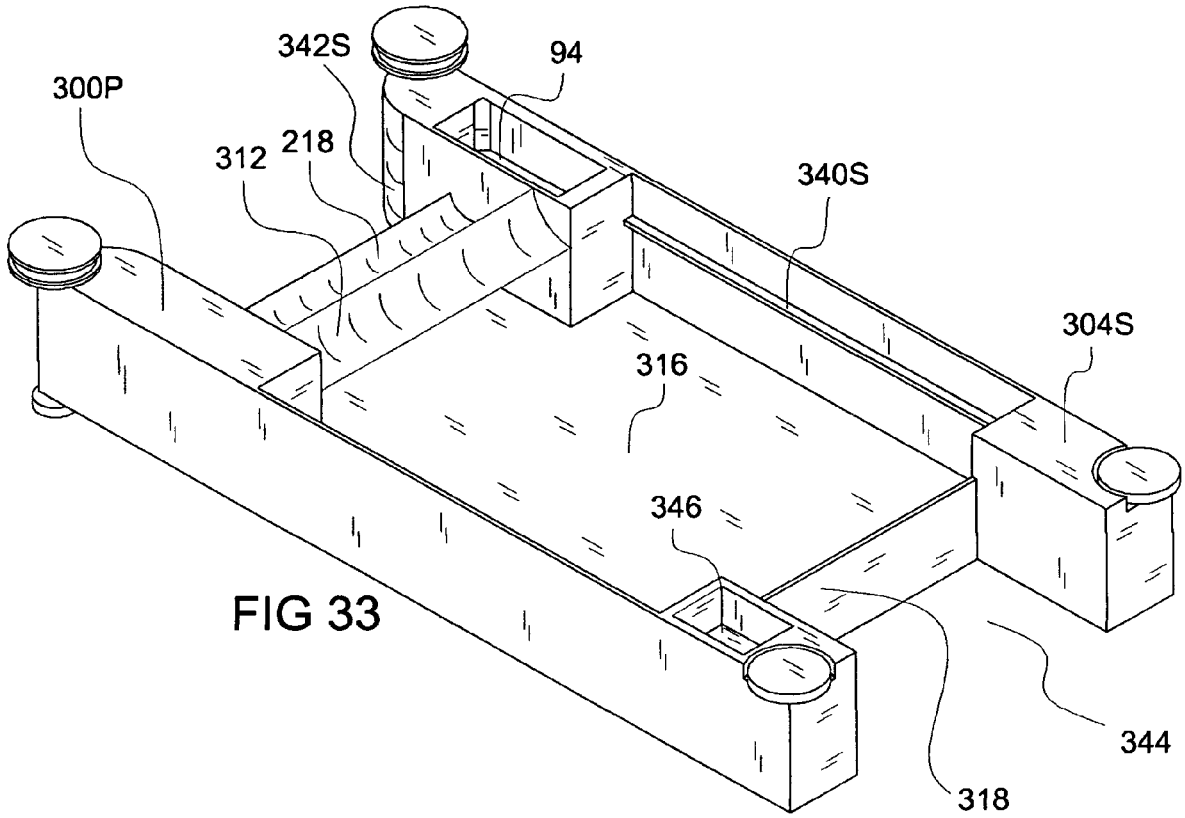

Body Structure: FIG. 33

FIG. 33 presents an isometric view of the skimmer with both drive trains and all filter components removed. This view clarifies the geometry of skimmer embodiment B.

Bow floatation chamber 300P and Stern floatation chamber 304S display how floatation is concentrated at bow and stern of the vessel. This is not particularly critical in skimmer B, but serves a useful floatation trim purpose in skimmer C. Therefore, the primary remaining reason for not having continuous pontoons on either side of the skimmer is to provide a larger rectangular area of filtration amidships.

Dry gear-motor recess 94 is identical to that in skimmer A. An additional similar cavity to receive rear dry gear-motor assembly 346 near the stern is provided to receive rear drive train assembly 296 (not shown here, but illustrated in FIG. 27.)

Water channel tapered inlet 342S, at the bow of the skimmer, serves a purpose similar to narrowing water inlet 100S in FIG. 2. The only difference is a bit more fullness of the floatation chamber, by extending it downward to nearer the bottom of the skimmer.

Deep inlet dam 218 can be seen to have a hollow cylindrical trough along its top surface, with its full sectional profile more apparent in FIG. 28. This element is identical with that presented in FIG. 7A. Waterline scoop 312 is a thin water deflector element whose cylindrical shape in shown in sectional profile in FIG. 28. It stretches laterally with a lower lip lining up with the back edge of bow floatation chamber 300P.

Sump chamber bottom pan 316 serves as the floor or bottom surface of sump chamber 314 (not shown here, but illustrated in FIG. 28). Rear dam 318 serves as the rear wall of this same sump chamber 314. It also has a top lip that is at the same level as filter frame support 340S, so that it conveniently mates with bottom grid frame 336, as can be seen more clearly in section in FIG. 31. Stern impeller well 344 is a cavity located below the normal position of rear impeller 308, shown most clearly in FIG. 29A. This serves a purpose analogous to a similar such stern impeller wells located on many stern paddle wheel riverboats.

Rear Drive Train Assembly 296

Figure 34:
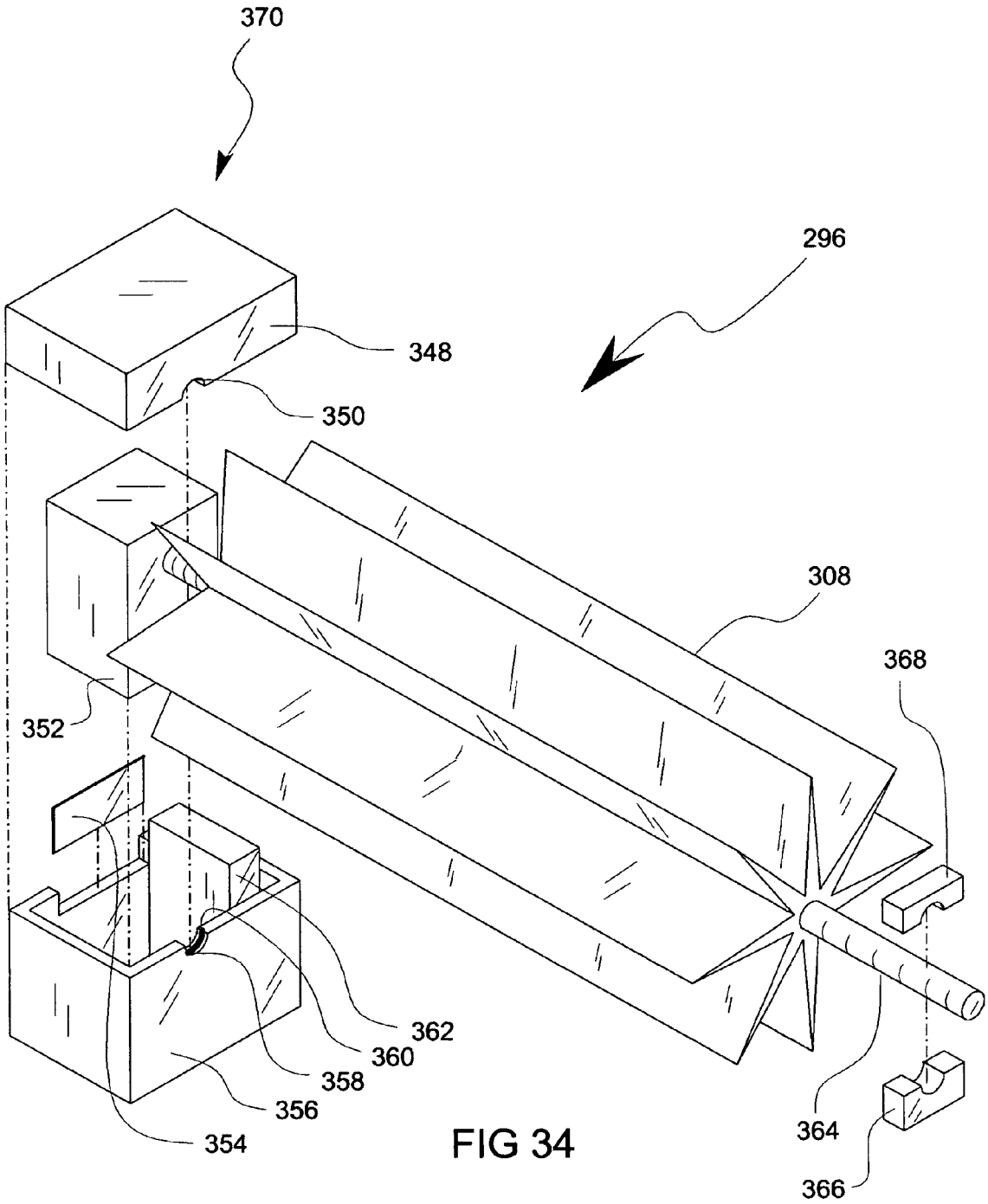

FIG. 34 is an isometric exploded view of rear drive train assembly 296. It incorporates components directly analogous to those in main drive train assembly 91, with the exception of not holding any printed circuit board or other electronic circuitry and having only a hole 358 and a hole 350 (top half of the same impeller shaft hole). Otherwise, all the elements are similar to the corresponding elements in main drive train assembly 91, as displayed in FIG. 3. Specifically:

Rear dry gear-motor assembly 370 is a simplified version of dry gear-motor assembly 78.

Gear-motor 352 is equivalent to gear-motor 138.

Rear impeller shaft 364 is equivalent to impeller shaft 88.

Top bushing 368 corresponds to impeller shaft top bushing 134.

Bottom bushing 366 corresponds to impeller shaft bottom bushing 136.

Rear impeller 308 is equivalent to impeller 76.

Rear barometric adjustment membrane 354 is equivalent to dry gear-motor barometric membrane 86.

Shaft seal 360 is equivalent to shaft seal 164.

Lid 348 is equivalent to dry gear-motor box lid 84

Rear dry gear-motor box 356 is equivalent to dry gear-motor box 82

Adsorbent chemical 362 is equivalent to chemical adsorbent 154.

The entire rear drive train assembly 296 serves a similar impeller function at the stern of the skimmer to that of main drive train assembly 91 at the front of the skimmer. As seen by comparing FIG. 34 to FIG. 3, the main differences are the lack of one shaft extending out of box 356 and a total lack of electronic components. These differences are due to the facts that all necessary electronics can reside in a single dry gear-motor box 82, and that there is no need for bumper wheel drive means at the stern of the skimmer.

Circuit Diagram Details

Skimmer B

FIG. 35 is a block schematic diagram of the major electrical and electronic circuits required for the functioning of embodiment B of the skimmer. Most elements remain the same as those of skimmer A, illustrated in FIG. 20. Only new elements, or differences of circuitry are detailed here.

Electrical power means 240, shown pictorially the same in FIG. 35, now includes a single solar cell array rather than the two smaller ones shown in skimmer A. This is a cosmetic difference of subcomponents, rather than an electrical one. Microprocessor 148, is also shown in FIG. 35 with one more input and one more output utilized, but can still represent the precise same microprocessor.

FIG. 35, deleted elements:

Note that all alarm related circuitry is stripped from skimmer B, as shown in FIG. 35. This is not critical, but merely demonstrates that both intrusion alarms and slowed motion alarms are useful optional extras, but not necessarily desirable in the more utilitarian heavy-duty skimmer B. This eliminates circuits 204, 258, 260, and 288 (all shown in FIG. 20), as well as line 290, and microprocessor output 277.

FIG. 35, added elements:

Circuit 372, detecting the speed of impeller 76 (FIG. 29A), includes magnetic sensor 320 and impeller magnet 322 (FIG. 29A), or similar conventional circuitry capable of counting the revolutions or otherwise detecting the existence of rotation of the forward impeller, impeller 76. Alternative equivalent conventional circuit elements might include a simple micro-switch contacting vane of impeller 76, or a photo-sensor based device detecting a dark spot on one impeller blade.

Circuit 372 detects rotational motion of impeller 76 and feeds a digital signal bearing information on the rotational state into microprocessor 374. This digital signal will typically be encoded in a form such as frequency of pulses being directly proportional to rotational speed of the impeller.

The remaining circuit elements that have been added represent one complete set of control circuitry for turning on and off, and reversing the direction of, the rear impeller motor 384, part of a conventional gear-motor assembly 384 that ultimately drives the added rear impeller 308 (FIG. 308).

Specifically:

Microprocessor output 376 produces a digital signal used by circuit 378 to turn on or off current to rear impeller motor 384. Since, in skimmer B, the propulsion function and skimming function are essentially separated, this motor control circuitry basically turns on and off propulsion, in either direction.

Microprocessor output 380 produces a digital signal used by circuit 382 to reverse the direction of rotation of rear impeller motor 384.

Motor 384 is the electrical motor component of gear-motor 352, which drives shaft 364, and ultimately rear impeller 308 (all displayed in FIG. 34).

Thus, circuit 378 is the functional equivalent to circuit 278, merely turning on and off rotation of the rear impeller Circuit 382 is the functional equivalent to circuit 280, merely reversing propulsion.

And motor 384 is the functional equivalent to motor 282, except that is in the rear, and more exclusively dedicated to propulsion, rather than skimming.

Excepting that they all serve to power and control the rotation of rear impeller 308 (displayed in FIG. 28) rather than forward impeller 76 (displayed in FIG. 28).

Operation, Skimmer B

Overview: FIG. 27 and FIG. 28.

The removal of the optional intrusion and slowed motion alarm circuits, and the optional chemical dispenser, obviously removes all of their associated functions. Skimmer B retains only navigation, skimming, filtering, and propulsion functions. All of the basic navigation operations associated with reversing the direction of propulsion and the use of powered bumper wheels assembly 92P and 92S, and idler bumper wheels 70P and 70S remain essentially the same, as previously discussed in dealing with FIG. 21–FIG. 26 in the Operation discussion of skimmer A.

The modified filter assembly 298 allows much finer filtration, and the under-the-filter sump chamber 314 allows collection of a much larger quantity of debris prior to filter clogging. And, obviously, the extra rear drive train assembly 296 considerably increases propulsion efficiency, partially separating propulsion and skimming functions of the impellers.

This embodiment is particularly well suited to large and leaf clogged swimming pools. This is mostly due to the large capacity filter sump chamber 314, and a filter assembly 298 that is "upside down" and hence very resistant to being clogged by leaves.

Major Operational Details FIG. 27 and FIG. 28

Similarities to skimmer A:

In normal (forwards) operation main drive train assembly 91, powered bumper wheels assembly 92P and 92S, and idler bumper wheels 70P and 70S operate identically to those in skimmer A, discussed earlier. Floatation chambers, such as 300P and 304S are distributed differently, but serve the same floatation purposes as corresponding parts in skimmer A. Solar cell array 302 operates as a larger replacement for two smaller arrays. And wide deep inlet dam 218 is simply the alternative inlet dam design illustrated in FIG. 7A. Since skimmer B is designed as a higher-powered unit, the resulting positive displacement pumping action of impeller 76 (described in the discussion of FIG. 7A) is appropriate as a standard feature.

FIG. 28: Differences from skimmer A:

Water flow, demonstrated by a string of 4 curved arrows running through the internal water channel, can be seen to enter over the top of deep inlet dam 218, with water and debris moved along by rotation of impeller 76. Water flow is deflected downward by static waterline scoop 312. This forces water and debris to flow downwards into sump chamber 314. Subsequently, water flows upward through filter assembly 298 and debris is retained inside of sump chamber 314. Then the filtered water flows backwards past rear impeller 308 where the rotation of rear impeller 308 gives the exiting water a higher velocity and greater reaction thrust.

Rear dam 318, sump chamber bottom pan 316, waterline scoop 312, deep inlet dam 218, and gunwales, such as starboard gunwale 306S cooperate to make sump chamber 314 essentially water tight, forcing water to exit upward through filter assembly 298. Note that water is pumped in a positive displacement action by impeller 76 through filter assembly 298, and that it is pulled, by virtue of rear impeller 308, upwards through filter assembly 298.

Reversals of Direction, FIG. 28

As will be more precisely described later, it is possible to independently start, stop, and reverse both impeller 76 and rear impeller 308. This can be done in response to independent sensing of both the rotation of impeller 76 and of the skimmers motion relative to the surrounding water. Here we will discuss the effects of such programmed (or hardwired) control.

If it is detected that impeller 76 does not rotate in response to electrically powering its motor 282 (FIG. 35), there is obviously a debris jammed front impeller 76. This can be cleared by the application of very brief but full powered reversals of impeller 76. If, after a fraction of a second, no motion of impeller 76 is still detected, it is possible to very briefly give it a long series of forwards and backwards rotational pulses till it is detected that rotation of impeller 76 occurs. Since no more than a single complete reverse rotation of impeller 76 ever needs to occur to clear a debris obstruction from the gap between impeller 76 and wide deep inlet dam 218, there will be minimal or no backwash of debris from out of sump chamber 314 during the debris clearing operation.

Essentially, this style of pulsed reversals allows clearing of debris obstructions without discharging debris.

If it is detected that impeller 76 is actively rotating, but still no relative motion of the skimmer occurs in a predetermined time period, then the skimmer can be assumed to be in a stuck position requiring propulsion reversal.

Propulsion reversal in skimmer B is handled considerably differently than in skimmer A, due to the presence of rear impeller 308, which provides most of the thrust in either forwards or backwards propulsion. The procedure to back away from an obstacle (similar to that shown in FIG. 24–FIG. 26) reverses the rear impeller 308, while preventing the rotation of impeller 76.

If impeller 76 does not rotate over wide deep inlet dam 218, the non-rotating impeller 76 essentially acts as a barrier against debris escaping from sump 314. Rear impeller 308 is reversed, and will usually successfully back the skimmer away from obstacles. It should be noted that, since the stopped impeller 76 essentially blocks the water inlet in the region of impeller 76, there is no harm to making the reversed operation sufficiently long to propel the skimmer backwards a significant fraction of the distance across the swimming pool.

Occasionally this procedure will fail on repeated attempts due to the fact that the powered bumper wheel assemblies, such as powered bumper wheel assembly 92S are rotationally coupled to the non-rotating impeller 76, and will not produce backward propulsion when in contact with a swimming pool wall, or other obstacle.

If, after repeated backwards operation of impeller 308 alone, no relative motion of the skimmer occurs, then a second extraction program can be attempted. This one does allow reverse operation of both impeller 76 and powered bumper wheel assembly 92S, but only at a significantly reduced speed. This final obstacle clearing technique may discharge some debris back into the pool, but will be needed very infrequently.

Skimmer & Impeller Motion Detection

FIG. 29B:

Skimmer motion detection in skimmer B is accomplished precisely the same mechanism and operating the same way as skimmer A. In addition to that mechanism, there are also impeller speed sensing means including magnetic sensor 320 and impeller magnet 322.

Impeller magnet 322 rotates with impeller 76, periodically passing by magnetic sensor 320, which detects and creates an electrical pulse at each passing. This provides impeller speed sensing means suitable for evaluating whether or not impeller 76 is jammed with debris, should the motion sensing means detect prolonged absence of relative motion of the skimmer through the water.

If such an impeller jam is detected, the impeller clearing sequence discussed above can be employed. It should also be noted that a badly plugged filter will cause slowing, but not stoppage of impeller 76. It is possible, at some reduced speed of impeller 76 operation, occurring over an extended period of time, to judge that the skimmer should be shut down until the filter is cleaned. Even without a "full filter" warning alarm, stopping normal skimming movements provides a visual indicator that the skimmer filter needs cleaning.

We recommend that such a programmed shutdown should occur after prolonged slowed rotation of impeller 76, even though it makes little difference to the actual operation of the unit. Several arguments favor this programmed shutdown: First, prolonged running after the filter is full can eventually create impeller clogs and situations more difficult to clean out. Second, stoppage is the most obvious visual warning of a plugged filter. Third, the ability to operate with a partially plugged filter will promote owners not cleaning the unit regularly, which seriously degrades performance, and promotes algae or bacterial growth in the collected debris.

Operation of Filter Media

FIG. 30–FIG. 32 show the procedure for changing disposable filter media 334. Top grid assembly 333, consisting of top grid 330 and top grid frame 332, can be pivoted upward, or completely removed for easier access to disposable filter media 334. Bottom grid 338 and its attached bottom grid frame 336 can also be removed for easier access to debris that collects in sump chamber 314. In skimmer B it is quite likely that sump chamber 314 will fill completely with debris before filter media 334 becomes clogged. This is because wave action continually knocks off dirt and debris from the bottom side of filter media 334, and down into sump chamber 314.

Since the disposable filter media 334 is essentially a felt-like porous paper, it is quite soft and floppy when wet. That is why it must be sandwiched between two grids, top grid 330 and bottom grid 338, or otherwise reliably secured. Even relatively porous paper towels are at least an order of magnitude finer than screens traditionally used in manual pool skimming nets. This, combined with the relatively low speed and head pressure of water flowing through filter media 334, results in its ability to capture extremely fine particulate debris.

In particular, a large fraction of algae and wind blown clay particles can be captured by this filter, significantly decreasing the biological load of the swimming pool.

In normal operation, dirt and debris tends to be filtered out on the bottom side of filter media 334 where it is extremely susceptible to being washed off by wave action, and settle to the bottom of sump chamber 314. During times when the skimmer is not operating, normal wave action serve to clean filter media 334. In practice, this allows filter 334 to be used (without replacement) until sump chamber 314 is essentially full of debris. The exception might be during algae blooms, where the film building tendency of living algae might prematurely plug the filter media 334.

Operation of the Rear Drive Train Assembly 296

FIG. 34 illustrates the physical mechanisms responsible for rotating rear impeller 308. This parallels the operation of main drive train assembly 91 (FIG. 2) almost perfectly.

FIG. 34:

Rear gear-motor 352 rotates rear impeller shaft 364, in either the forwards or backwards direction. Rear dry gear-motor assembly 370 also keeps rear gear-motor 352 dry and corrosion free. Box 356 and lid 348 fit together with a near hermetic seal, with shaft seals such as shaft seal 360 sealing between the shaft holes 358 and 350 and impeller shaft 364. Barometric adjustment membrane 354 reduces moisture infiltration by limiting barometric pressure differences between the interior of rear dry gear-motor assembly and the outside ambient air pressure. Chemical absorbent 362 absorbs any trace of moisture that may find its way into box 356.

The rotating rear impeller shaft 364 also rotates impeller 308, which is secured firmly to it. Top bushing 368 and bottom bushing 366 secures and allows free rotation of the far end of rear impeller shaft 364.

Skimmer B

Operation of Electronic Circuitry: FIG. 35

In operation, the majority of electrical and electronic circuits of skimmer B precisely mimic the operation of the same circuits and components in Skimmer A. The current operational description will cover only points of differences

Circuit Differences of Skimmer B Relative to Skimmer A

The circuits of FIG. 35, skimmer B, have the obvious operational difference of producing no sort of warning of swimming pool intrusion or slowed motion, since all alarm related circuits are deleted in this simplified skimmer B. This is not obligatory, however. Any feature, electronic, or physical, contained in skimmer A could, in some fashion, be included in skimmer B.

Electrical power means 240, labeled the same schematically in both embodiments, includes (in skimmer B) a single solar cell array 302 (FIG. 27) that is electrically equivalent to the two smaller solar cell arrays 66P and 66S (FIG. 1) appearing in skimmer A.

One additional input circuit is added. Circuit 372 detects rotation of impeller 76 (FIG. 29B) and signals this rotation to microprocessor input 374 in digital format. One particular method of accomplishing this is with magnetic sensor 320 magnetically detecting the nearby rotation of impeller magnet 322, as depicted in FIG. 29B. In the simplest possible case this could consist of something as simple as a reed switch acting as magnetic sensor 320, being fed current from electrical storage battery 244 through a current limiting resistor, and feeding the results directly into microprocessor input 374. Microprocessor 148 then merely has to count pulses per unit time to calculate the impeller speed.

Detection of impeller speed at microprocessor input 374 separate from skimmer relative motion, detected at input 266 allows skimmer B to differentiate between a "stuck skimmer" and a "stuck front impeller". This is important, since skimmer B is equipped with both a front and rear impeller. It can both sense and react to the two different conditions in two completely different manners.

Beyond this, one additional set of motor driving circuits is added. Microprocessor output 376 signals circuit 378 at appropriate times to turn on the rear impeller motor 384. And output 380 signals circuit 382 of appropriate times to briefly reverse rear impeller motor 384. These circuits 378 and 382 and this rear impeller motor 384 may even precisely mimic the circuitry of circuit 278, circuit 280, and main impeller motor 282.

In operation, rear impeller motor 384 provides the primary propulsion of the skimmer. It produces most of the thrust in both forward and backward operation. As such, it always operates when moving forward, and always operates when moving backwards.

A debris clogged front impeller is detected by relative motion indicated at input 266 simultaneous with little or no impeller speed detected at input 268. This is primarily handled by cyclic front impeller reversal, but benefits by a slightly more sophisticated response.

It is useful to rotate rear impeller motor 384 in reverse for several seconds when front impeller 76 first becomes debris clogged, before attempting to reverse impeller 76 in brief pulses of operation. This is convenient in allowing the skimmer to back away from large plastic bags and tree branches before attempting to spit out a debris clog. This makes clearing the debris clog, by brief reversals of impeller 76 rotation, much more effective. It also has the effect of initially using front impeller 76 as an inlet barrier, to prevent backwash of debris out of the filter when maneuvering backwards (to navigate away from obstacles). This cycle of operations allows much more active forwards and backwards maneuvers, without disgorging already collected debris, than is possible with skimmer A.

It is also useful to turn off rear impeller motor 384 briefly, during times when front impeller motor 282 is briefly reversed to clear a stubborn clog in the impeller. This limits the amount of debris disgorged out of the front of the skimmer.

This cyclic operation to clear a debris clog is initiated when input 374 indicates a stuck front impeller while input 266 indicates continued forwards or reversed motion. It typically begins by backing away from any obstacle by using output 272 to stop front impeller rotation while output 376 combined with output 380 cause rear impeller motor 384 to operate for several seconds in reverse.

The debris clearing cycle then continues by using output 376 to shut down rear motor 384 (and with it, skimmer propulsion) while output 272 and output 274 are combined to cause reverse operation of front impeller motor 282.

As soon as front impeller motion is detected for several seconds at input 374, it indicates the debris clog is cleared, and normal operations (forward, both impeller motors 282 and 384) may resume. Alternatively, a very brief backwards propulsion cycle by rear impeller motor 384 only may first be used to cause the skimmer to back away from the debris, and reduce the chance of a secondary clog with the same clump of debris.

Detailed Description

Skimmer C

Figure 36:
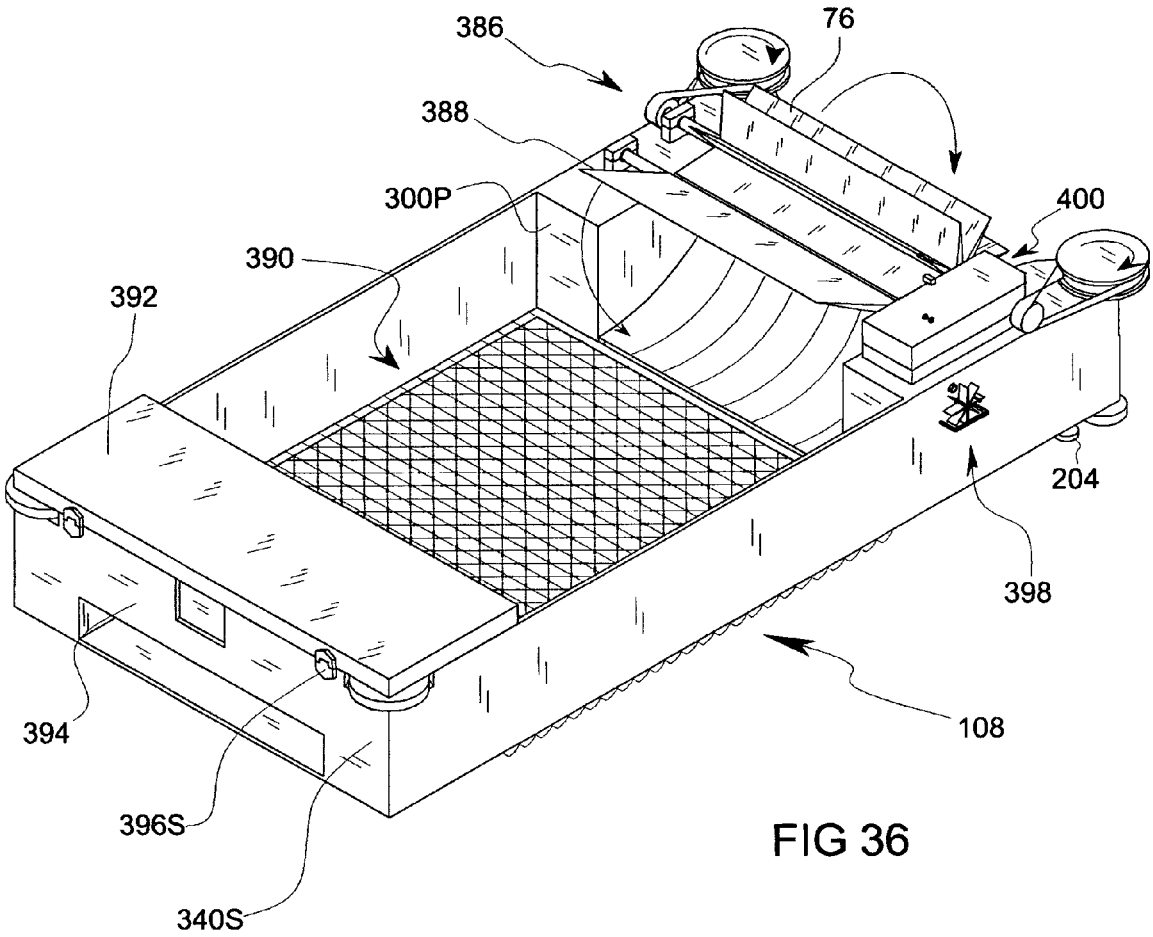

FIG. 36 displays an isometric view of skimmer C, seen from the starboard stern position, in its normal operating conditions.

Introduction to Skimmer C, FIG. 36

Impeller 76 and most connecting elements and navigation and maneuvering elements remain the same as in skimmer A. Even skimmer C drive train assembly 386 is essentially the same as the main drive train assembly 91 (FIG. 2), except for movable barrier 388 and its connecting elements, which are essentially just added to main drive train assembly 91. Similarly, speed measuring assembly 398 is merely a conventional functional equivalent to the sail switch type of system used in the first two embodiments A and B. It rotates rather than moving back and forth in measuring speed.

Dry gear-motor assembly 400 is essentially identical the dry gear-motor assembly 78 (FIG. 3), with the addition of components necessary to make movable barrier 388 operate and with minor changes to adapt to the alternate speed measuring assembly 398. A few more subtle changes show up in the circuit diagram, FIG. 48.

Filter assembly 390 is built almost identical to filter assembly 333 (FIG. 31), and rests directly atop a diverter vane assembly 108, at the bottom of the skimmer, that is identical to diverter vane assembly 108 in skimmer A.

A single solar cell array 392 serves as the lid to chemical dispenser 394 and is a functional equivalent (electrically) to those in earlier embodiments. It differs mainly in serving as the hinged lid of an integral chemical dispenser 394. Note the hinges, such as hinge 396S, that secure it to chemical dispenser 394.

Floatation chambers, such as floatation chamber 304S at the stern and 300P at the bow place all of the skimmer's floatation near the bow and stern, with virtually no floatation amidships. This serves an important function in maintaining the trim of impeller 76, in spite of variable pool chemical weight in chemical chamber 394.

The appearance of Intrusion Alarm Sensor 204, signals the reintroduction of alarm systems, as in Skimmer A.

In fact, skimmer C includes every major physical element of both skimmer A and B, excepting the floatation systems distinctive to skimmer A and the rear drive train assembly and associated parts distinctive to skimmer B.

Figure 37:
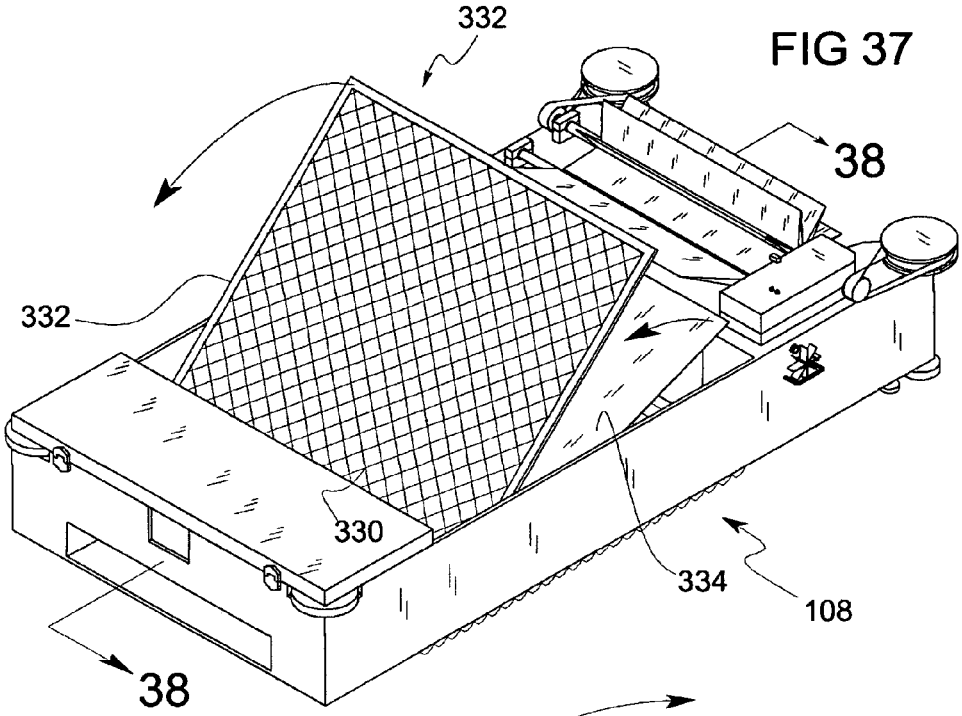
Figure 38:
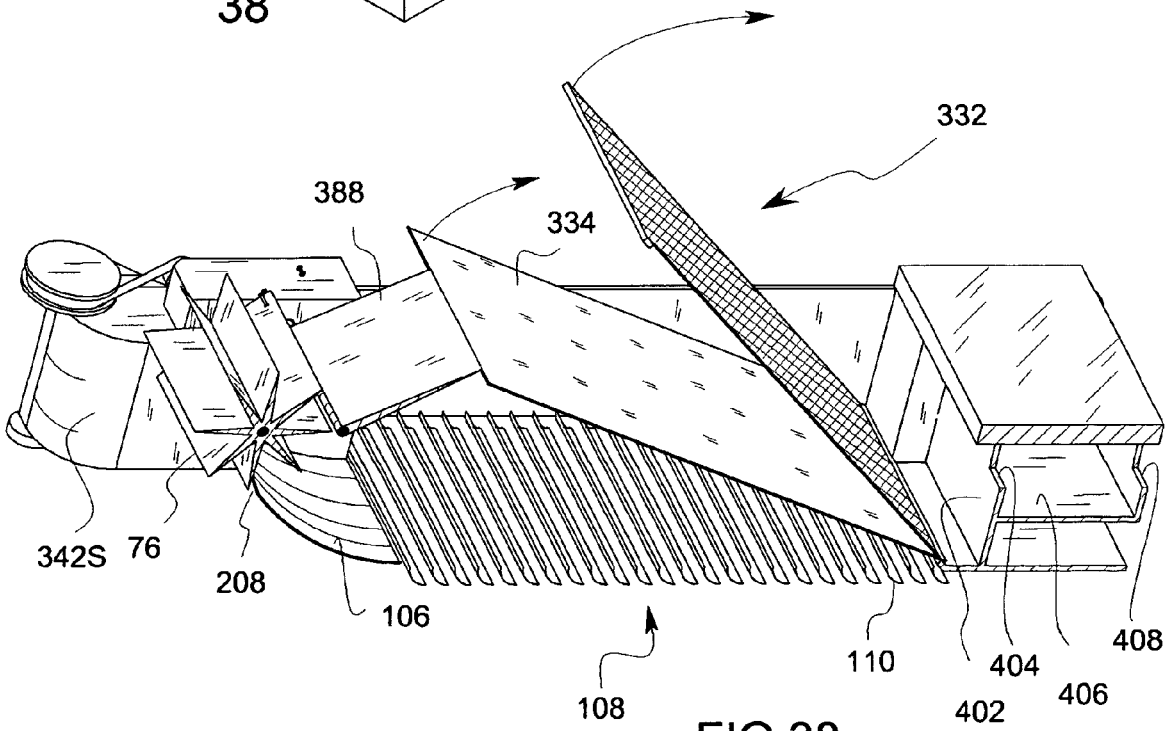

FIG. 37 & FIG. 38 Details

FIG. 37 is an isometric view of skimmer C showing the slicing plane for isometric section FIG. 38.

FIG. 37 also displays top grid assembly 332, including top grid 330 and top grid frame 332 in an angled upward position. It also shows disposable fine filter media 334 angled upward, in a position suitable for changing the disposable filter media 334. These elements are seen to be identical with the corresponding elements in skimmer B (FIGS. 31 & 32). Unlike skimmer B, the present embodiment has disposable fine filter media 334 resting directly atop diverter vane assembly 108, which in turn forms the floor or bottom of the skimmer.

FIG. 38 shows an isometric longitudinal section of skimmer C, revealing the internal structure more clearly. Tapered inlet 342S, where the water inlet narrows approaching impeller 76, is identical to that in skimmer B. Impeller 76 can be seen to be spaced a short distance above inlet dam 106, having a narrow inlet gap 208.

It is particularly useful in skimmer C to fabricate inlet dam 106 of a flexible springy material secured only along its bottom edge. These structures are more clearly displayed in section on the left side of FIG. 7.

Figure 43:
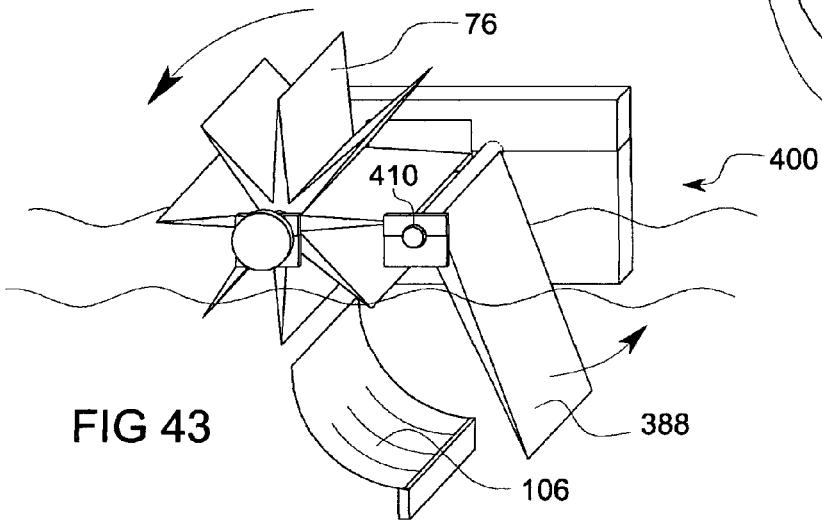
Figure 44:
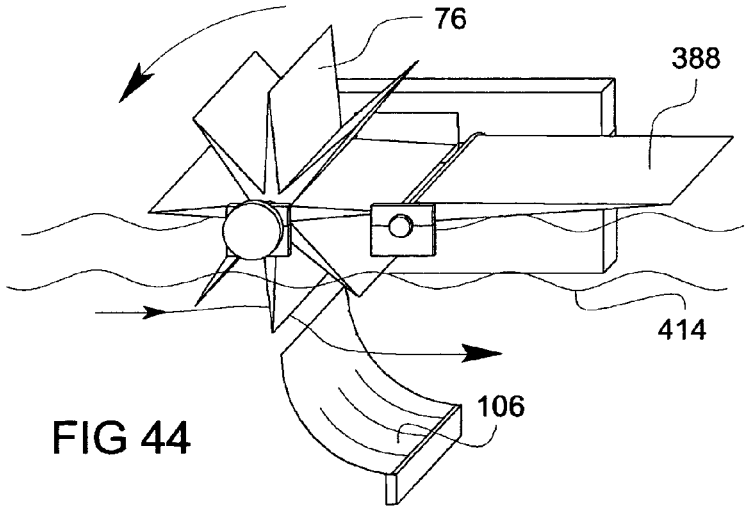

Movable barrier 388, a new structure in this embodiment, is shown in its up position, and will pivot downward to touch inlet dam 106, as more clearly shown in FIGS. 42–44. If inlet dam 106, above its bottom lip, is able to flexibly yield to pressure, then contact of movable barrier 388 will cause it to yield slightly.

Disposable fine filter media 334 can be seen to rest directly atop diverter vane assembly 108. These diverter vanes, such as diverter vane 110, form a structural equivalent to the bottom grid 338 (FIG. 31) that is employed in skimmer B to support filter media 334. They form a support grid for filter media 334, as well as serving as an exiting water thrust diversion means. And diverter vane assembly 108 itself serves a thrust diversion purpose that is the functional equivalent to the entire closed sump chamber 314 (FIG. 31) that is used to divert thrust in a rearward direction subsequent to filtration in skimmer B.

Integral Chemical Chamber 394

FIG. 38:

Chemical chamber 394, not separately labeled here, but illustrated in FIG. 36, shows several new components here. Front wall 402, of the chemical chamber also acts as a rear wall for the enclosure that surrounds filter assembly 332. Chemical chamber entrance 404 is seen to be near the top of the enclosure. It is illustrated as a simple hole, but, as in conventional chlorinators, it is useful to insert screens to block debris or adjustable opening means to throttle and control water flow through the device.

Chemical chamber exit 408 is also a hole placed near the top of chemical chamber 394. Chemicals placed in the chemical chamber interior 406 will reside under water, significantly below this opening. In this position, they will form concentrated solutions held inside by gravity until the skimmer begins operation, and water is pumped through the system.

Solar Cell Array 392, as a Hinged Lid

Figure 39:
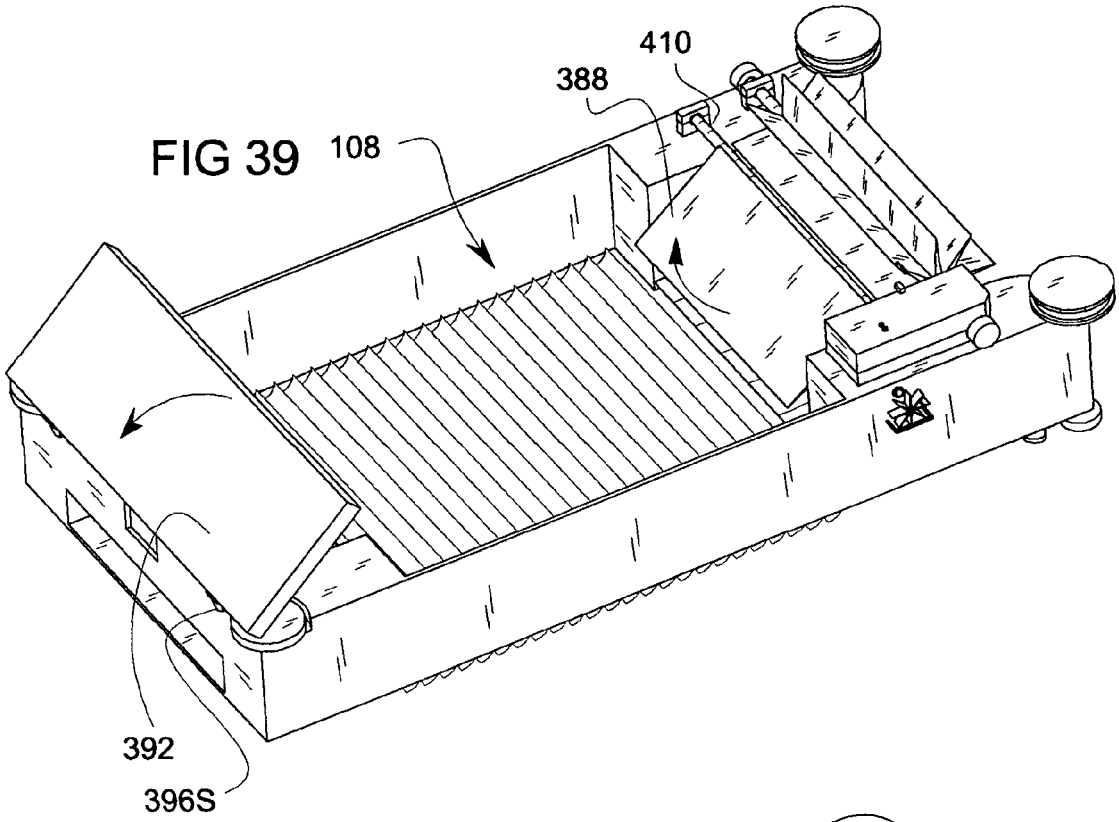
Figure 40:
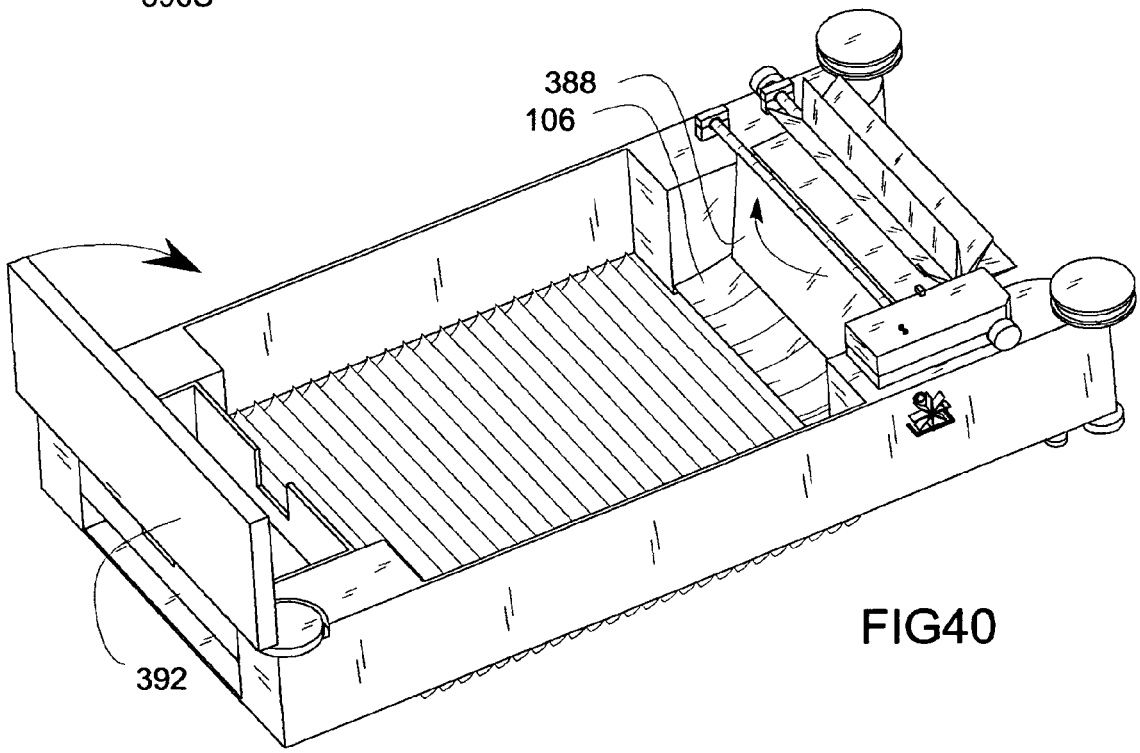

FIG. 39 and FIG. 40 are both isometric views of skimmer C with filtration systems removed to reveal deflector vane assembly 108 below.

FIG. 39:

Solar cell array 392 is shown pivoting upward and rearward as a lid, pivoting on hinges such as hinge 396S.

Movable barrier 388 is shown pivoting upwards and backwards, pivoting upon movable barrier shaft 410.

FIG. 40:

Solar cell array 392 is shown pivoted fully upward, revealing structures below. Movable barrier 388 is shown fully down, sealed against inlet dam 106 in a position to block essentially all flow of water through the skimmer.

Figure 41:
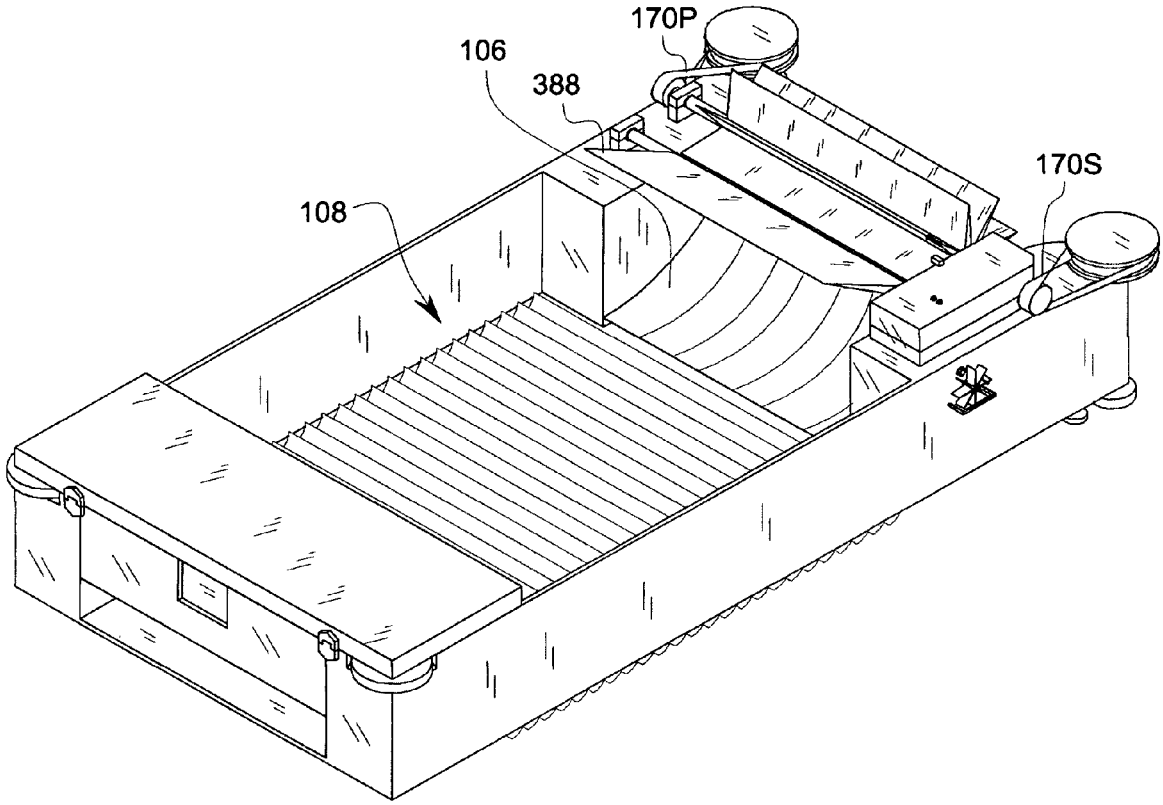

FIG. 41 is an isometric view of skimmer C with all filtration systems removed, but in normal operating positions.

Deflector vane assembly 108 can be seen to extend forwards to meet inlet dam 106, which curves upwards. Movable barrier 388 can be seen in its fully raised position.

Note in this view the clearly defined difference in the twisting manner in which belts 170S and 170P are installed, with the later having a clear half twist more than the former.

FIG. 42–FIG. 44 all show isometric views, at a low angle of only the working parts immediately surrounding impeller 76. They further show streamlines, positions of the movable barrier, and impeller rotation direction in different modes of operation.

FIG. 42–44:

Impeller 76 is shown rotating backwards in FIG. 42, and forwards in FIG. 43 and FIG. 44. Movable barrier 388 can be seen rotating from fully closed having its bottom lower lip 412 in contact with curved inlet barrier below in FIG. 42.

FIG. 43:

Movable barrier 388 can be seen rotating about movable barrier shaft 410, with movable barrier 388 partially raised. Also shown is dry gear-motor assembly, including movable barrier drive 400, which acts as a drive unit for turning both impeller 76 and movable barrier shaft 410.

FIG. 44:

Movable barrier 388 can be seen fully raised above water level 414. Impeller 76 can be seen turning, and propelling a stream of water, indicated by arrows, over and past inlet dam 106.

Figure 45:
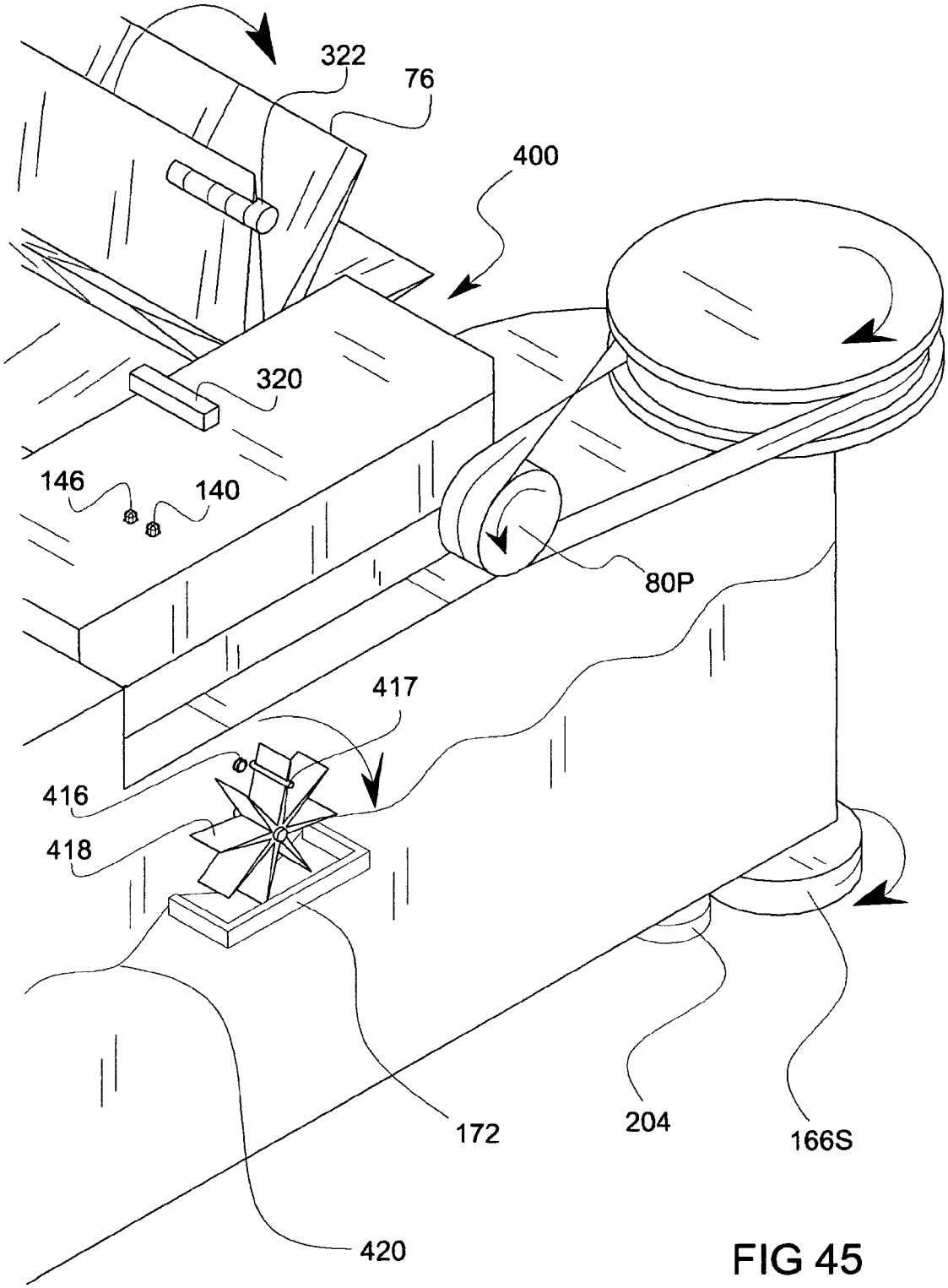

FIG. 45 is a perspective view of only the extreme starboard bow of skimmer C, including details immediately surrounding dry gear-motor assembly 400. Impeller 76, at the top of the view, represents the same impeller as in all other embodiments. Located on one of its vanes, rotating with impeller 76, is impeller magnet 322, located at a place on impeller 76 that will pass by magnetic sensor 320, identical to those elements in skimmer B. Note that the modified dry gear-motor assembly, including movable barrier drive 400, lacks all of the hardware typical of the sail switches of the previous two embodiments. This makes LED warning strobe 146 and photo-sensor 140 easier to identify than on earlier versions.

The sail switches used as motion sensors in skimmers A and B are replaced by speed impeller 418, magnet 417, and magnetic sensor 416. These elements combine to form a conventional speed-sensing device equivalent to the magnetic sail switch of the earlier embodiments. Motion sensor guard 172, remains the same, protecting the alternate motion detection system.

Waterline 420 illustrates the relationship of the normal waterline level to speed measuring impeller 418. Bumper wheel drive pulley 80P and bottom bumper wheel 166S are emphasized for clarity, with their orientation and direction of rotation clearer in this magnified view than elsewhere in the illustrations. Intrusion sensor 204 is also pointed out again, to emphasize the re-introduction of alarm systems into this embodiment.

Figure 46:
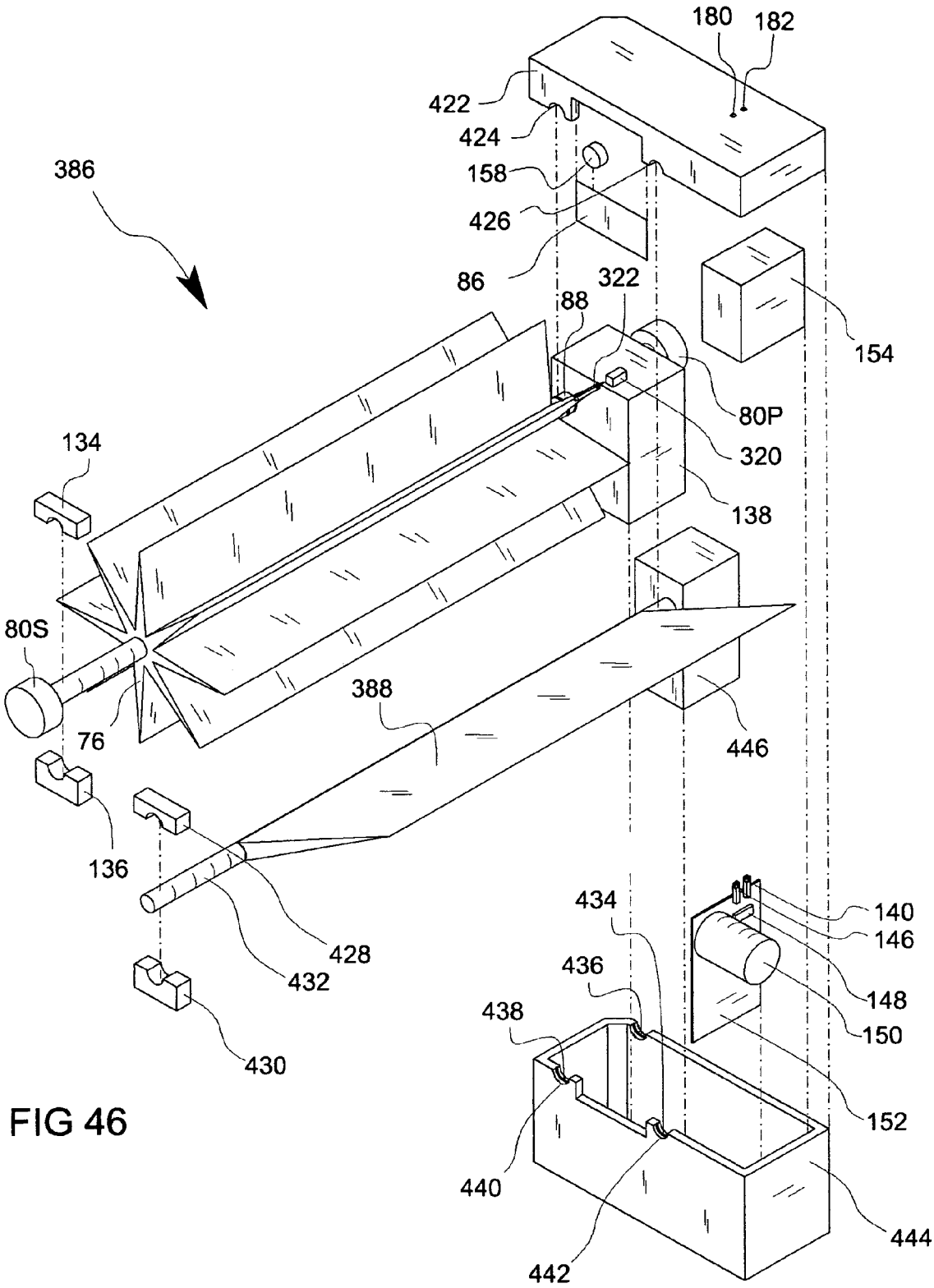

FIG. 46: Exploded C Drive Train Assembly 386

FIG. 46 is an exploded view of C drive train assembly 386. This bears extreme resemblance to the main drive train assembly 91 shown in exploded view in FIG. 3. Most of the parts remain the same as in earlier embodiments:

Remaining the same in the top half:

Impeller 76, attached impeller shaft 88, bushings 134 and 76, pulleys 80S and 80P, gear-motor 138, barometric membrane 86, alarm sounding means 158, and chemical absorbent 154.

Also the same, in the bottom half

Printed circuit board 152 (though some circuits are added, as detailed in FIG. 48), motor start capacitor 150, microprocessor 148, LED strobe 146, photo-sensor 140 (and their corresponding lid holes 180 and 182 respectively).

Similar, but changed slightly:

Lid dry gear-motor box 422 and corresponding dry gear-motor box 444 differ from earlier lid and box by having extra shaft holes 426 and 442 respectively, along with extra shaft seals such as shaft seal 434. But impeller shaft hole 440, and movable barrier shaft hole 424, and shaft seals 436 and 438 are really just the same holes in different locations from the earlier embodiments.

New components:

Magnetic sensor 320 and impeller magnet 322, already discussed, were seen more clearly in context in FIG. 45.

All of the remaining new components are closely associated with movable barrier 388.

FIG. 46: Movable Barrier 388

Movable barrier 388 is represented as a tapered dam fastened to, and rotating about movable barrier shaft 432. Shaft 432 must be corrosion resistant, and is driven through a partial arc by gear-motor 446. Shaft 432 passes through box 444 at hole 442 and through lid 422 through hole 426, with all such shaft holes employing conventional shaft seals, such as shaft seal 434.

Gear-motor 446 is a conventional gear-motor very similar to gear-motor 138, but perhaps with a more extreme gear ratio. It constitutes the major physical portion of the "barrier moving means", with the remainder being made up of the connecting components: shaft 432, bushing 428, and bushing 430. Both gear-motors 446 and 138 are housed inside of dry gear-motor box 444. Gear-motor 446 conventionally includes a bearing capable of supporting one end of movable barrier shaft 432. The opposite end of shaft 432 is supported by a bearing composed of top bushing 428 and bottom bushing 430, which in turn rests on the body of the skimmer (not shown here).

Figure 47:
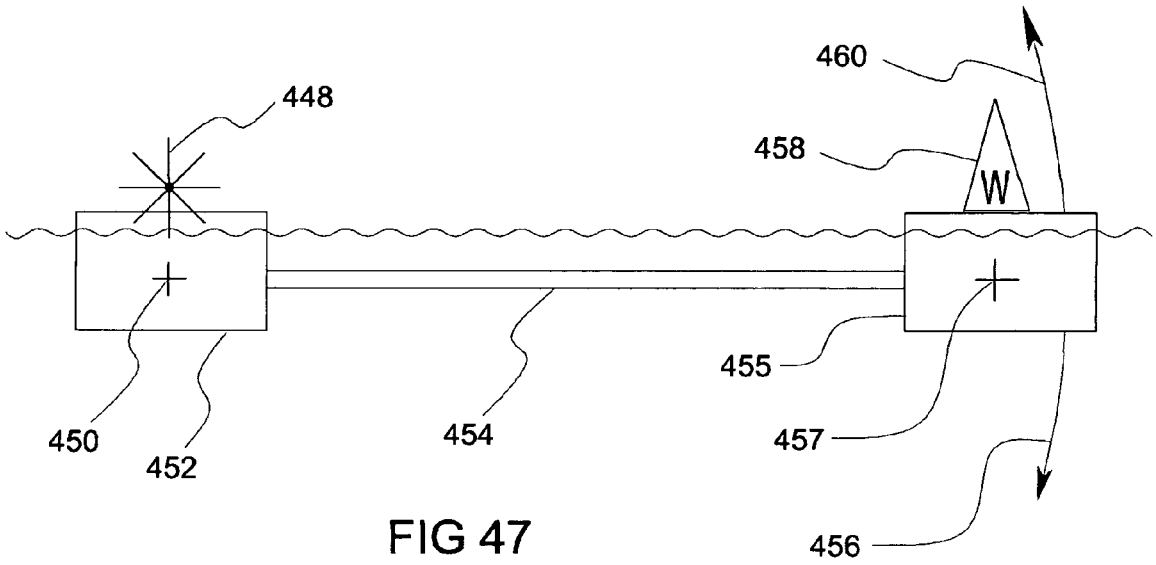

FIG. 47: Floatation Schematic

FIG. 47 represents a longitudinal representative schematic of floatation chambers, weight distribution, and a schematic front impeller 448. This schematic represents the distribution of floatation predominantly at the bow and stern of skimmer C, and the distribution of weight and floatation relative to a schematic front impeller 448, which corresponds to impeller 76 (FIG. 38).

FIG. 48 will be more thoroughly discussed in the operations section. But here we will describe what the symbols represent.

Impeller 448 represents an impeller, such as impeller 76 (FIG. 38). It is located approximately above a center point of floatation 450 that is the center of floatation of all bow floatation chambers, represented by schematic bow floatation chamber 452.

Schematic central section of skimmer 454 represents the central portions of the skimmer having relatively little floatation or weight so that their net floatation is essentially neutral.

Schematic bow floatation chamber 457 has a center of floatation located approximately below a schematic representation of variable weight 458. Schematic weight 458 is representative of all variable weight of swimming pool chemicals added to the stern chemical chamber 394 (FIG. 36). The arrow 460, representing deflection of stern upward, and arrow 456, representing deflection of stern downward, represent deflection upwards or downwards respectively of the stern of the schematic skimmer in response to variable weight 458.

Circuit Diagram

Skimmer C

FIG. 48 is a block schematic diagram of electrical and electronic circuits found in skimmer C. It borrows most circuit elements from skimmer A, a few from skimmer B, and introduces several new elements.

New elements in skimmer C: FIG. 48:

Microprocessor output 462 provides a digital signal to circuit 464, which turns on power to barrier motor 470. Circuit 464 is very analogous to circuit 278 that turns on impeller motor 282. Movable barrier motor 470 represents the actual electric motor inside of movable barrier gear-motor 446 (FIG. 46).

Microprocessor output 466 provides a digital signal to circuit 468, which reverses the direction of rotation of movable barrier motor 470, most simply by just reversing polarity. Circuit 468 is directly analogous to circuit 280, which reverses rotation of impeller motor 282. Note that the barrier motor, unlike the impeller motors, are designed to operate briefly, to open or close a barrier, and then shut off.

These new elements, together, constitute the electronic and electric components of the "barrier moving means".

Deleted elements in skimmer C:

Skimmer B has a complete rear impeller drive system that is not included in this skimmer C. But a careful look at the drive circuitry indicates that the precise same circuitry that could drive and reverse the rear impeller motor 384 (FIG. 35) could also be utilized to drive and reverse the movable barrier motor 470. The circuits are precisely analogous, even if given different reference numerals and names. Even the motors 384 and 470 could theoretically be the same: it is the gear properties of the gear-motors that will differ, and the length of time that they are operated.

Operation, Skimmer C

Overview

FIG. 36. Operational similarities to Skimmer A:

During normal forwards operation, and during common collisions with sidewalls (such as depicted in FIGS. 21–23) Skimmer C operates in a manner essentially identical to Skimmer A, including the manner in which powered bumper wheels deflect skimmer A from swimming pool sidewalls depicted in FIG. 21–23.

In FIG. 36, water flow is propelled by impeller 76 into filter assembly 390, where debris is retained, while water passes through downward, and is deflected rearward by diverter assembly 108.

FIG. 36: Operational differences from skimmer A

Movable barrier 388 can be seen to be able to swing downward to essentially block all water flow through filter assembly 390. Movable barrier 388 is closed during periods of shut down and during reversals of impeller 76 to prevent backwash of debris already retained in filter assembly 390 back out through impeller 76. Aside from this, drive train assembly 386 and dry gear-motor assembly 400 operate in manners essentially identical to equivalent parts in skimmer A.

Speed measuring assembly 398 appears visually different from the sail switch type of device employed earlier (FIG. 29B). It is just another equivalent conventional speed measuring device that, in operation, provides essentially identical information to the skimmer, concerning motion relative to surrounding water. Its primary difference lies in providing accurate continuous speed data, rather than an on/off digital decision related to a predetermined minimum velocity.

Swimming pool chemical dispenser 394, while integrated with the structure of the skimmer, dispenses chemicals in precisely the same manner as chemical dispenser assembly 72 (FIG. 16). In operation it differs only in the manner in which the weight of chemicals inside are balanced by floatation chambers to prevent them affecting the trim of impeller 76 relative to its surrounding water level (more thoroughly covered in discussion of FIG. 47). In essences, all of the skimmer's floatation chambers, such as floatation chambers 300P and 340S, are moved either to the bow, very near impeller 76, or to the stern, very near chemical dispenser 394. This causes the floatation trim of the bow of the skimmer to operate essentially independent of that at the stern.

While solar cell array 392 is shown fastened atop chemical chamber 394, by hinges, such as hinge 396S, allowing it to serve as a pivoting lid, this operation does not affect the use of chemical chamber 394 or the electrical operation of solar cell array 392.

Operational Details—Filtration FIG. 37

FIG. 37 shows that a disposable fine filter 334 and top grid assembly 332 can be removed for cleaning and replacement in precisely the same manner displayed in skimmer B (FIGS. 30–31). The necessity of removing the filter 334 from the topside, and the convenience of maintaining the original rectangular shape of paper towels, or other rectangular fine filtration media, dictates much of the shape of skimmer C. Namely, that a rectangular filtration media needs to be placed in the center of the skimmer, and be removable upward from that position.

FIG. 38 reveals that disposable fine filter 334 is laid directly atop diverter assembly 108, which then serves a purpose similar to bottom grid 338 (FIG. 31) in supporting and holding in place the fine filter 334. Top grid assembly 332 may also be used without the fine filter 334, in which case it serves as a course filter, retaining only large debris. This may be suitable for skimming a more leaf clogged swimming pool.

Tapered inlet 342S serves to divert water and debris towards impeller 76. Water flow normally sweeps through inlet gap 208, over inlet dam 106, through top grid assembly 332, fine filter 334, downwards, and through deflector vane assembly 108, where it is deflected backwards for thrust. The shape and spacing of individual deflector vanes, such as vane 110, must be suitable both for turning the downward flowing water rearward, and for supporting fine filter 334 directly. The support function requires reasonably close spacing of vanes in deflector vane assembly 108.

Water that does not travel downward finds a path through the chemical dispenser 394 (not separately labeled here, but shown in FIG. 36), where it passes through the front wall 402 of the chemical chamber by way of entrance 404. As a practical operational matter, entrance 404 may be equipped with a screen to block debris, or an opening that may be throttled, such as is common in conventional swimming pool chemical dispensers. Entering water swirls around any chemicals sitting at the bottom of the chemical dispenser interior 406, and then is forced to exit through the relatively high exit 408.

As in the earlier chemical dispenser assembly 72 (FIG. 19), the weight of concentrated chemical solution forming in the chemical dispenser interior 406 prevents diffusion of chemicals outward through the high mounted exit 408 except when there is an actively pumped flow of water through the skimmer.

The last feature obvious in FIG. 38 is movable barrier 388, shown hanging angled upwards above inlet dam 108. Its purpose is to block all water flow backwards, while still allowing impeller 76 to rotate freely in either the forwards or backwards direction. This is obviously useful in preventing backwash of debris through inlet gap 208 while shut down, and during reversals of impeller 76 used to unclog debris from inlet gap 208, or reversals of impeller 76 used to navigate backwards from obstacles.

FIG. 39 and FIG. 40 simply display the action of solar cell array 392 swinging open as a lid pivoting on hinges, such as hinge 396S. These figures also display the opening and closing of movable barrier 388, swinging upon movable barrier shaft 410, and closing to meet the curved surface of inlet dam 106, thereby shutting off water flow through the skimmer. And FIG. 41 completes the series of figures, displaying the lid (solar cell array 392, not separately labeled here, but labeled in FIG. 40) fully closed and movable barrier 388 fully open.

Operation of Movable Barrier 388 FIGS. 42–44

FIG. 42–FIG. 44 demonstrate the gradual opening of movable barrier 388, and its affect on water flow patterns in the proximity of the skimmer.

FIG. 42 displays movable barrier 388 fully closed with its lower lip 412 in firm contact with the curved surface of inlet dam 106. Impeller 76 is shown rotating in reversed (from normal) direction. This mode of operation is used when reversing to back away from an obstruction (FIGS. 24–26), or when reversing to clear a debris clogged impeller 76. Both skimmer B and skimmer C have an advantage over skimmer A in this operation, by each possessing means to block the backwash of debris when in reverse.

Movable barrier 388 allows reversal operations to be extended in time, frequent, and to allow full speed reverse rotation of impeller 76, since backwashing is fully blocked by the lowered position of movable barrier 388. In complex pools with many obstacles, the ability to reverse frequently is very useful. It is also helpful to be able to operate in reverse for more than a few seconds without spitting out already captured debris.

Note the reverse water flow path indicated by the arrows at the bottom of FIG. 42. The location and curved shape of inlet dam 106 helps promote a more useful propulsive force in the exiting water, by more smoothly sucking water from underneath the skimmer and allowing impeller 76 to propel it outward from the bow.

Clearing Debris Clogs—Special features: FIG. 42

Reverse operation, as indicated in FIG. 42, is also used to clear impeller clogs, where large debris may jam between impeller 76 and the top lip of inlet dam 106. Both of the first embodiments, skimmer A and skimmer B, must limit reversing the front impeller 76 to very brief bursts, to prevent active debris backwash out of the inlet to the skimmer. Movable barrier 388 removes this concern by creating a positive seal against backwash of debris.

There is a special class of cases, however, when very large debris, such as plastic bags, may actually become trapped between movable barrier 388 and inlet dam 106. This unusual case may justify an additional clearing cycle. If, after repeated attempts, a stuck impeller 76 does not clear itself, it is possible to program a special cycle where movable barrier 388 is briefly opened for one last attempt, before shutting down the unit and sounding an alarm indicating a hopelessly stuck position.

In operation, it is important to note here a distinction between this skimmer (all embodiments) and other prior skimmers. Because of the ability to use impeller reversals to clear clogged impellers, it is actually wise to create closer clearance between inlet dam 106 and impeller 76 than would be practical in other prior pool skimmer designs. It is wise to force any clogs that might occur to occur at this narrow point, where they can be automatically cleared, rather than at any point upstream or down stream from impeller 76. This is necessary for truly autonomous operation, since it is not realistic to expect human tenders to clear away debris clogs many times a day in leaf clogged swimming pools.

FIG. 42 also reveals a minor but significant design variation that might significantly improve the clearing of debris clogs. If inlet dam 106 is constructed of a springy material, and is secured firmly only at its lower edge, then contact of lower lip 412, of movable barrier 388, exerting pressure on the central regions of inlet dam 106, will cause a deflection of inlet dam 106. This useful and convenient deflection of inlet dam 106 serves to widen the gap between impeller 76 and the top surface of inlet dam 106, thereby freeing up any debris securely caught in this gap.

This operation causing deflection of a flexible inlet dam 106 is feasible largely because the gear ratio of gear motor 446 (FIG. 46) driving movable barrier 388 is typically at least an order of magnitude higher than that driving impeller 76.

FIG. 43 displays forwards operation of impeller 76 beginning, and movable barrier 388 pivoting upwards about movable barrier shaft 410, swinging away from contact with inlet dam 106. This swinging arc movement of movable barrier 388, must therefore be physically compatible with the curvature of inlet dam 106, so that such opening and closing is possible without jamming occurring, or the arcs not intersecting at an appropriate point. Note that the rotation of movable barrier shaft 410 is powered by the same dry gear-motor assembly 400 (but, obviously a separate gear-motor inside) as is the rotation of impeller 76.

Normal Operations: FIG. 44:

FIG. 44 displays normal operations, showing movable barrier 388 rotated upward, clear of water level 414, and not impeding water flow in any way. It should be noted that, due to the low level of electrical power available on a solar powered device, the motor 470 (FIG. 48) driving the operation of movable barrier 388 operates only for seconds at a time, and is positively shut off in both the fully open (FIG. 44) and the fully closed (FIG. 42) positions.

FIG. 44:

Also, note that the arrows showing normal water flow through impeller 76, and over inlet dam 106, neglect to display a smaller component, not displayed, that will always move downward, outside of inlet dam 106, and underneath the skimmer, propelling it forwards. This small bypass current that bypasses the filtration system altogether, plays a greater role in skimmer propulsion than intuition would indicate. In any unitary impeller skimmer (such as skimmer A and skimmer C) propulsion can be improved at the expense of skimming action by moving the top lip of inlet dam 106 rearward from impeller 76. Propulsion can also be improved by modifying the streamline properties of the bottom surface of inlet dam 106 such that water is encouraged to move rearward (rather than downward) at an earlier point along its curved surface.

Operation of Sensors: FIG. 45

FIG. 45 more clearly reveals the various external sensors on skimmer C.

Minimum light photo-sensor 140 (and nearby LED 146) operate the same as in skimmer A, as does intrusion alarm sensor 204. It should be noted that both of the alarm systems included in skimmer A are repeated in skimmer C, and operate the same.

Impeller magnet 322 and magnetic sensor 320 operate in the same manner that they did in skimmer B. Because reversals of impeller 76 do not spit out already filtered debris, sensing separately the rotation of impeller 76 is not as critical in this embodiment. It is not critically necessary to know whether a lack of relative motion of the skimmer is caused by an impeller jam or a stuck position of the skimmer itself. This is because the solution to both problems may be essentially the same, closing barrier 388 (FIG. 42) and reversing impeller 76 repeatedly till relative movement of the skimmer in the water is sensed.

Impeller magnet 322 and magnetic sensor 320 are included, in spite of this, because more precision information will allow a response more specific to the problem, and because it allows software refinements permitting behavior that is more sophisticated in dealing with specific problems. For instance, debris clogs respond well to fast and hard reversals interspersed with slow and gentle forward cycles. A skimmer stuck at an obstacle does better with more prolonged reversals.

Motion sensor guard 172 is common, as a shield to motion sensors, in all embodiments. But motion sensing impeller 418 is unique to skimmer C. This, and its companion parts, impeller magnet 417 and magnetic sensor 416 serve to detect speed and comprise a conventional speed sensing assembly common for sensing or measuring speed. It is displayed as a variation because it is not precisely equivalent functionally to a sail switch.

The motion sensing impeller 418 has at least the theoretical capability of indicating to a microprocessor the actual skimmer's relative velocity through the water. Nearby water, indicated by waterline 420, normally causes rotation of impeller 418 in the direction indicated by the nearby curved arrow. Impeller magnet 417, rotating with impeller 418, produces a signal in magnetic sensor 416. This signal, in turn may be integrated over time by a microprocessor 148 (FIG. 48) to give actual indication of true relative velocity, rather than merely an indicator of a certain minimum velocity.

An indicator of true relative velocity, rather than the simple knowledge that the skimmer has attained a minimum speed, is a richer source of data, more useful to a microprocessor in making decisions. For instance: very low speeds over long periods of operation may warn of something wrong worthy of raising an alarm, or shutting down the unit, in spite of the fact that it is still making some minimum forward headway.

Doppler sonar, ram pressure, and other types of conventional fluid velocity measuring devices are close conventional equivalents to this device and could be used in its place, with proper digital interface.

FIG. 46: Operation of Main Drive Assembly 386

FIG. 46 shows, in exploded view all the numerous components of main drive assembly 386. In operation, this assembly 386 operates precisely like that of main drive train assembly 91, shown in exploded view in FIG. 3, except for those components directly attached to movable barrier 388, just below the center of the page. (With the exception of impeller magnet 322 and magnetic sensor 320, which operate precisely like those in Skimmer B, FIG. 29A.)

Gear-motor 446 operates in short forwards and backwards cycles of operation, rotating movable barrier shaft 432 not much over 90 degrees at each opening or closing operation of movable barrier 388. This requires a gear-motor 446 with a very high gear ratio, perhaps equipped with physical stops (not shown) at the end of its operating travel. The precise operating scheme proposed for this gear-motor 446 includes cycles timed by the microprocessor 148 (FIG. 48), and stopped by impact on the downward stroke of movable barrier 388 with inlet dam 106 (FIG. 42).

While limit switches could theoretically be employed at the limits of rotational travel of gear-motor 446, it is probably not necessary to employ them on the skimmer as described. This is due to the relatively low power levels involved, and the active timed shutoff by microprocessor 148 (FIG. 48) at the two ends of its rotational travel.

Gear-motor 446 rotates movable barrier shaft 432, which passes through dry gear-motor box 444 and lid 422 through holes 442 and 426 respectively. The holes 442 and 426 are sealed actively about shaft 432 with the assistance of conventional shaft seals such as shaft seal 434.

Movable barrier 388 is rigidly secured to shaft 432, rotating with it. And the far end of shaft 432 is both secured to skimmer C and allowed to freely rotate by a bearing including top bushing 428 and bottom bushing 430.

Operation: Bow and Stern Floatation: FIG. 47

FIG. 47 presents a schematic representation showing the floatation trim operation of the fore and aft floatation chambers (such as 300P and 340S respectively, FIG. 36), relative to other components of skimmer C.

In operation, schematic impeller 448 corresponds with the real impeller 76 (FIG. 36). Impeller 448 is located approximately over a point 450, representing the center of floatation of all forwards floatation chambers, represented by schematic floatation chamber 452. Note that chamber 452 represents the summation effect of all flotation on the bow end of the skimmer, and that impeller 448 must be located approximately over the combined center of floatation 450.

Schematic central region 454 of the skimmer approximates the central region of skimmer C, which has minimal, or at least neutral floatation, and doesn't significantly affect the net floatation trim of the skimmer. It is represented by a simple bar connecting the bow and stern of the schematic skimmer.

Schematic stern floatation chamber 455 represents the sum of all floatation located near the stern of the vessel, having a center of floatation 457. Center of floatation 457 is in turn located approximately below a schematic variable weight 458. Variable weight 458 represents, schematically, any increase or decrease in stern loading due to variable amounts of heavy (solid) swimming pool chemicals added to chemical chamber 394 (FIG. 36).

The upward curved arrow 460 represents deflection of the stern upward upon decrease of weight 458 and downward curved arrow 456 represents the deflection of the stern downward upon an increase of weight 458.

In operation, this schematic represents the approximate fact that deflections of the stern caused by increases or decreases of chemical weights have a tendency of having a center of rotation at point 450, or the central point of bow floatation. Since this point is (ideally) located directly below impeller 448, any increases or decreases in chemical weights (represented by variable weight 458) have minimal effect upon the floatation trim, and hence depth of bite in the water, of impeller 448.

This schematic diagram reinforces the importance of the following in skimmer C.

1. Locating impeller 76 as closely as possible above the center of floatation of any bow floatation chambers.
2. Locating the center of any swimming pool chemical weight as closely as possible to the center of any stern floatation chambers.
3. Providing a large central region of the skimmer with essentially neutral floatation.

This neutral floatation scheme allows skimmer C to be used with extremely variable chemical loads without affecting impeller trim.

Operation Electrical Schematic Diagram FIG. 48

Skimmer C

In operation, most elements of the circuit of Skimmer C mirror elements of skimmer A (as shown in FIG. 20).

Operation of New Electrical Schematic Elements

Any time the skimmer operates in the forwards direction the barrier 388 (FIG. 38) must open. Microprocessor output 462 signals circuit 464 to turn on for a predetermined time deemed long enough for barrier motor 470 to fully open movable barrier 388 (FIG. 36). It does so any time microprocessor output 272 transitions motor impeller motor 282 to the ON condition AND any time microprocessor output 274 is not active, both simultaneously, thereby reversing the direction of rotation of impeller motor 282. Put simply, they open movable barrier 388 only when motor 282 initially turns on in the forward direction.

Any time the skimmer operates in the backwards direction the barrier 388 (FIG. 38) must close. Microprocessor output 462 signals circuit 464 to turn on for a predetermined time long enough to fully close movable barrier 388 (FIG. 36), while simultaneously microprocessor output 466 is signaling circuit 468 to reverse the direction of barrier motor 470. This has the effect of closing an already opened movable barrier 388 (FIG. 36). Microprocessor outputs 462 and 466 cooperate to reverse motor 470 any time microprocessor output 272 is active AND microprocessor output 274 is simultaneously active. In simpler terms they close barrier 388 any time the skimmer turns on in the backwards direction.

In precisely the same manner, microprocessor output 463 and microprocessor output 466 cooperate to signal the closing of barrier 388 any time microprocessor output 272 is not active. In other words, they close barrier 388 any time the skimmer turns off. This helps prevent waves causing loss (by backwash) of debris already gathered by the skimmer.

Circuit 464, serves to turn on movable barrier motor 470 in either the forwards or reverse direction. And Circuit 468, when active, simply reverses the direction of rotation of motor 470.

Movable barrier motor 470 itself, in operation, never runs more than the few seconds it takes to open or close barrier 388 (FIG. 36), then must be promptly shut down in this fully open or fully closed state. This saves energy over any circuit that needs to be continually powered. This is the argument against using something like a simple solenoid to operate the movable barrier 388 (FIG. 46), rather than a gear-motor. It is conceivable, however, that two solenoids, operating only momentarily in opposing directions, could serve as an equivalent replacement for movable barrier motor 470. Likewise, solenoid operated escapement mechanisms could similarly replace a gear motor.

CONCLUSIONS, RAMIFICATIONS, AND SCOPE

Accordingly, the reader will see that the solar powered pool skimmer of this invention can be used to continuously, or intermittently, clean the entire surface of swimming pools of floating debris, with minimal human intervention, using free solar power. In addition, it both navigates to every corner of the swimming pool and autonomously extracts itself from difficult stuck positions. Furthermore, the skimmer has the additional following advantages:

- it warns humans of intruder entry, full filter, stuck skimmer, or jammed impeller;
- it employs several mechanisms to prevent loss of already gathered debris
- it allows use of disposable paper towels or disposable shop rags as filter media
- it provides a chlorinator that only distributes chemicals during unit operation
- it controls impeller depth in water with respect to added pool chemical weight
- it intelligently navigates out of shadows
- it intelligently charges storage batteries at opportune times
- it provides long term corrosion protection for motors and electronics and gears
- it selectively skims wind concentrated debris at pool edges Although the description above contains many specifications, these should not be construed as limiting the scope of the invention but as merely providing illustrations of some of the presently preferred embodiments of this invention. For example: simply omitting the rear impeller and drive mechanism of skimmer B, incorporating a movable barrier into either of the first two embodiments, or moving the alarm and warning systems of skimmer A into skimmer B. Further examples include driving powered bumper wheels with gears rather than belts, or driving multiple impellers off of a single shaft.

Thus, the scope of the invention should be determined by the appended claims and their legal equivalents, rather than the examples given.

We claim:

1. A self propelled solar swimming pool skimmer having a body configured as a boat, the body having outermost extremities at the port bow and starboard bow positions respectively, said body containing an internal water channel having a bow entrance at the waterline and an exit, the improvement comprising:

a) an electrical power means including a solar cell array
b) a bow mounted impeller whereby water and floating debris shall be propelled in a rearwards direction through said internal water channel upon rotation of said bow mounted impeller in its normal direction of rotation
c) a porous filter medium oriented across said internal water channel suitable for capturing floating debris
d) an electrical motor rotationally coupled to said bow mounted impeller by a conventional rotary energy transmission means including a shaft and electrically powered by said electrical power means whereby said bow mounted impeller may be caused to rotate
e) powered bumper wheels, having vertical shafts, said powered bumper wheels having their outer perimeters protrude both forwards and laterally beyond the port bow and starboard bow extremities of said body, respectively
f) said powered bumper wheels each being rotationally connected to an electrical motor by conventional rotary energy transmission means
g) the electrical motor powering each of said powered bumper wheels being electrically connected to said electrical power means
h) with rotational direction of said rotary energy transmission means being chosen such that the gunwale perimeter of each powered bumper wheel shall normally rotate in a direction parallel to the normal direction of travel of the skimmer, whereby contact of said powered bumper wheels with obstacles shall serve to deflect said skimmer away from said obstacles by means of reactive forces of the rotating powered bumper wheels with said obstacles.

2. The skimmer of claim 1 wherein:

a) said bow mounted impeller is configured as a paddle wheel having a horizontal shaft extending across said internal water channel from starboard to port
b) said powered bumper wheels at port bow and starboard bow extremities respectively shall be rotationally connected, by conventional rotary power transmission means, to the port and starboard ends, respectively, of the rotating bow mounted impeller with rotational direction of said conventional rotary power transmission means chosen such that each of said powered bumper wheels shall be rotationally linked in an opposite direction from one another and furthermore to the same electrical motor which is rotationally connected to said bow mounted impeller.

3. The skimmer of claim 1 further including:

a) a swimming pool chemical dispenser located at a point longitudinally distant from said bow mounted impeller
b) the dispenser including a dispenser body, said dispenser body including: floatation means, and an interior cavity configured suitable so as to allow chemicals to rest below the waterline within said interior cavity, said cavity having at least one water entrance
c) flotation chambers distributed in positions of neutral flotation relative to said bow mounted impeller and placed at predetermined locations on the skimmer body and on the dispenser body whereby the weight of chemicals added to said interior cavity shall have a substantially neutral affect on the floatation trim of said bow mounted impeller by virtue of the location of said flotation means relative to said bow mounted impeller and relative to the variable mass of chemicals placed inside of said dispenser.

4. The skimmer of claim 1 wherein water deflectors are placed downstream of said porous filter medium within said internal water channel whereby the thrust vector of water exiting said internal water channel of said skimmer shall be turned to a substantially rearwards direction, whereby the reaction force of such deflected water shall produce useful thrust propelling the skimmer in a predominantly forwards direction; with said water deflectors being chosen from the group consisting of:

a) rearward curved vanes located downstream from said porous filter media and curved in a manner so as to be essentially perpendicular to said porous filter media at its surface, and curving smoothly downwards and backwards towards the rear of the skimmer whereby water exiting from said porous filter medium shall be turned so as to exit and produce useful thrust in a predominantly rearwards direction
b) and a closed chamber having a rear exit, said rear exit placed downstream from said porous filter media whereby said closed chamber shall prevent significant water from exiting in any but a predominantly rearwards direction and whereby said rear exit shall open towards the rear of said skimmer so that exiting water shall produce thrust in a predominantly rearwards direction.

5. The skimmer of claim 1 wherein said porous filter medium shall include:

a) a sheet of a fine disposable filter medium b) a support grid in contact with said sheet of fine disposable filter medium and located on the downstream side of said sheet of fine disposable filter medium, said support grid physically connected in several places to said body of said skimmer, whereby said sheet of fine disposable filter medium may be supported by said support grid against the thrust of water traveling through said sheet of fine disposable filter medium c) a conventional clamping mechanism in contact with said sheet of fine disposable filter medium on the upstream side of said sheet of fine disposable filter medium, whereby said conventional clamping mechanism may secure at least the edges of said sheet of fine disposable filter medium firmly in contact with said support grid d) whereby the primary filtration of fine debris may be performed by said sheet of fine disposable filter medium, which sheet of fine disposable filter medium may be readily discarded when fouled by an accumulating layer of fine debris.

6. The skimmer of claim 1 wherein upstream and downstream are defined by the normal direction of water flow through said bow mounted impeller, said skimmer further including:

a) said porous filter medium located across said internal water channel in an essentially horizontal position whereby the downstream surface of said porous filter media shall constitute the bottom surface of said filter medium b) an essentially closed sump chamber located in said internal water channel, downstream of said bow mounted impeller and upstream of said bottom surface of said porous filter medium, with the sump chamber having a primary water exit through said porous filter medium whereby debris shall be retained within said closed sump chamber and whereby gravity shall assist waterlogged debris in eventually falling away from said bottom surface of said filter medium, whereby the debris may be retained inside of said closed sump chamber.

7. The skimmer of claim 1 further including:

a) a circuit to detect minimum solar input whereby a predetermined level of solar flux may be detected b) an electrical output from said circuit to detect minimum solar output producing an electrical signal in response to the ambient level of solar flux c) a circuit to turn on impeller motor electrically connected to said electrical output in a manner such that the absence of said electrical signal shall inhibit electrical power reaching said electrical motor and furthermore, the presence of said electrical signal shall abruptly provide electrical power to said electrical motor d) an electrical capacitor, electrically connected to said solar cell array whereby electrical power from said solar cell array shall be stored for sudden release upon said electrical signal e) whereby the extra electrical current stored by said electrical capacitor shall overcome the electrical starting load of said electrical motor with a smaller area of solar cell array than is possible without said electrical capacitor.

8. A solar swimming pool surface skimmer configured as a self propelled boat containing an internal water channel having a bow entrance at the waterline of the skimmer and an exit, the improvement comprising:

a) an electrical power means including a solar cell array whereby any circuits and motors on board the skimmer may be provided electrical power b) a porous filter medium oriented across said internal water channel suitable for the capture and retention of floating debris c) a bow mounted impeller, having a horizontal shaft transverse to the normal direction of travel of said skimmer, whereby water and floating debris shall be propelled in a rearwards direction through said internal water channel upon rotation of said bow mounted impeller in its normal direction of rotation d) a rear impeller whereby said skimmer may be propelled by rotary reaction with the surrounding water in either the forwards or reverse direction e) an electrical motor rotationally coupled to said bow mounted impeller by a conventional rotary energy transmission means including a shaft, said electrical motor electrically connected to said electrical power means whereby said bow mounted impeller may be caused to rotate f) a rear electrical motor rotationally coupled to said rear impeller by a conventional rotary energy transmission means including a shaft and electrically connected to said electrical power means whereby said rear impeller may be caused to rotate and whereby said skimmer may be propelled through the water independently of said bow mounted impeller in either the forwards or reverse direction g) a circuit to turn on impeller motor, having an electrical input receiving electrical signal, and having an electrical power output electrically connected to said impeller motor in the presence of said electrical signal, whereby said electrical motor may rotate said bow mounted impeller in the presence of said electrical signal, and cause it to cease rotation completely in the absence of said electrical signal h) a rear motor reverse circuit having an electrical output capable of reversing the rotation of said rear electrical motor by conventional motor reversal means, including switches or transistors electrically connected to said rear electrical motor i) said rear motor reverse circuit also having a second output capable of killing the output of said circuit to turn on impeller motor by conventional switching means, including transistors electrically connected to said circuit to turn on impeller motor, whereby reversing the direction of said rear motor shall also have the effect of killing the rotation of said impeller motor j) an inlet dam located below, closely fitted to, and adjacent to said bow mounted impeller k) said inlet dam and said bow mounted impeller, in combination, shall approximate a barrier to backwards flow of water and retained debris during times when said bow mounted impeller is not rotating l) whereby already gathered debris may be retained against backwashing through said front inlet at the waterline during times when said skimmer is not being propelled and also during times when said rear impeller shall be rotated in the reverse of its normal direction of rotation for purposes of reverse propulsion.

9. A solar swimming pool surface skimmer configured as a self propelled boat containing an internal water channel having a bow entrance at the waterline of the skimmer and an exit, the improvement comprising:

a) an electrical power means including a solar cell array b) a bow mounted impeller, having a horizontal shaft transverse to the normal direction of travel of said skimmer, whereby water and floating debris shall be propelled in a rearwards direction through said water internal channel upon rotation of said bow mounted impeller in its normal direction of rotation c) a porous filter medium oriented across said internal water channel suitable for the capture and retention of floating debris d) an electrical motor rotationally coupled to said bow mounted impeller by a conventional rotary energy transmission means, including a shaft, and electrically connected to said electrical power means whereby said bow mounted impeller may be caused to rotate e) a circuit to detect impeller speed having an electrical output whereby both a prolonged lack of forward rotation and resumption of forward rotation of said bow mounted impeller may produce unique electrical signals f) a movable barrier located adjacent to said bow mounted impeller and transverse to the water flow through said internal water channel whereby substantially all flow of water and debris through said internal water channel may be blocked g) a barrier moving means including a movable barrier motor, and conventional linkage means including at least a shaft, whereby said movable barrier may be emplaced or retracted from its position blocking water flow through said internal water channel h) a circuit to turn on barrier motor receiving input from said circuit to detect impeller speed and producing electrical power output electrically linking said movable barrier motor to said electrical power means, whereby said barrier motor shall be compelled to rotate for a short predetermined period of time at both the beginning and ending of periods of rotation of said bow mounted impeller i) a circuit to reverse barrier motor receiving input from said circuit to detect impeller speed and electrical outputs wired in a conventional manner suitable to reverse the direction of rotation of said movable barrier motor, whereby said movable barrier motor shall be encouraged to retract said movable barrier when said bow mounted impeller is rotating in a forwards direction, and encouraged to emplace said movable barrier when said bow mounted impeller is rotating in a reverse direction, and also when said bow mounted impeller is not rotating j) a microprocessor including a program, or an equivalent time delay circuit, with electrical outputs connected to said circuit to turn on barrier motor in a conventional manner, whereby the period of operation of said movable barrier motor shall be limited to a short predetermined time sufficiently long to fully emplace or fully retract said movable barrier from its position blocking water flow through said internal water channel.

10. A solar swimming pool skimmer configured as a self propelled boat containing an internal water channel having a bow entrance at the waterline of the skimmer and an exit, the improvement comprising:

a) an electrical power means including at least a solar cell array b) a bow mounted impeller whereby water and floating debris shall be propelled in a rearwards direction through said internal water channel upon rotation of said bow mounted impeller in its normal direction of rotation c) a porous filter medium oriented across said internal water channel suitable for capturing floating debris d) a conventional gear motor assembly, including an electrical motor, which gear motor's output shaft is connected by conventional rotary power transmission means including a shaft to said bow mounted impeller, said electrical motor being electrically powered by said electrical power means, whereby said bow mounted impeller may be caused to rotate e) said conventional gear motor assembly being mounted inside of a water tight box with a conventional low speed shaft seal located at any point where the output shaft of said conventional gear motor assembly shall pass through the walls of said water tight box f) where conventional sealing techniques are used to seal any additional holes in said watertight box, including any holes necessary for the passage of wires from said electrical motor to said electrical power means g) said watertight box being pneumatically connected to a predetermined quantity of moisture adsorbent material whereby said gear motor assembly shall be substantially protected from the corrosive effects of moisture and the corrosive effects of swimming pool chemicals h) said watertight box being pneumatically connected to a flexible diaphragm which shall constitute a yielding barrier between the external atmosphere and the interior of said watertight box whereby approximately zero relative pressure shall be maintained between the inside and outside of said watertight box to further inhibit the infiltration of moisture.

11. The skimmer of claim 10 further including:

a) a conventional storage battery electrically connected to said solar cell array b) an electronic control circuit including conventional battery charging circuitry c) said electronic control circuit also encased inside of said watertight box or a similar secondary watertight box d) whereby said electronic control circuit may also be protected against the infiltration of moisture and resulting corrosion.

12. A method of inhibiting propulsion of a self propelled solar swimming pool surface skimmer upon the skimmer leaving a shadow and entering sunlight, during times when said skimmer requires charging of a low storage battery, whereby the storage battery may be more effectively charged by prolonging the time spent in sunlight, the method comprising:

a) providing said skimmer configured as a self propelled boat containing an internal water channel having a bow entrance at the waterline of said skimmer and an exit b) providing said skimmer with propulsion means including a bow mounted impeller, an electrical motor rotationally coupled to said bow mounted impeller, and a conventional rotary energy transmission means including a shaft, with said conventional rotary energy transmission means rotationally linking said electrical motor with said bow mounted impeller, whereby said bow mounted impeller may be caused to rotate c) propelling water and floating debris in a rearwards direction through said internal water channel by means of rotation of said bow mounted impeller rotating in its normal direction of rotation d) providing a porous filter medium suitable for capturing floating debris oriented both within and transverse to said internal water channel e) providing an electrical power means including a solar cell array, electrically connected to an electrical storage battery f) charging said electrical storage battery in a conventional manner, utilizing electrical power from said solar cell array by way of a conventional battery charger circuit during times when said solar array is producing useful electrical energy and said electrical storage battery shall be in need of an electrical charge g) connecting the propulsion means electrically with said electrical power means whereby said propulsion means, including said electrical motor, shall be electrically powered to rotate h) providing a circuit to detect low battery condition that shall produce an electrical signal when the level of electrical charge of said electrical storage battery is lower than a predetermined low level i) providing a circuit to turn on impeller motor, which shall be configured so as to be able to turn on and off the electrical power to said propulsion means, including said electrical motor, in response to electrical signals provided to an input of said circuit to turn on impeller motor j) providing a circuit to detect minimum solar input which shall have an electrical output signaling if a predetermined minimum level of solar energy flux exists, predetermined to be the minimum level required for useful charging of said electrical storage battery by said solar cell array k) connecting both the electrical output of said circuit to detect low battery condition and the output of the circuit to detect minimum solar output to inputs of a microprocessor or equivalent decision making circuit l) providing the microprocessor with a program capable of making a logical decision of the AND variety based on the condition of these two inputs m) utilizing said microprocessor for producing an "off" signal at an output of said microprocessor IF both the electrical storage battery has a low charge AND IF there is sufficient solar energy flux to allow useful charging of said electrical storage battery n) using the "off" signal as an input to said circuit to turn on impeller motor in such a manner that it shall have the effect of turning off electrical power to said electrical motor during times that such a logical AND condition shall persist o) whereby the full voltage and current available from said solar cell array may be applied to the charging of said electrical storage battery without electrical competition from said electrical motor or other propulsion means during times when said electrical storage battery is in need of charging.

13. The method of claim 12 further including a time delay method, whereby motor running may be resumed after a period of time in sunlight, the method comprising:

a) providing a program for said microprocessor, or equivalent decision making circuitry, capable of producing an electrical signal, at an output of the microprocessor, after a predetermined time delay b) feeding said electrical signal into an input of said circuit to turn on impeller motor in such a manner that it shall cause resuming power application to said electrical motor after a predetermined time of charging said electrical solar battery utilizing electrical power from said solar array c) whereby said predetermined time delay for charging the battery in the sun shall be sufficiently long to favor charging said battery in the sun, without operating the skimmer, over operating in shadow, without totally eliminating operating the motor for extensive periods of time.

14. The method of claim 12 further including an intrusion alarm method, with said intrusion alarm method comprising:

a) providing a conventional swimming pool intrusion alarm including an intrusion sensor suitable for detecting the presence of unwanted visitors in the water of a swimming pool by conventional means such as acoustic detectors, sonar detectors, or wave detectors b) providing electrical power to said conventional swimming pool intrusion alarm from said electrical power means or other electrical power source c) providing an alarm circuit capable of providing an audible or other type of sensible alarm so as to warn swimming pool caretakers of such unwanted visitors within the water of a swimming pool d) connecting the output of the swimming pool intrusion alarm to said alarm circuit e) sensing the presence of unwanted visitors in the water of the swimming pool by means the swimming pool intrusion alarm f) using an electrical output of said swimming pool intrusion alarm to trigger the activation of said alarm circuit g) whereby swimming pool caretakers may be warmed by sensible alarms of the presence of unwanted visitors within the waters of a swimming pool.

15. The method of claim 12 further including a fault alarm method, whereby swimming pool caretakers may be warned of fault conditions in the operation of said skimmer, with said fault alarm method comprising:

a) providing said microprocessor with an input receiving an electrical signal from an output of a circuit to detect impeller speed and also with another input receiving an electrical signal from a circuit to detect lack of relative motion whereby the microprocessor may be informed of the speed of impeller rotation as well as any lack of motion of said skimmer relative to the surrounding water b) providing said microprocessor with a program, or equivalent decision making circuitry, capable of deciding, based on said electrical signal from said circuit to detect impeller speed, and said electrical signal from said circuit to detect lack of relative motion, whether fault conditions related to slowed propulsion, or slowed impeller rotation may warrant a condition of alarm c) deciding, utilizing said program, which shall analyze the conditions of these two inputs and therewith decide whether certain alarm conditions might exist, whereby a total lack of relative motion might indicate a stuck position of said skimmer, or a partial lack of relative motion might indicate a debris clogged filter medium, or a total lack of impeller rotation might indicate a debris clogged impeller d) providing said microprocessor with an output which shall produce an electrical signal, according to said program when conditions of said electrical inputs of said microprocessor reach conditions predetermined to represent a condition worthy of alarm, with the conditions specified in said program e) providing an alarm sensible to human beings and suitable for attracting their attention that may be triggered by said alarm circuit f) whereby nearby pool caretakers may be warned of a lack of skimmer propulsion or proper skimming, with possible cause for such alarm being: failure of propulsion indicating that said skimmer is physically being restrained from moving, slowed propulsion indicating a debris clogged filter medium, or stopped bow mounted impeller rotation indicating a debris clogged impeller.

16. The method of claim 12 further including a multiplexed electrical storage battery charging method, with the multiplexed charging method comprising:

a) providing a conventional means of cyclically interrupting electrical power provided to said propulsion means, including said circuit to turn on impeller motor, whereby electrical power from said power means to said propulsion means may be cyclically interrupted b) interrupting electrical power to said propulsion means cyclically at a predetermined high frequency, utilizing said conventional means of cyclically interrupting electrical power, whereby there shall be provided brief off cycles with essentially no electrical power reaching said propulsion means c) choosing said predetermined high frequency sufficiently high as to not allow said electrical motor to cease rotating during said brief off cycles d) providing switching means, including said conventional battery charger circuit, which may turn off battery charging when either said brief off cycles shall occur or when said electrical storage battery shall not be in need of electrical charge e) switching electrical power from said solar cell array by said switching means so as to make electrical power available for charging said electrical storage battery during said brief off cycles and furthermore preventing, by said switching means, such charging of said electrical storage battery during times when said electrical power means are providing power to said propulsion means f) whereby the electrical load represented by said propulsion means shall not cause a large voltage drop during times when said electrical storage battery is being charged and whereby the electrical load represented by charging said electrical storage battery shall not cause a voltage drop during times when said propulsion means are being provided with electrical power.

17. The method of claim 12 further including a method to extend battery life by causing periodic cycles of operation during the night, the method comprising:

a) providing said microprocessor with software capable of receiving electrical inputs, and making logical decisions according to an internal program, affecting electrical outputs, on the basis of the both the conditions of electrical inputs and microprocessor clock related timing periods of programmable duration and frequency b) connecting, electrically, said circuit to detect minimum solar input to an input of said microprocessor in such a manner that the condition of said input is capable of providing said microprocessor with information regarding whether it is night or day, relative to solar brightness c) providing a microprocessor output electrically connected to said circuit to turn on motor whereby a program controlled variation of said microprocessor output may turn on or off said electrical motor d) providing a program for said microprocessor designed to trigger said output so as to turn on said electrical motor during times of low solar input, as sensed at said input of said microprocessor, but only at predetermined relatively long time intervals, on the order of an hour, and only for predetermined relatively short periods of operation, on the order of several minutes, as measured by said microprocessor clock e) utilizing said circuit to detect minimum solar input to inform said microprocessor, by way of said input, that there is a condition of low solar input typical of night f) utilizing said program to measure and signal, by way of said output, when both said condition of low solar input typical of night AND said relatively short period of operation, interspersed with said relatively longer time intervals, shall apply g) whereby said skimmer shall be caused to periodically operate for short periods of time with its normal debris skimming functions interspersed with relatively longer periods with virtually no operation, even in conditions of low solar flux.

18. The method of claim 12 further including a method to navigate out of shadows comprising:

a) providing an input to said microprocessor from said circuit to detect minimum solar input b) providing said microprocessor with the capability of using an internal timer based on said microprocessor's clock, combined with other logical functions, to determine the state of an electrical output of said microprocessor c) utilizing said input to said microprocessor to inform said microprocessor of any decrease of solar flux below a certain predetermined low level of sunshine threshold judged to be sufficient to operate said skimmer by the electrical output of said solar cell arrays alone d) providing an electrical output from said microprocessor, electrically connected to said circuit to turn on impeller motor in such a manner that a signal or lack of signal from said electrical output shall have the effect of turning on or off said propulsion means, respectively e) providing a program for said microprocessor which shall control said electrical output from said microprocessor in response to input including said electrical input as well as a time delay initiated using the internal timer f) sensing said decrease of solar flux during a time when said skimmer is being propelled, by means of said input to said microprocessor g) initiating a predetermined time delay, by means of said program and said internal program, upon said sensing decrease of solar flux h) allowing said electrical output to said microprocessor to produce a signal for a period of several minutes during said predetermined time delay, whereby said circuit to turn on motor shall provide power to said propulsion means i) sensing, by means of said sensor to detect minimum solar input, any resumption of a higher level of solar flux, and resetting said timer to its maximum time duration each time said input to said microprocessor shall indicate such a resumption of a higher level of solar flux j) terminating said signal to said electrical output of said microprocessor upon the end of said predetermined time delay, if such resumption of a higher level of solar flux should occur during the predetermined time delay period k) whereby said skimmer, upon entering a shadow, and hence transitioning to a low level of solar flux, shall be caused to continue to be propelled by said propulsion means for a period of time, predetermined to be of sufficient temporal length to enable navigating out of most average sized shadows, and back into any remaining regions of adequate solar flux remaining in the operating area of said skimmer.

19. A method of deflecting a self propelled solar swimming pool skimmer away from the walls a swimming pool, the method comprising:

a) providing a self propelled swimming pool skimmer of the class having a body configured as a boat, said body having an internal water channel containing a porous filtration medium suitable for capturing floating debris, said internal water channel having a bow entrance at the waterline and an exit, said skimmer having an electrical power means and an impeller rotated by conventional rotary energy transmission means including a shaft that is physically connected to an electrical motor, with said electrical motor being electrically connected to said electrical power means whereby said impeller may be caused to rotate in a manner promoting both propulsion of the skimmer through the surrounding water and the flow of water through said internal water channel b) providing horizontal powered bumper wheels having vertical shafts, said powered bumper wheels having rims protruding beyond the body of the skimmer, said powered bumper wheels being placed at locations on said body most likely to suffer collisions with said walls of a swimming pool c) rotating said powered bumper wheels by conventional rotary power transmission means including a shaft, connected to said electric motor and electrically powered by said electrical power means d) rotating said powered bumper wheels in a direction such that their contacting a wall of a swimming pool will cause a propulsive reaction force conducive to turning said skimmer away from said wall e) whereby the rotation of said bumper wheels shall provide a secondary means of propulsion that shall actively deflect said skimmer to starboard or port upon contact of a bumper wheel with any obstacle, thereby preventing the normal thrusting force of said impeller from resulting in said skimmer becoming stuck against a wall, stuck against and obstacle, or stuck in a corner of said swimming pool.

20. A method of clearing debris from a clogged impeller of a self propelled solar swimming pool skimmer comprising:

a) providing said skimmer with a body configured as a boat b) providing said body with an internal water channel, said internal water channel having a bow entrance at the waterline and an exit c) providing said internal water channel with a porous filtration medium located transverse to the water flow through said internal water channel, with said porous filter medium chosen to be suitable for capturing floating debris d) providing said skimmer with an electrical power means including a solar cell array e) providing said skimmer with a bow mounted impeller oriented transverse to said internal water channel such that rotation of the impeller shall propel water and floating debris into said internal water channel f) rotating said impeller by way of conventional rotary energy transmission means including a shaft that is physically connected to an electrical motor, with said electrical motor being electrically connected to said electrical power means whereby said impeller may be caused to rotate in a manner promoting both propulsion of the skimmer through the surrounding water and the flow of water through said internal water channel g) propelling said skimmer over the surface of a swimming pool by means including the thrust of said impeller h) providing a circuit to detect impeller speed which shall provide an electrical signal upon detection of a prolonged absence of rotation of said impeller i) sensing the prolonged absence of rotation of said impeller, and feeding the resulting electrical signal to a circuit to reverse motor j) causing said impeller to operate in its reverse direction for a brief predetermined period of time, by virtue of the influence of said electrical signal on said circuit to reverse motor, whereby said electrical motor, and hence said impeller, shall be caused to briefly operate in reverse direction subsequent to said circuit to reverse motor having received said electrical signal k) sensing once more, by means of said circuit to detect impeller speed, whether there is any prolonged lack of impeller rotation l) repeating such brief periods operation of the impeller in reverse direction upon reoccurrence of such a prolonged absence of impeller rotation by said circuit to detect impeller speed m) resuming normal direction of impeller rotation if no prolonged absence of impeller rotation is subsequently detected, n) whereby said skimmer shall clear said impeller of debris clogs by means of quickly ejecting debris through reverse direction of impeller rotation, subsequently detecting resumption of rotation and, as a result resuming normal forwards rotation of said impeller before any significant quantity of already gathered debris may be ejected.

21. The method of claim 20 further including a method to turn the skimmer off after repeated failures to clear a debris clogged impeller, the method comprising:

a) providing a microprocessor or equivalent electronic decision making circuitry b) providing an input of said microprocessor receiving the electrical signal of said circuit to detect impeller speed whereby said microprocessor may be informed of the number of cycles of operation of said impeller in a reverse direction of rotation c) providing a program for said microprocessor capable of counting changes of state of said input of said microprocessor, and responding to said count by influencing the electrical state of the output of said microprocessor d) counting or otherwise measuring a predetermined number of cycles of operation of said impeller in reverse direction, by incrementing a register or other memory location associated with said microprocessor e) providing an output of said microprocessor feeding an electrical signal to a circuit to turn on impeller motor, whereby said electrical motor may be turned on an off f) producing a signal at said output of said microprocessor when the register or other memory location associated with said microprocessor shall reach a predetermined value g) utilizing the signal, received by said circuit to turn on impeller motor, as a signal to turn off electrical power to said electrical motor h) leaving off said electrical motor for a predetermined long period of time, or until said microprocessor shall detect some other signal indicating a benefit to resuming operation of said skimmer i) resetting said register or other memory location associated with said microprocessor to a lower value and resuming normal operation of said electrical motor j) whereby said electrical motor shall be compelled to attempt to clear itself of clogs by multiple attempts at reversals of impeller rotation at long time intervals, rather than continuously.

22. The method of claim 20 further including a method for navigation reversals comprising:

a) providing a sensor to detect lack of relative motion which shall use conventional means to detect prolonged lack of motion of said skimmer relative to the surrounding water, and providing an electrical signal in response b) providing a microprocessor, or equivalent control circuitry having an input receiving said electrical signal, whereby the microprocessor shall be apprised of any prolonged lack of motion of said skimmer c) providing said microprocessor with a program which shall, in response to said electrical signal, cause an output of said microprocessor to produce an output signal, said output signal lasting for a predetermined time on the order of several seconds d) connecting said output of said microprocessor to said motor reverse circuit in such a manner that said output signal shall have the effect of reversing the direction of said electrical motor, and, in turn, the direction of rotation of said impeller, for said predetermined time whereby said motor reverse circuit shall essentially act as a motor reverse relay that reverses the direction of rotation of said electrical motor, and thereby the direction of rotation of said bow mounted impeller for a period of several seconds e) whereby propulsion of the skimmer shall proceed in a reverse direction for a predetermined time sufficient to cause it to navigate in a backwards direction away from obstacles that said skimmer is not otherwise capable of circumnavigating.

* * * * *